US011309154B2

(12) United States Patent
Ikushima et al.

(10) Patent No.: US 11,309,154 B2
(45) Date of Patent: Apr. 19, 2022

(54) CONTACT DEVICE AND ELECTROMAGNETIC RELAY

(71) Applicant: PANASONIC INTELLECTUAL PROPERTY MANAGEMENT CO., LTD., Osaka (JP)

(72) Inventors: Kimiya Ikushima, Osaka (JP); Satoshi Nishita, Mie (JP); Takeshi Okada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/054,011

(22) PCT Filed: May 20, 2019

(86) PCT No.: PCT/JP2019/019823
§ 371 (c)(1),
(2) Date: Nov. 9, 2020

(87) PCT Pub. No.: WO2019/225524
PCT Pub. Date: Nov. 28, 2019

(65) Prior Publication Data

US 2021/0159036 A1 May 27, 2021

(30) Foreign Application Priority Data

May 23, 2018 (JP) ..... JP2018-099156
Jan. 18, 2019 (JP) ..... JP2019-007305

(51) Int. Cl.
*H01H 50/38* (2006.01)
*H01H 50/58* (2006.01)
*H01H 50/24* (2006.01)

(52) U.S. Cl.
CPC ..... *H01H 50/38* (2013.01); *H01H 50/24* (2013.01); *H01H 50/58* (2013.01)

(58) Field of Classification Search
CPC ..... H01H 1/54; H01H 50/24; H01H 50/38; H01H 50/58; H01H 77/107; H01H 50/56
See application file for complete search history.

(56) References Cited

U.S. PATENT DOCUMENTS

2009/0033446 A1* 2/2009 Gruner ..... H01H 1/26 335/129
2009/0134962 A1 5/2009 Nishida
(Continued)

FOREIGN PATENT DOCUMENTS

DE 10 2014 106 957 A1 7/2015
JP S52-128041 U 9/1977
(Continued)

OTHER PUBLICATIONS

Machine Translation of JP2016072021A (Year: 2016).*
(Continued)

*Primary Examiner* — Bernard Rojas
(74) *Attorney, Agent, or Firm* — McDermott Will & Emery LLP

(57) ABSTRACT

A first end portion includes a first contact. A second end portion includes a second contact. At least a first end portion, out of the first end portion and a second end portion, is curved to be folded back from a tip in one direction of the first end portion. The first contact is located in a folded-back part of the first end portion and faces the second contact.

20 Claims, 37 Drawing Sheets

(56) References Cited

U.S. PATENT DOCUMENTS

| | | | | |
|---|---|---|---|---|
| 2013/0335175 | A1* | 12/2013 | Tachikawa | H01H 50/546<br>335/147 |
| 2015/0206685 | A1* | 7/2015 | Naka | H01H 50/02<br>335/187 |
| 2020/0105488 | A1 | 4/2020 | Ikushima et al. | |

FOREIGN PATENT DOCUMENTS

| | | | |
|---|---|---|---|
| JP | S63-69346 | U | 5/1988 |
| JP | 2007-073308 | A | 3/2007 |
| JP | 2014-013747 | A | 1/2014 |
| JP | 2016-072021 | A | 5/2016 |
| JP | 2017-059353 | A | 3/2017 |

OTHER PUBLICATIONS

International Search Report and Written Opinion issued in International Patent Application No. PCT/JP2019/019823, dated Aug. 20, 2019; with partial English translation.

Extended European Search Report dated Jun. 25, 2021, issued in corresponding European Patent Application No. 19806789.4.

* cited by examiner

CONTACT DEVICE AND ELECTROMAGNETIC RELAY

CROSS-REFERENCE OF RELATED APPLICATIONS

This application is the U.S. National Phase under 35 U.S.C. § 371 of International Patent Application No. PCT/JP2019/019823, filed on May 20, 2019, which in turn claims the benefit of Japanese Application No. 2018-099156, filed on May 23, 2018 and Japanese Application No. 2019-007305, filed on Jan. 18, 2019, the entire disclosures of which Applications are incorporated by reference herein.

TECHNICAL FIELD

The present disclosure generally relates to a contact device and an electromagnetic relay, and more particularly relates to a contact device including a moving contact and a fixed contact and an electromagnetic relay including such a contact device.

BACKGROUND ART

Patent Literature 1 discloses an electromagnetic relay including: a base; an electromagnet block; an armature; a card; a moving contact portion including a moving contact and attached to the base; and a fixed contact portion including a fixed contact and attached to the base. The armature reciprocates as the electromagnet block is excited or non-excited. The card slides as the armature reciprocates. The moving contact moves as the card slides. As the moving contact moves, the moving contact comes into, and goes out of, contact with the fixed contact.

In the electromagnetic relay of Patent Literature 1, an arc may be generated when the moving contact goes out of contact with the fixed contact. Thus, such an electromagnetic relay (contact device) is sometimes required to improve its arc extinction performance.

CITATION LIST

Patent Literature

Patent Literature 1: JP 2017-059353 A

SUMMARY OF INVENTION

It is therefore an object of the present disclosure to provide a contact device and an electromagnetic relay, both of which are configured to improve the arc extinction performance.

A contact device according to an aspect of the present disclosure includes a first conductive portion and a second conductive portion. The first conductive portion includes a first end portion and a first extended portion. The first end portion includes a first contact. The first extended portion is provided to extend in one direction and connected to the first end portion at a tip in the one direction of the first extended portion. The second conductive portion includes a second end portion and a second extended portion. The second end portion includes a second contact. The second extended portion is provided to extend in the one direction and connected to the second end portion at a tip in the one direction of the second extended portion. One contact selected from the group consisting of the first contact and the second contact is a moving contact. The other contact selected from the group consisting of the first contact and the second contact is a fixed contact. The moving contact moves between a closed position where the moving contact is in contact with the fixed contact and an open position where the moving contact is out of contact with the fixed contact. At least the first end portion, out of the first end portion and the second end portion, is curved to be folded back from a tip in the one direction of the first end portion. The first contact is located in a folded-back part of the first end portion and faces the second contact.

An electromagnetic relay according to another aspect of the present disclosure includes the contact device described above and a driving unit. The driving unit includes a coil and an armature. The armature is displaced according to a variation in energization state of the coil to drive a conductive portion having the moving contact, which is either the first conductive portion or the second conductive portion, and thereby move the moving contact between the closed position and the open position.

BRIEF DESCRIPTION OF DRAWINGS

FIG. 16 illustrates a principal part of a cross section taken along the plane X2-X2 shown in

FIG. 2;

FIG. 17 illustrates a principal part of a cross section taken along the plane X3-X3 shown in

FIG. 2;

DESCRIPTION OF EMBODIMENTS

Next, a contact device and electromagnetic relay according to some embodiments will be described with reference to the accompanying drawings Note that the embodiments to be described below are only exemplary ones of various embodiments of the present disclosure and should not be construed as limiting. Rather, those embodiments may be readily modified in various manners depending on a design choice or any other factor without departing from the scope of the present disclosure. The drawings to be referred to in the following description of embodiments are all schematic representations. That is to say, the ratio of the dimensions (including thicknesses) of respective constituent elements illustrated on the drawings does not always reflect their actual dimensional ratio.

First Embodiment (Configuration of Electromagnetic Relay)

Figure 10:
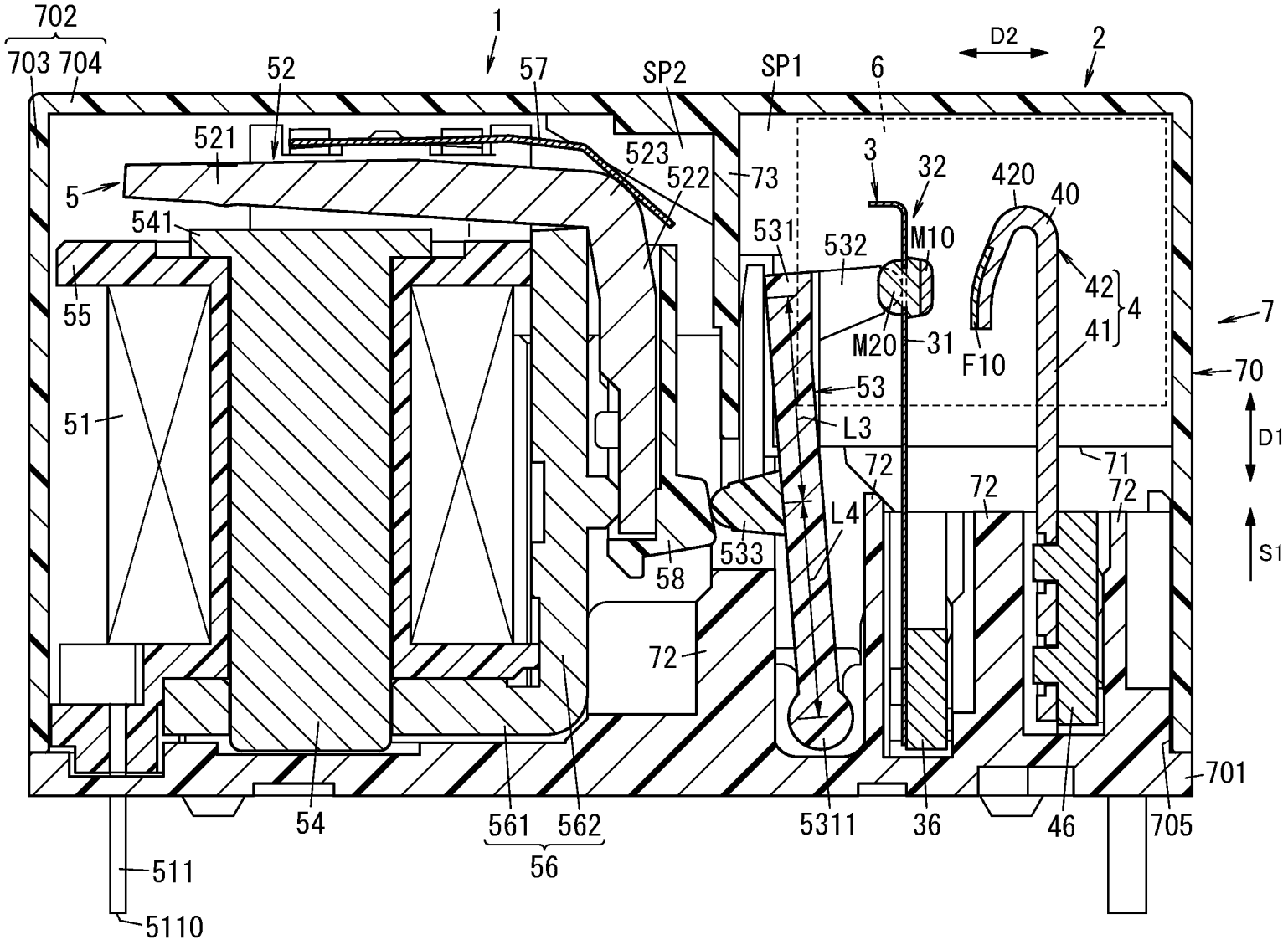
FIG. 10 is a cross-sectional view taken along the plane X1-X1 shown in FIG. 2 and illustrating a state where no current flows through the coil to keep a moving contact and a fixed contact out of contact with each other.

FIGS. 1-5 illustrate the appearance of an electromagnetic relay 1 according to an exemplary embodiment. FIGS. 6-9 illustrate the appearance of the electromagnetic relay 1 from which a cover 702 is removed. FIG. 10 is a cross-sectional view taken along the plane X1-X1 shown in FIG. 2.

As shown in FIG. 10, the electromagnetic relay 1 according to this embodiment includes a contact device 2 and a driving unit 5. The contact device 2 includes a moving conductive portion 3 (second conductive portion) and a fixed conductive portion 4 (first conductive portion). The moving conductive portion 3 includes an extended portion 31 (second extended portion) and an end portion 32 (second end portion). The end portion 32 includes a moving contact M10 (second contact). The fixed conductive portion 4 includes an extended portion 41 (first extended portion) and an end portion 42 (first end portion). The end portion 42 includes a fixed contact F10 (first contact). The driving unit 5 includes a coil 51 and an armature 52. The contact device 2 further includes two permanent magnets 6 (see FIG. 15) and a case 7.

Figure 11:
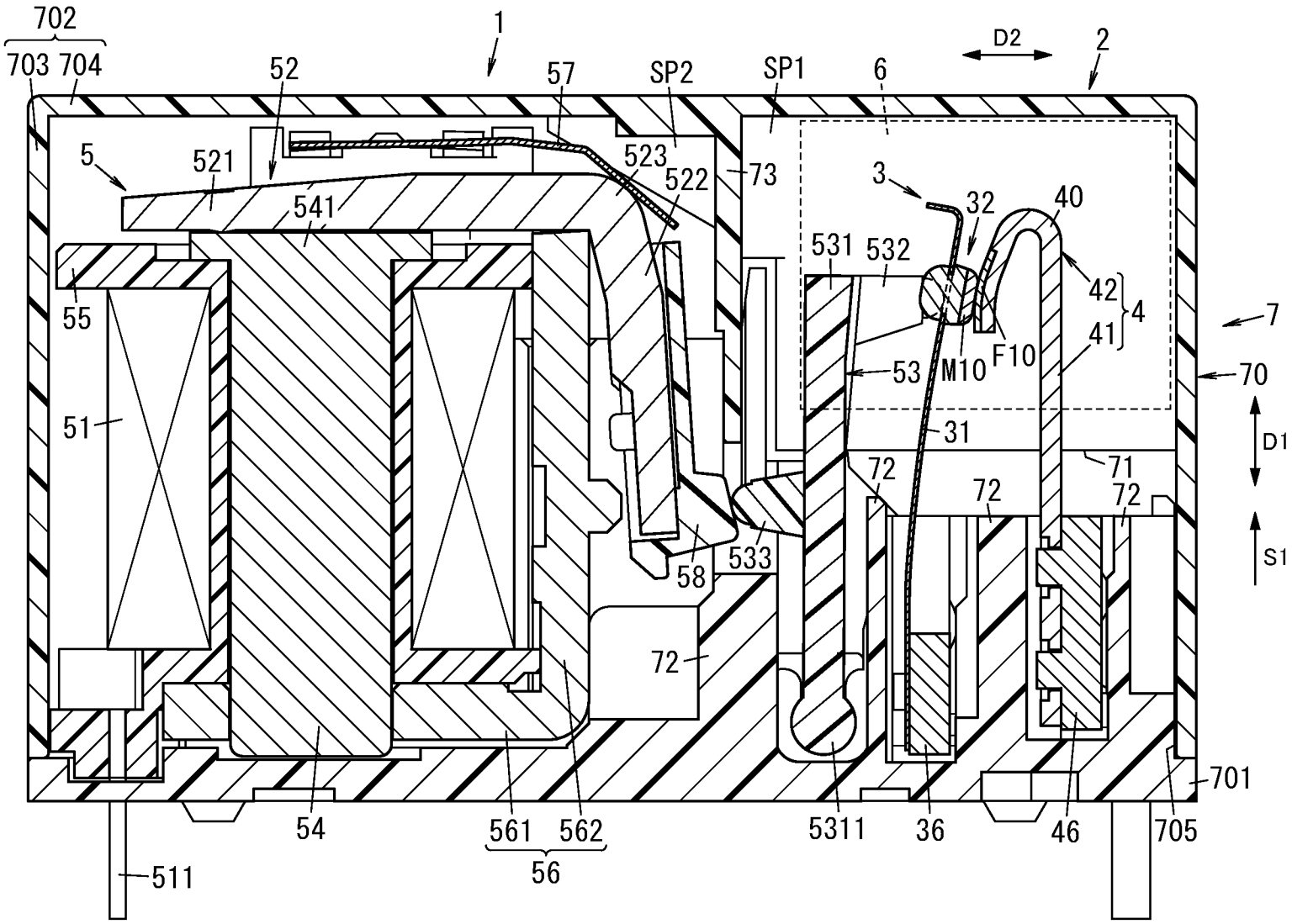
FIG. 11 is a cross-sectional view thereof taken along the plane X1-X1 shown in FIG. 2 and illustrating a state where a current flows through the coil to bring the moving contact and the fixed contact into contact with each other.
Figure 12:
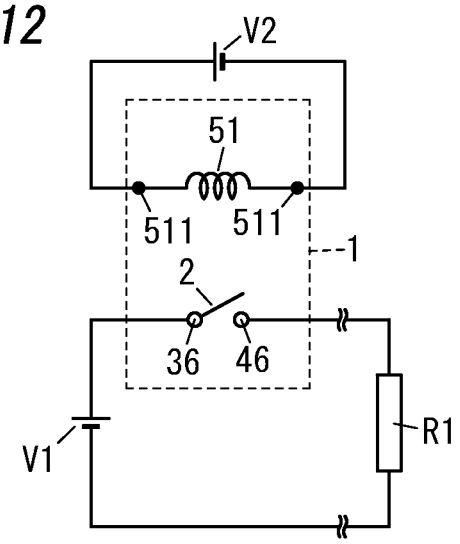
FIG. 12 is a circuit diagram of an electric circuit including the electromagnetic relay.

The electromagnetic relay 1 is a so-called "hinged relay." The electromagnetic relay 1 may be used, for example, in an inrush current limiter circuit for limiting the amount of an inrush current to flow through a power supply circuit for a solar panel, a power supply circuit for a storage battery, or a power supply circuit for a DC feeding type server. The electromagnetic relay 1 is a device for controlling the supply of a DC current from a DC power supply V1 to a load R1 (see FIG. 12). The DC power supply V1 supplies a current to the load R1 via the contact device 2. In the electromagnetic relay 1, the driving unit 5 drives the moving conductive portion 3 and thereby moves the moving contact M10 between a closed position where the moving contact M10 is in contact with the fixed contact F10 (i.e., the position shown in FIG. 11) and an open position where the moving contact M10 is out of contact with the fixed contact F10 (i.e., the position shown in FIG. 10). This allows the supply of the DC current from the DC power supply V1 to the load R1 to be controlled. FIG. 12 illustrates an example of a circuit in which the electromagnetic relay 1 is applied to an inrush current limiter circuit.

The driving unit 5 further includes a card 53, an iron core 54, and a coil bobbin 55. The coil 51 is a conductive wire wound around the coil bobbin 55. The iron core 54 is arranged inside the coil bobbin 55. The armature 52 is displaced according to a variation in the energization state of the coil 51 to drive the moving conductive portion 3 and thereby move the moving contact M10 between the open position and closed position. While the coil 51 is not energized, the armature 52 is out of contact with the iron core 54 and the moving contact M10 is located at the open position where the moving contact M10 is out of contact with the fixed contact F10. When the coil 51 is energized, a magnetic field generated by the coil 51 causes a first plate portion 521 of the armature 52 to be attracted toward the iron core 54 to displace the first plate portion 521 and thereby change the orientation of the armature 52. As the orientation of the armature 52 changes, the card 53 is displaced, thus making the card 53 drive the moving conductive portion 3. This causes the moving contact M10 to move from the open position to the closed position and come into contact with the fixed contact F10.

The extended portion 31 of the moving conductive portion 3 is formed in the shape of a rectangular plate. The extended portion 31 has length in one direction S1. In other words, the extended portion 31 is provided to extend in the one direction S1. More specifically, the longitudinal axis of the extended portion 31 is aligned with the one direction S1. As used herein, the "one direction S1" agrees with the direction in which the extended portion 31 extends from a base 701 (to be described later) of the case 7. The extended portion 41 of the fixed conductive portion 4 is formed in the shape of a rectangular plate. The extended portion 41 has length in the one direction S1. In other words, the extended portion 41 is provided to extend in the one direction S1. More specifically, the longitudinal axis of the extended portion 41 is aligned with the one direction S1.

In the following description, a first direction D1, a second direction D2, and a third direction D3 (see FIG. 13) are defined as follows. The first direction D1 is aligned with the one direction S1. The second direction D2 is perpendicular to the first direction D1 and aligned with the direction in which the moving contact M10 and the fixed contact F10 face each other. The third direction D3 is perpendicular to both the first direction D1 and the second direction D2.

Figure 13:
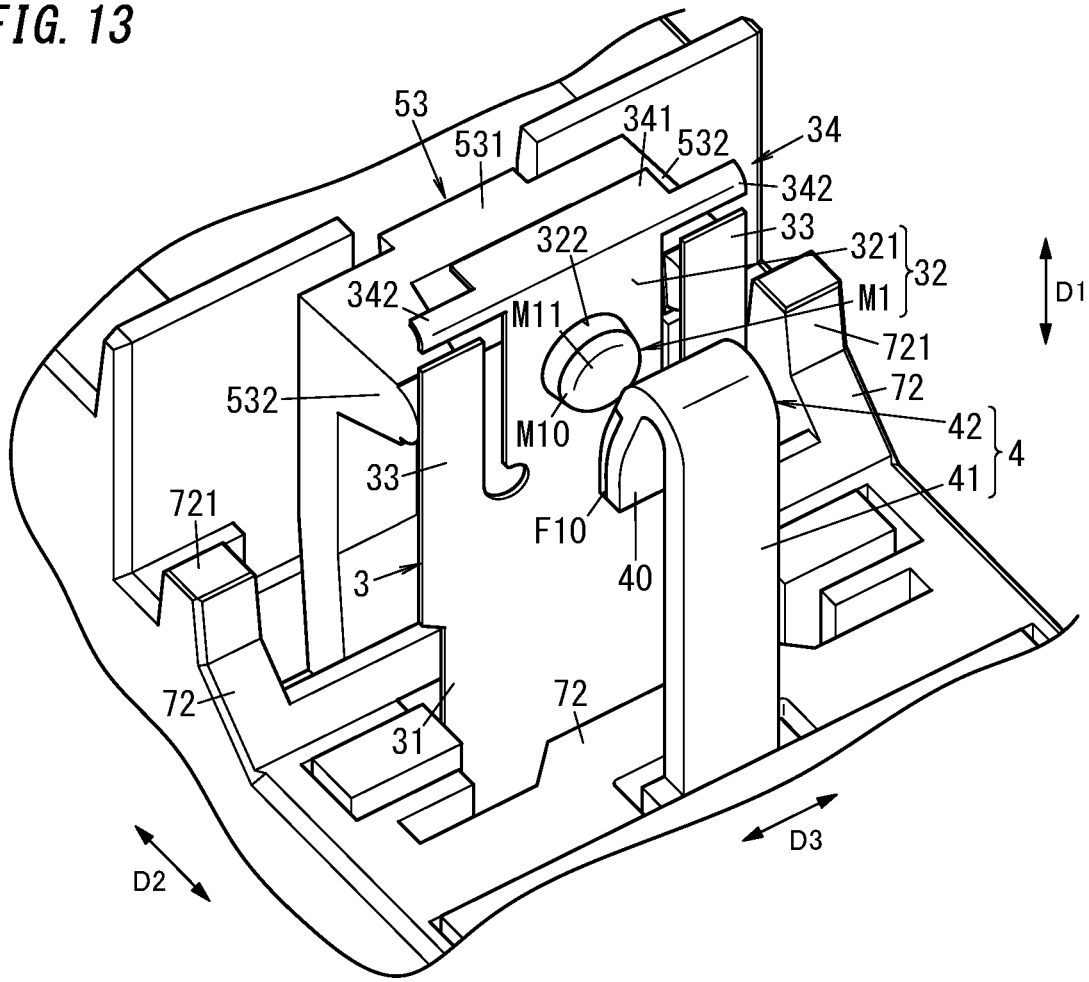
FIG. 13 is a perspective view illustrating a principal part of the electromagnetic relay.

As shown in FIGS. 10 and 13, the end portion 32 of the moving conductive portion 3 includes a contact member M1 with the moving contact M10 and a base portion 321. The base portion 321 is formed in a plate shape. The extended portion 31 is connected to the base portion 321 at the tip in the one direction S1. The base portion 321 is formed integrally with the extended portion 31. More specifically, the base portion 321 and the extended portion 31 form integral parts of a single member. The base portion 321 and the extended portion 31 have elasticity. The base portion 321 has an attachment hole 322.

The contact member M1 is formed in the shape of a rivet. That is to say, the moving contact M10 is a rivet contact. A head portion, facing the fixed contact F10, of the contact member M1 (rivet) is the moving contact M10. That part, forming the moving contact M10, of the contact member M1 may be made of a silver alloy (such as AgNi or $AgSnO_2$), for example. A body portion M20 of the contact member M1 is passed through the attachment hole 322. The contact member M1 is fixed to the base portion 321. More specifically, with the body portion M20 thereof passed through the attachment hole 322, the contact member M1 is fixed by caulking to the base portion 321. The contact member M1 is electrically connected to the base portion 321. A surface M11, facing the fixed contact F10, of the moving contact M10 has a spherical shape. Nevertheless, in this embodiment, the surface M11 has a rather flat spherical shape. Alternatively, the surface M11 may have a convex shape.

The moving conductive portion 3 further includes two contact pressure portions 33. The two contact pressure portions 33 are parts, receiving force from the card 53, of the moving conductive portion 3. Each of the two contact pressure portions 33 is formed in a plate shape. Each of the two contact pressure portions 33 has elasticity. The two contact pressure portions 33 are connected to a first end along the length of the extended portion 31. The two contact pressure portions 33 are arranged such that one contact pressure portion 33, the base portion 321, and the other contact pressure portion 33 are arranged in this order in the third direction D3.

The moving conductive portion 3 further includes a facing portion 34 facing the card 53 in the first direction D1. The facing portion 34 is located opposite from the fixed contact F10 when viewed from the surface M11, facing the fixed contact F10, of the moving contact M10 (i.e., with respect to the surface M11). The facing portion 34 forms an integral part of the base portion 321. More specifically, the facing portion 34, the base portion 321, the extended portion 31, and the two contact pressure portions 33 form respective parts of a single member. The facing portion 34 includes a body portion 341 and two arm portions 342.

One of the two arm portions 342 protrudes from a first end, defining one end in one of the two third directions D3, of the body portion 341. The other arm portion 342 protrudes from a second end, defining the other end in the opposite one of the two third directions D3 (i.e., the end opposite from the first end) of the body portion 341.

The fixed conductive portion 4 includes an extended portion 41 and an end portion 42. The end portion 42 includes the fixed contact F10. The extended portion 41 and the end portion 42 refer to respective regions of the fixed conductive portion 4.

The extended portion 41 is formed in a rectangular plate shape. The extended portion 41 is connected to the end portion 42 at the tip in the one direction S1. The end portion 42 is formed in a band shape. The end portion 42 is curved to be folded back from the tip 420 in the one direction S1 of the end portion 42. The fixed contact F10 is located in the folded-back part of the end portion 42 and faces the moving contact M10. More specifically, the end portion 42 is formed in a U-shape when viewed in the third direction D3.

Figure 14:
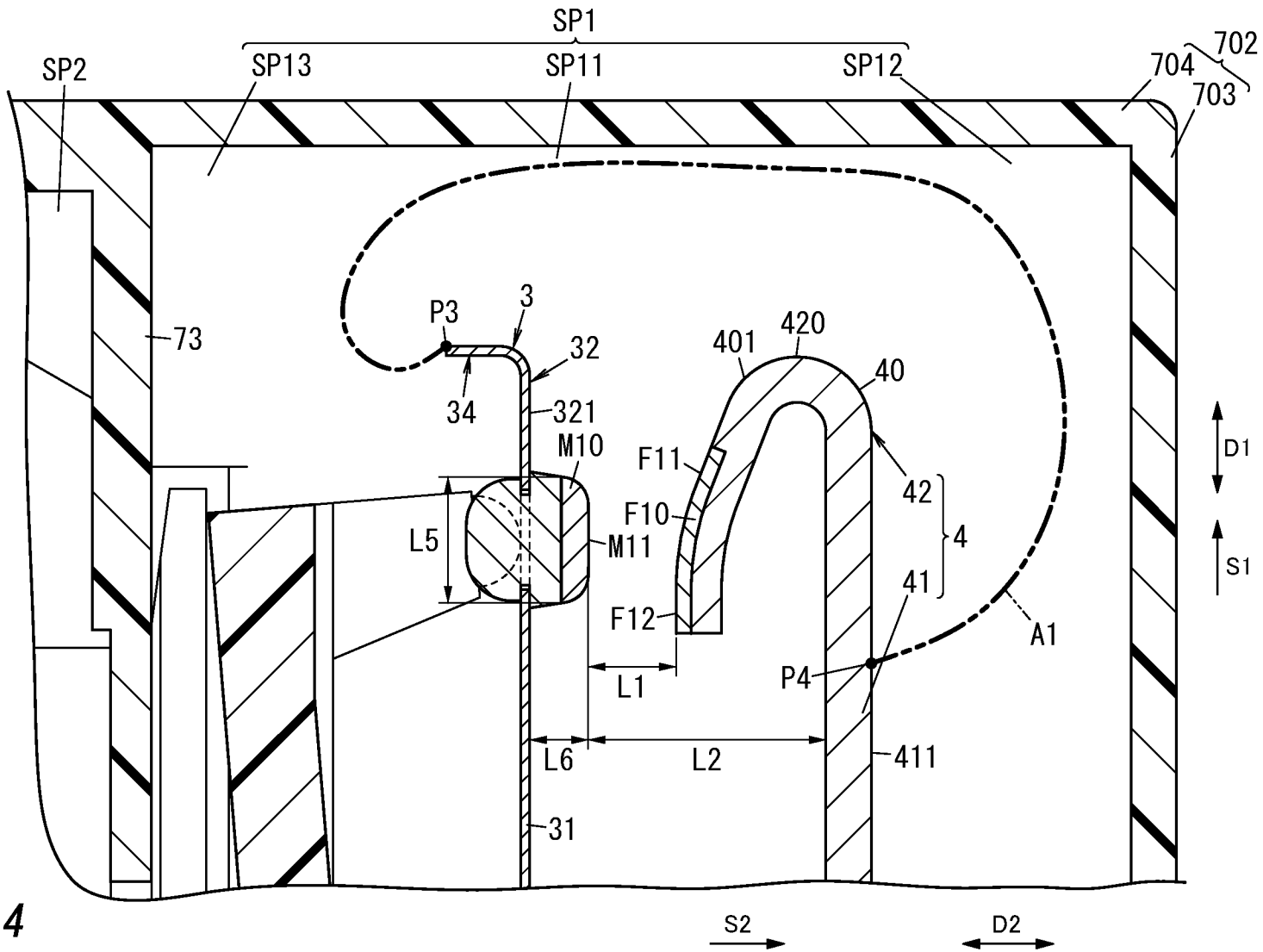
FIG. 14 is a cross-sectional view illustrating the principal part of the electromagnetic relay to schematically show how an arc is generated.

As shown in FIG. 14, a surface, facing the end portion 32 of the moving conductive portion 3, of the end portion 42 of the fixed conductive portion 4 is curved in an arc shape when viewed in the third direction D3. In this embodiment, the surface, facing the end portion 32 of the moving conductive portion 3, of the end portion 42 of the fixed conductive portion 4 is a first surface F11 of the end portion 42. In this embodiment, the first surface F11 of the end portion 42 of the fixed conductive portion 4 faces the moving contact M10 at the end portion 32 of the moving conductive portion 3. The gap distance L1 as measured in the second direction D2 between the fixed contact F10 and the moving contact M10 is shorter than a distance L2 as measured in the second direction D2 between the extended portion 41 connected to the curved end portion 42, out of the two end portions 32, 42, and the moving contact M10 that is the contact included in the other end portion 32. The first surface F11 is curved to extend from the tip 420 in the one direction S1 of the end portion 42 toward the end portion 32.

The fixed contact F10 includes a flat, second surface F12 adjacent to the first surface F11. The second surface F12 is provided to extend from the first surface F11 in the direction opposite from the one direction S1. The second surface F12 is perpendicular to the second direction D2. As used herein, the second surface F12 being "perpendicular to" the second direction D2 refers to not only a situation where the second surface F12 and the second direction D2 intersect with each other at exactly right angles (90 degrees) but also a situation where the second surface F12 and the second direction D2 intersect with each other at generally right angles. For example, when the second surface F12 is "perpendicular to" the second direction D2, the second surface F12 and the second direction D2 may intersect with each other at an angle falling within the range from 65 degrees to 115 degrees.

A direction aligned with the second direction D2 and pointing from the moving contact M10 toward the fixed contact F10 (as indicated by the arrow S2 in FIG. 14) is herein supposed to be a positive X-axis direction. Since the first surface F11 is curved, the angle defined by a normal to the first surface F11 with respect to a normal to the second surface F12 varies according to the position of the normal to the first surface F11. An acute angle formed between the normal to the first surface F11 and the normal to the second surface F12 increases monotonically as the position of the normal to the first surface F11 changes in the positive X-axis direction.

As shown in FIGS. 10, 13, and 14, the fixed conductive portion 4 includes the fixed contact F10 and a base member 40. The fixed contact F10 and the base member 40 refer to respective members that form the fixed conductive portion 4. The base member 40 includes a part (i.e., region other than the fixed contact F10) of the end portion 42 and the extended portion 41. The fixed contact F10 may be made of, for example, a silver oxide such as silver tin oxide or silver nickel. The base member 40 may be made of, for example, a copper alloy such as phosphorus bonze, a copper alloy including chromium (i.e., a copper-chromium alloy) or a copper alloy including tin (a copper-tin based alloy).

The fixed conductive portion 4 is a cladding member. That is to say, the fixed contact F10 is crimped to the base member 40. More specifically, the fixed contact F10 is fixed to the base member 40 by being crimped to the base member 40 by, for example, cold pressure welding or cold crimping.

The fixed conductive portion 4 is an inlay cladding member in which the fixed contact F10 is embedded in the base member 40. The surface 401 of the base member 40 is flush with the first surface F11, facing the moving contact M10, of the fixed contact F10.

The contact device 2 further includes a first terminal portion 36 and a second terminal portion 46. The first terminal portion 36 is electrically and mechanically connected to the moving conductive portion 3. The first terminal portion 36 supports the moving conductive portion 3. The second terminal portion 46 is electrically and mechanically connected to the fixed conductive portion 4. The second terminal portion 46 supports the fixed conductive portion 4.

Figure 1:
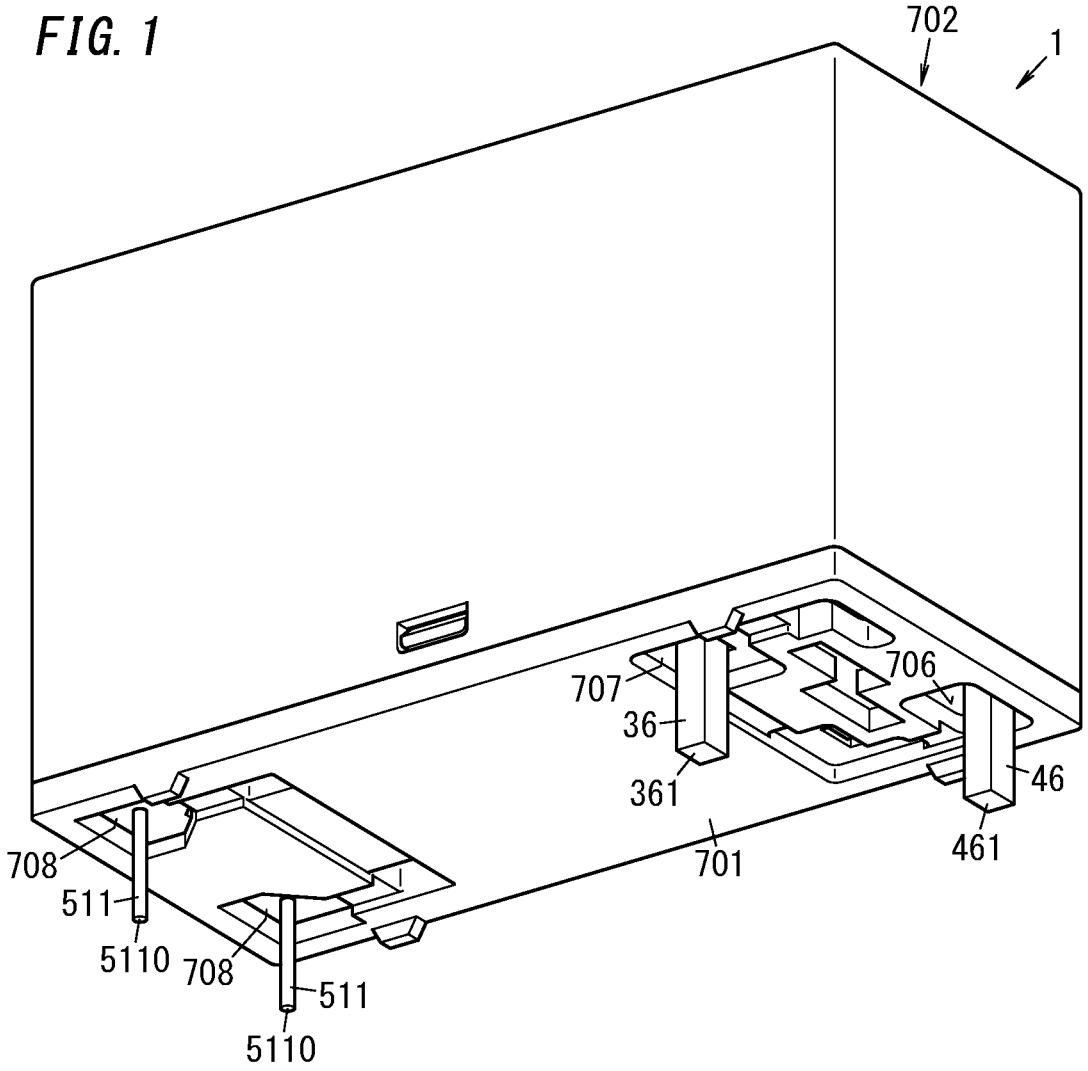
FIG. 1 is a perspective view of an electromagnetic relay according to a first embodiment.
Figure 15:
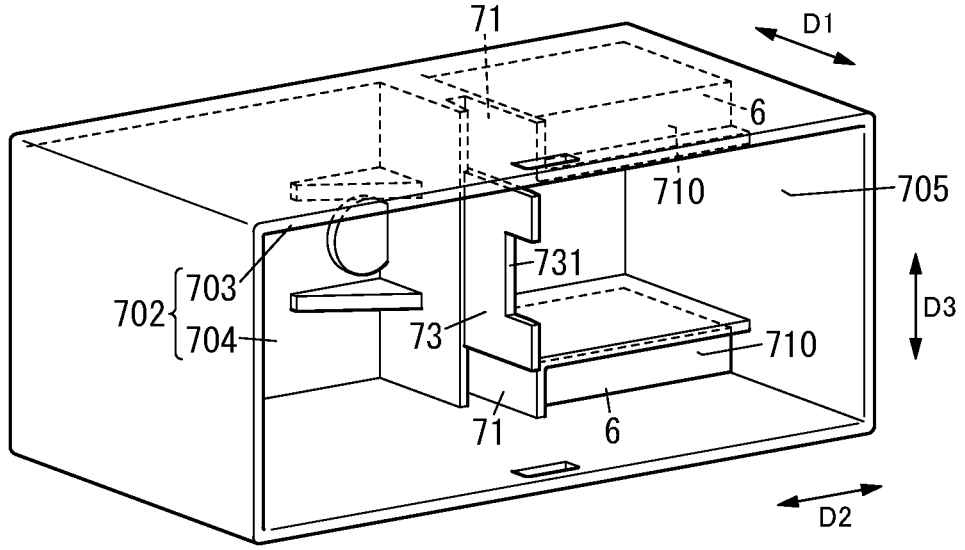
FIG. 15 is a perspective view illustrating the cover and two permanent magnets of the electromagnetic relay.

As shown in FIGS. 1, 10, and 15, the case 7 of the contact device 2 includes a case body 70, two inserting portions 71, and a plurality of wall portions 72. The case 7 may be made of a resin, for example. The case 7 has electrical insulation properties. The case body 70 includes a base 701 and a cover 702. The case body 70 houses the moving conductive portion 3, the fixed conductive portion 4, the driving unit 5, and two permanent magnets 6.

The cover 702 is formed in a box shape. The cover 702 includes a side portion 703 and a cap portion 704. The side portion 703 is formed in the shape of a square tube. The cap portion 704 is formed in the shape of a rectangular plate. The cap portion 704 covers a first axial end of the side portion 703. An opening 705 is provided at a second axial end of the side portion 703.

The base 701 is formed in the shape of a rectangular plate. The base 701 is attached to the cover 702 to close the opening 705.

The plurality of wall portions 72 protrude from the base 701 into the internal space of the cover 702. The plurality of wall portions 72 are connected together. The extended portion 31 of the moving conductive portion 3, the extended portion 41 of the fixed conductive portion 4, the first terminal portion 36, and the second terminal portion 46 are inserted between the plurality of wall portions 72. The first terminal portion 36 and the second terminal portion 46 are fixed to the case 7 by being inserted between the plurality of wall portions 72.

Figure 2:
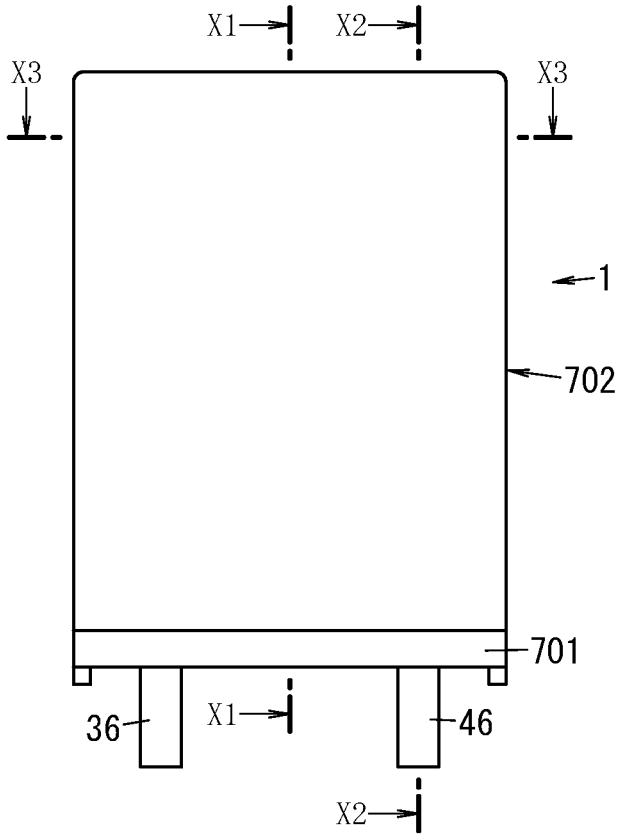
FIG. 2 is a side view of the electromagnetic relay.
Figure 3:
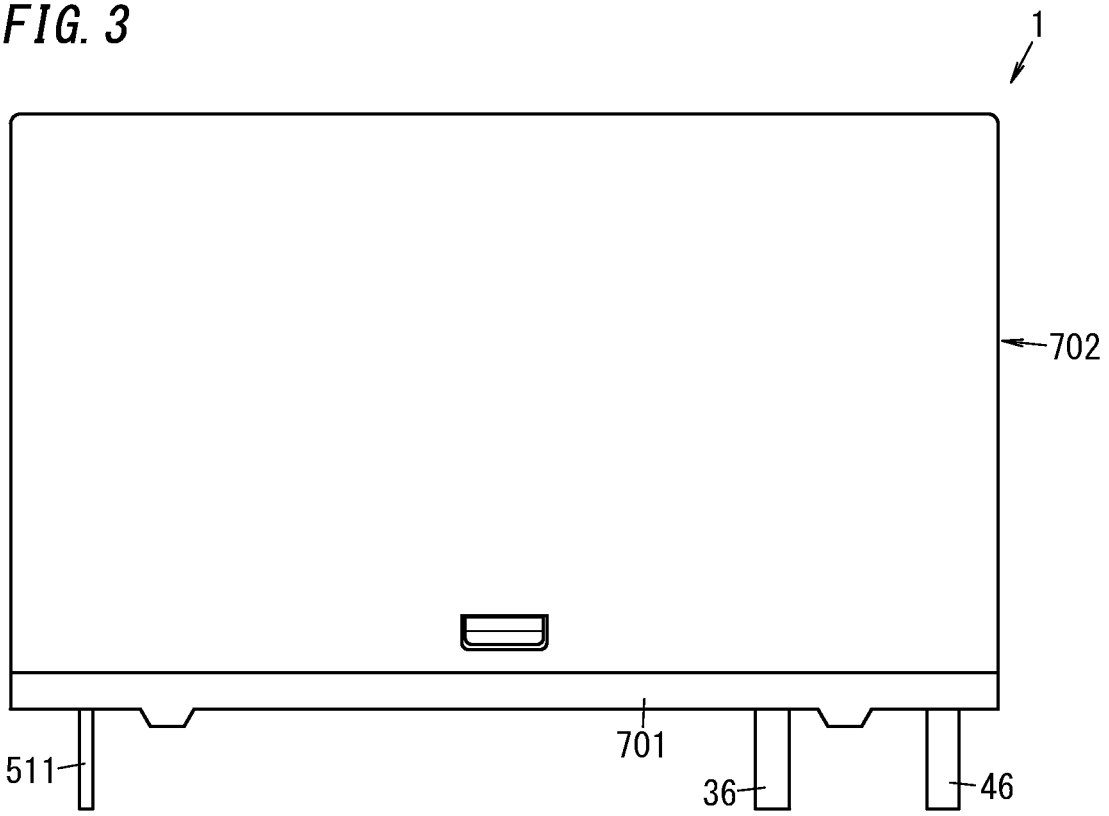
FIG. 3 is a front view of the electromagnetic relay.
Figure 4:
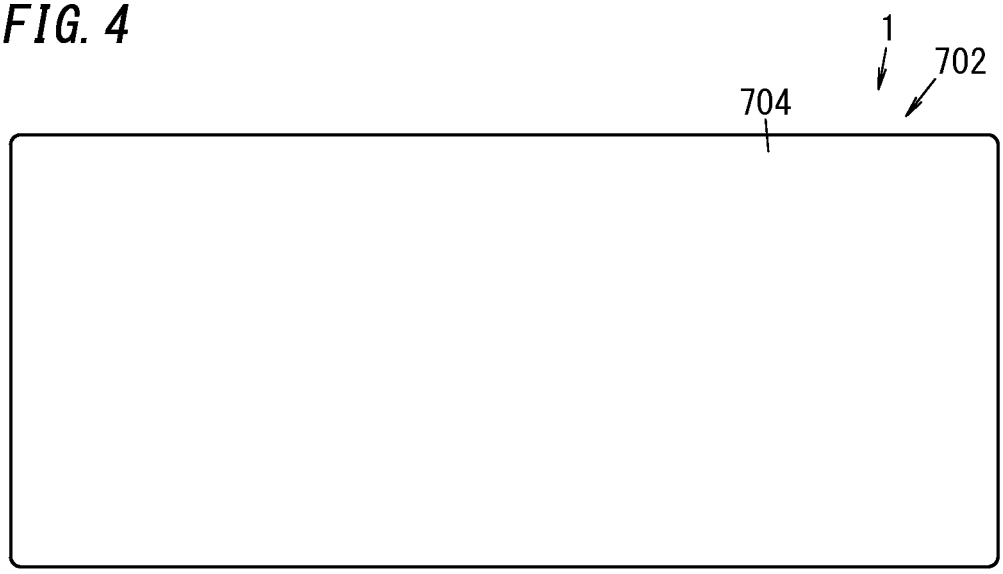
FIG. 4 is a plan view of the electromagnetic relay.
Figure 5:
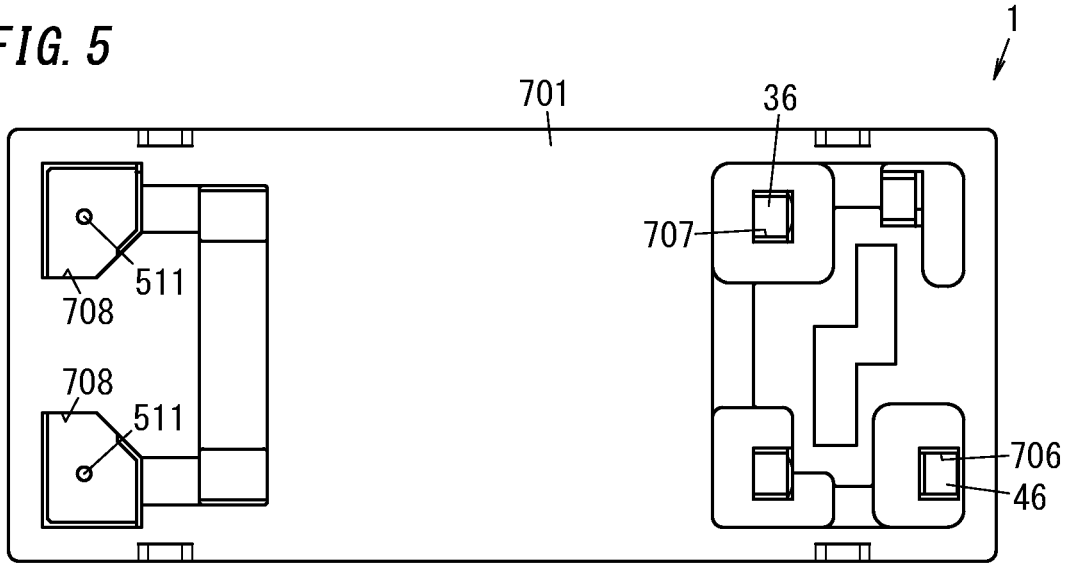
FIG. 5 is a bottom view of the electromagnetic relay.
Figure 6:
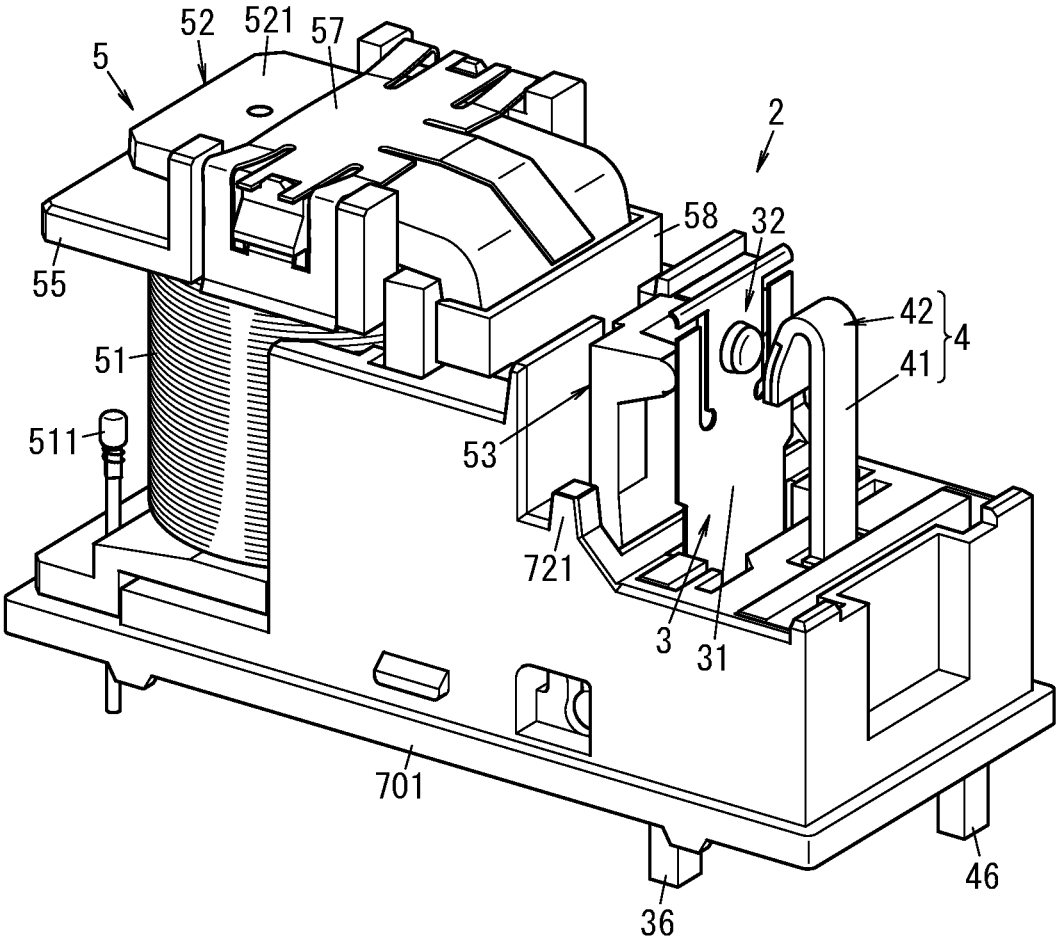
FIG. 6 is a perspective view illustrating the electromagnetic relay with its cover removed.
Figure 7:
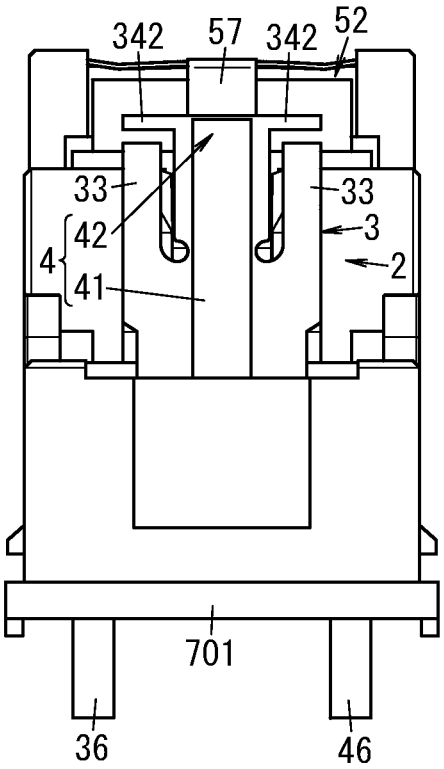
FIG. 7 is a side view illustrating the electromagnetic relay with its cover removed.
Figure 8:
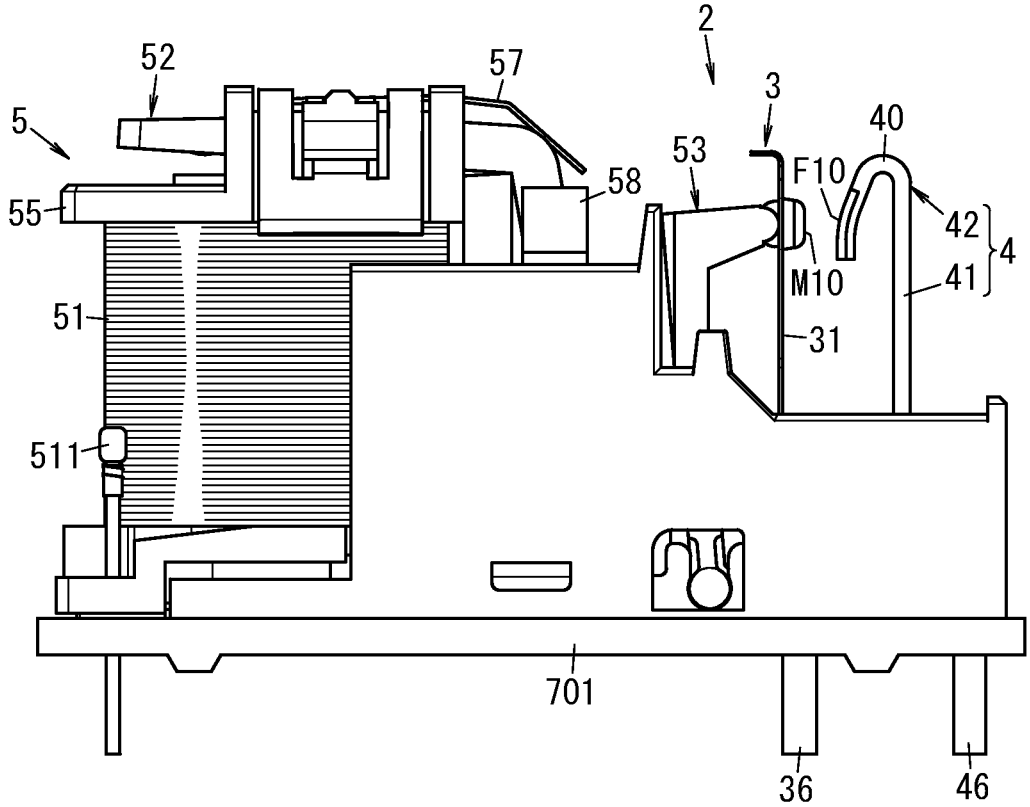
FIG. 8 is a front view illustrating the electromagnetic relay with its cover removed.
Figure 9:
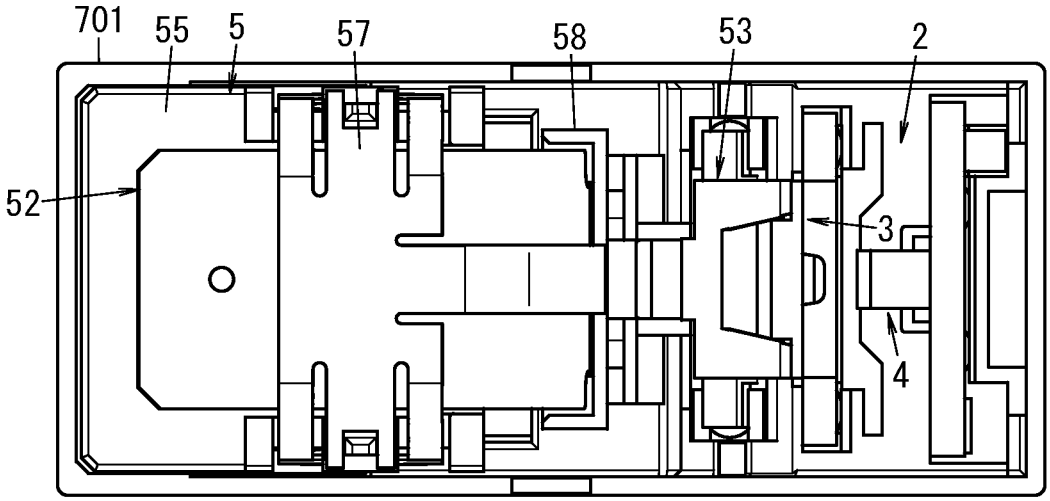
FIG. 9 is a plan view illustrating the electromagnetic relay with its cover removed.
Figure 16:
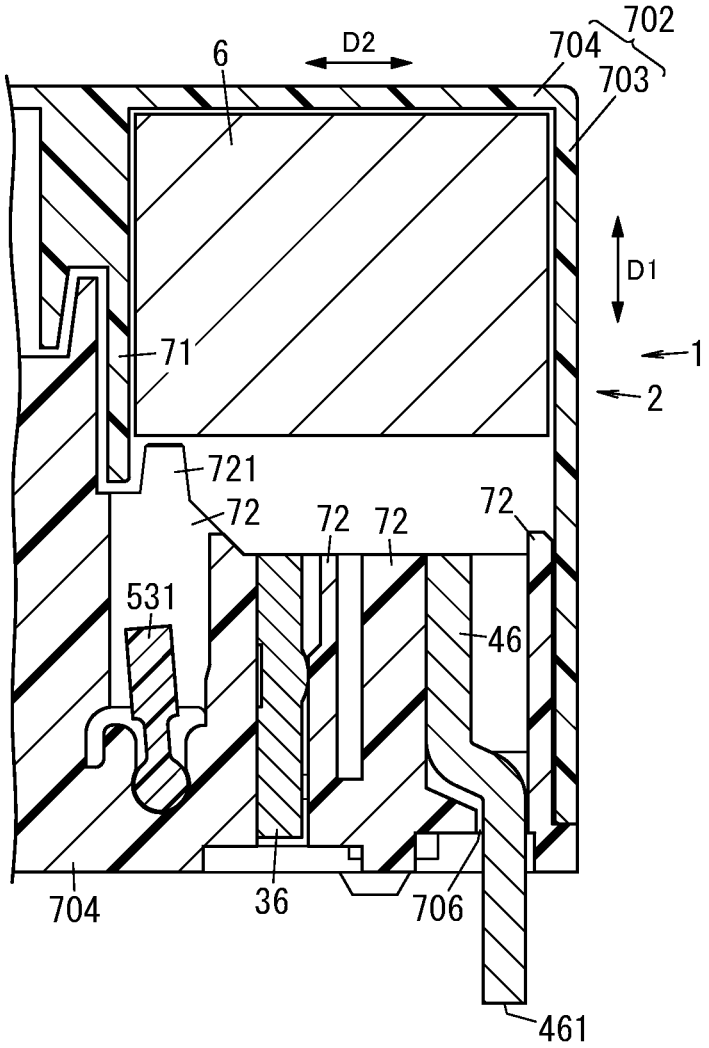

FIG. 16 is a cross-sectional view taken along the plane X2-X2 shown in FIG. 2. As shown in FIG. 16, a first end 461 of the second terminal portion 46 passes through a through hole 706 provided through the base 701 to be exposed outside of the case 7. Likewise, a first end 361 of the first terminal portion 36 (see FIG. 1) passes through a through hole 707 provided through the base 701 (see FIG. 5) to be exposed outside of the case 7. The first end 461 of the second terminal portion 46 is electrically connected to a negative electrode of the DC power supply V1 (see FIG. 12). The first end 361 of the first terminal portion 36 is electrically connected to a positive electrode of the DC power supply V1.

That is to say, the fixed conductive portion 4 (see FIG. 10) is electrically connected to the negative electrode of the DC power supply V1 via the second terminal portion 46 and the moving conductive portion 3 (see FIG. 10) is electrically connected to the positive electrode of the DC power supply V1 via the first terminal portion 36. The end portion 42 of the fixed conductive portion 4 (see FIG. 10) is electrically connected to the negative electrode of the DC power supply V1. Thus, the end portion 32 of the moving conductive portion 3 (see FIG. 10) comes to have a positive potential with respect to the end portion 42 of the fixed conductive portion 4 (see FIG. 10).

As shown in FIG. 15, the two inserting portions 71 are provided inside the cover 702 of the case body 70. Each of the two inserting portions 71 is formed in the shape of a box, of which one surface has an opening 710. That is to say, each inserting portion 71 has such a shape that an internal space thereof is surrounded with five surfaces. Three surfaces of each inserting portion 71 each serve as a part of an inner surface of the inserting portion 71 and a part of an inner surface of the cover 702. Each of the two inserting portions 71 is formed integrally with the cover 702 of the case body 70.

One permanent magnet 6 is inserted into each of the two inserting portions 71. Each of the two permanent magnets 6 may be a neodymium magnet, for example. The two permanent magnets 6 face the base 701 (see FIG. 10) in the first direction D1 via the opening 710 and the plurality of wall portions 72 (see FIG. 10).

The two permanent magnets 6 are arranged in the third direction D3. More specifically, when viewed in the third direction D3, the respective outer peripheral edges of the two permanent magnets 6 overlap with each other. As shown in FIG. 10, each permanent magnet 6 faces the fixed contact F10 and the moving contact M10 in the third direction D3. More specifically, the fixed contact F10 and the moving contact M10 are located between the two permanent magnets 6. Furthermore, each permanent magnet 6 faces the end portion 32 and the end portion 42 in the third direction D3.

The end portion 42 of the fixed conductive portion 4 is electrically connected to the negative electrode of the DC power supply V1. The end portion 32 of the moving conductive portion 3 is electrically connected to the positive electrode of the DC power supply V1. When the moving contact M10 is located at the closed position, a current flows from the end portion 32 of the moving conductive portion 3 toward the end portion 42 of the fixed conductive portion 4 via the moving contact M10 and the fixed contact F10. The two permanent magnets 6 are arranged such that Lorentz force is applied in the first direction D1 to a current flowing in the second direction D2 between the fixed contact F10 and the moving contact M10.

Figure 17:
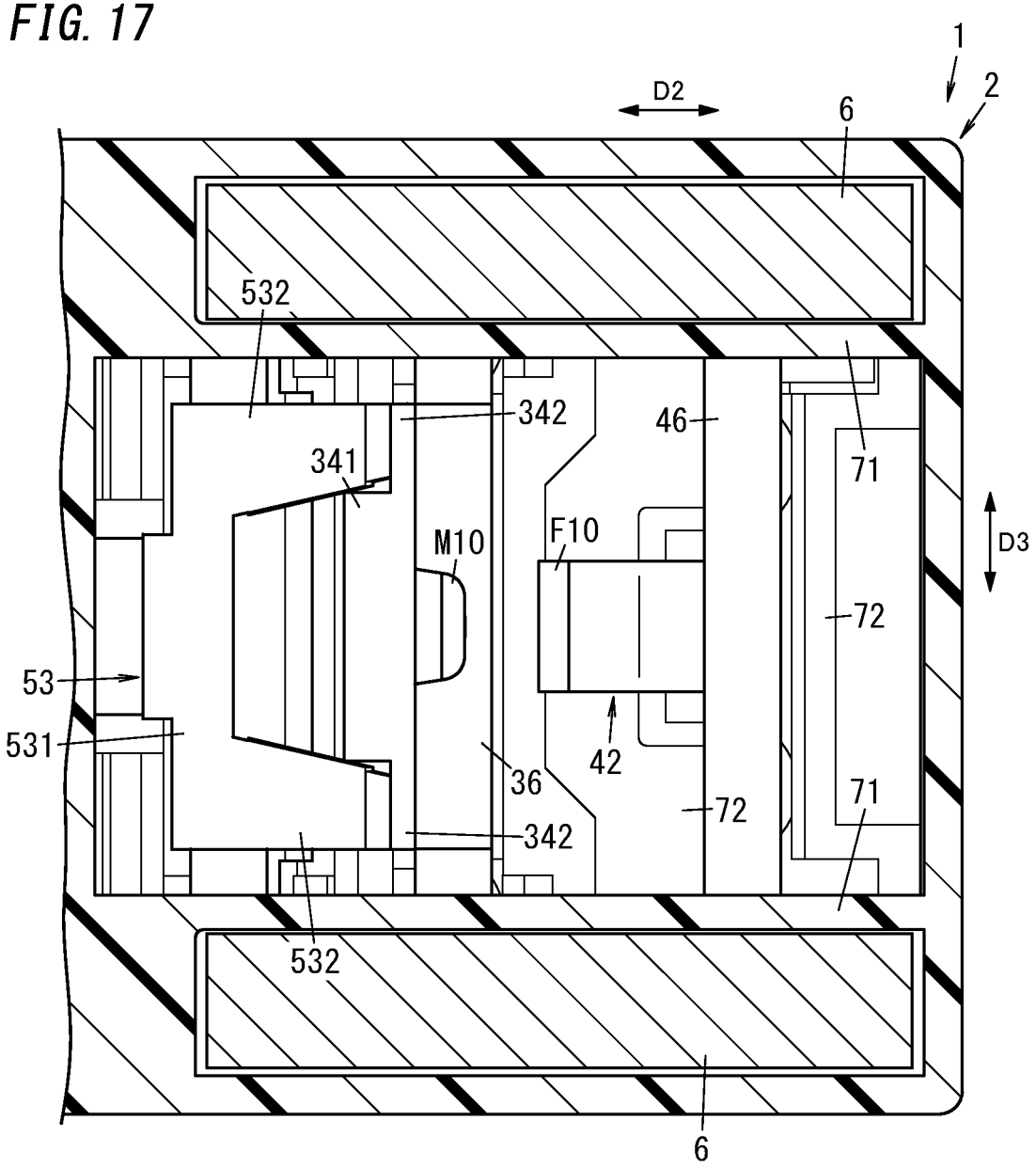

FIG. 17 is a cross-sectional view taken along the plane X3-X3 shown in FIG. 2. The direction of a magnetic field generated by the two permanent magnets 6 may be, for example, aligned with a viewing direction of a person who looks at the paper on which FIG. 10 is drawn from in front of the paper. More specifically, in the permanent magnet 6 located in front of the paper on which FIG. 10 is drawn (i.e., the permanent magnet 6 located at the bottom of the paper on which FIG. 17 is drawn), one end thereof located closer to the inside of the case body 70 has N-pole and another end thereof located closer to the outside of the case body 70 has S-pole. On the other hand, in the permanent magnet 6 located behind the paper on which FIG. 10 is drawn (i.e., the permanent magnet 6 located at the top of the paper on which FIG. 17 is drawn), one end thereof located closer to the inside of the case body 70 has S-pole and another end thereof located closer to the outside of the case body 70 has N-pole. Therefore, Lorentz force is applied in the one direction S1 (i.e., upward on the paper on which FIG. 10 is drawn) to a current flowing from the moving contact M10 toward the fixed contact F10 between the fixed contact F10 and the moving contact M10. For example, when the moving contact M10 in contact with the fixed contact F10 goes out of contact with the fixed contact F10, an arc may be generated between the moving contact M10 and the fixed contact F10. With respect to a current component flowing through the arc from the moving contact M10 toward the fixed contact F10, Lorentz force is applied in the one direction S1 (i.e., upward on the paper on which FIG. 10 is drawn).

As shown in FIGS. 13 and 16, the case 7 includes two regulating pieces 721 (only one of which is shown in FIG. 16). Each of the two regulating pieces 721 protrudes from some of the plurality of wall portions 72. The two regulating pieces 721 are associated one to one with the two permanent magnets 6. Each of the regulating pieces 721 faces its associated permanent magnet 6 in the first direction D1. Each permanent magnet 6 is held between its associated regulating piece 721 and the cap portion 704 of the cover 702 to have its movement in the first direction D1 restricted.

As shown in FIGS. 10 and 13, the card 53 includes a card body 531, two first projections 532, and a second projection 533. The card body 531 is formed in the shape of a rectangular plate. A first end 5311 (axial portion) along the length of the card body 531 is held by a bearing portion of the base 701 of the case 7. The card body 5311 is supported to be rotatable around the first end 531, held by the bearing portion of the base 701, as fulcrum. The two first projections 532 protrude from the card body 531. The two first projections 532 are associated one to one with the two contact pressure portions 33 of the moving conductive portion 3. Each of the first projections 532 causes the moving conductive portion 3 to be displaced by pressing its associated contact pressure portion 33. The second projection 533 protrudes from the card body 531 in the opposite direction from the first projections 532. The card 53 may be made of a resin, for example. The card 53 has electrical insulation properties.

The two arm portions 342 of the facing portion 34 of the moving conductive portion 3 are associated one to one with the two first projections 532 of the card 53. Each of the arm portions 342 faces a tip portion of its associated first projection 532. As shown in FIGS. 13 and 17, when viewed in the first direction D1, each arm portion 342 and its associated first projection 532 are arranged side by side in the second direction D2.

When the moving contact M10 that has been in contact with the fixed contact F10 goes out of contact with the fixed contact F10, an arc may be generated between the fixed contact F10 and the moving contact M10. Also, after the moving contact M10 has gone out of contact with the fixed contact F10, the arc generated between the fixed contact F10 and the moving contact M10 may move while changing its shape. When viewed from the surface M11 of the moving contact M10, the facing portion 34 is located on the left. That is to say, when viewed from the surface M11, the facing portion 34 is located on the opposite side (i.e., on the left) from the fixed contact F10 (on the right). The surface M11 faces the fixed contact F10. The facing portion 34 faces the card 53. The facing portion 34, the contact pressure portions 33, and the base portion 321 are able to protect the card 53 from the arc. That is to say, the facing portion 34, the contact pressure portions 33, and the base portion 321 are provided to cover the card 53, and therefore, are able to protect the card 53 from the arc.

As shown in FIG. 10, the coil bobbin 55 is formed in a cylindrical shape. The coil bobbin 55 is fixed to the base 701. The coil bobbin 55 may be made of a resin, for example. The iron core 54 is formed in a circular columnar shape. The iron core 54 is inserted into the coil bobbin 55. The coil 51 is a conductive wire wound around the coil bobbin 55. The contact device 2 further includes two coil terminals 511 (only one of which is shown in FIG. 10) electrically connected to the coil 51. A first end 5110 of each of the two coil terminals 511 is passed through a through hole 708 (see FIG. 1) provided through the base 701 to be exposed outside the case 7. Both ends of the coil 51 are electrically connected to a power supply V2 for excitation (see FIG. 12) via the two coil terminals 511. The power supply V2 may be, for example, a power supply including a voltage step-down transformer for stepping down the voltage of the DC power supply V1.

The driving unit 5 further includes a yoke 56 and a hinged spring 57.

The yoke 56 includes a first wall portion 561 and a second wall portion 562. Each of the first wall portion 561 and the second wall portion 562 is formed in a plate shape. The second wall portion 562 protrudes from one end of the first wall portion 561 generally perpendicularly to the first wall portion 561. The iron core 54 is fixed to the first wall portion 561. The yoke 56 is fixed to the base 701.

The armature 52 includes a first plate portion 521 and a second plate portion 522. The first plate portion 521 faces a first end 541 of the iron core 54. The second plate portion 522 protrudes from one end of the first plate portion 521 generally perpendicularly to the first plate portion 521. An intermediate portion 523 between the first plate portion 521 and the second plate portion 522 is supported by the second wall portion 562 of the yoke 56. The armature 52 is supported to be rotatable, around the intermediate portion 523 as a fulcrum, between a first position (i.e., the position shown in FIG. 10) where the first plate portion 521 is out of contact with the first end 541 of the iron core 54 and a second position (i.e., the position shown in FIG. 11) where the first plate portion 521 is in contact with the first end 541 of the iron core 54.

The hinged spring 57 is in contact with, and applies elastic force to, the intermediate portion 523 of the armature 52. The elastic force applied by the hinged spring 57 to the armature 52 allows the armature 52 to be supported rotatably around the intermediate portion 523 with the intermediate portion 523 of the armature 52 kept in contact with the upper end of the second wall portion 562 (i.e., the tip in the one direction S1) of the yoke 56. In FIG. 10, as the armature 52 rotates counterclockwise, the card 53 rotates clockwise. Furthermore, as the card 53 rotates, the extended portion 31 of the moving conductive portion 3 is deformed elastically, thus causing the moving contact M10 to move toward the fixed contact F10. Also, as the armature 52 rotates clockwise, the card 53, the moving conductive portion 3, and the moving contact M10 move in the opposite direction from the one described above.

The driving unit 5 further includes a transmitting portion 58. The transmitting portion 58 is attached to the second plate portion 522 of the armature 52. The transmitting portion 58 may be made of a resin, for example. The transmitting portion 58 has electrical insulation properties. The transmitting portion 58 is in contact with the second projection 533 of the card 53. As the armature 52 turns back and forth between the first position and the second position, the transmitting portion 58 and the card 53 move accordingly. The card 53 rotates around the first end 5311 of the card body 531 as a fulcrum. As the card 53 rotates, the moving conductive portion 3 is deformed elastically. More specifically, the extended portion 31 is deformed elastically such that the longitudinal axis of the extended portion 31 of the moving conductive portion 3 is tilted with respect to the longitudinal axis (i.e., the first direction D1) of the extended portion 41 of the fixed conductive portion 4. This causes the moving contact M10 to move back and forth between the open position and the closed position. The transmitting portion 58 has the capability of enhancing electrical insulation between the coil 51, the fixed conductive portion 4, and the moving conductive portion 3.

When measured along the length of the card body 531, the distance L3 between the center of the two first projections 532 of the card 53 and the center of the second projection 533 is approximately equal to the distance L4 between the center of the second projection 533 and the first end 5311 of the card body 531. That is to say, the card 53 amplifies (approximately doubles) the displacement of the transmitting portion 58 and transmits the amplified displacement to the moving conductive portion 3. As used herein, when the distance L3 is approximately equal to the distance L4, it may mean that the distance L3 is 80% to 120% as long as the distance L4.

The card 53 is arranged between the moving conductive portion 3 and the armature 52. In addition, the case body 70 includes an inner wall 73. The inner wall 73 protrudes from the cap portion 704 of the cover 702 toward the internal space of the case body 70. The protruding direction of the inner wall 73 is aligned with the first direction D1. The inner wall 73 is provided between the moving conductive portion 3 and the armature 52. More specifically, the inner wall 73 is provided between the card 53 and the armature 52. The inner wall 73 separates a space SP1 where the fixed contact F10 and the moving contact M10 are arranged from a space SP2 where the armature 52 is arranged. The inner wall 73 has a recess 731 (see FIG. 15) to pass the second projection 533 of the card 53 therethrough.

Providing the card 53 and the inner wall 73 between the moving conductive portion 3 and the armature 52 reduces the chances of the arc generated between the moving conductive portion 3 and the fixed conductive portion 4 reaching the armature 52. That is to say, this allows the armature 52 to be protected from the arc. In addition, this allows the coil 51 adjacent to the armature 52 to be protected from the arc as well. Besides, providing the card 53 and the inner wall 73 increases the insulation distance between the moving conductive portion 3 and the coil 51 and the insulation distance between the fixed conductive portion 4 and the coil 51, compared to a situation where neither the card 53 nor the inner wall 73 is provided. That is to say, the card 53 and the inner wall 73 play the role of enhancing electrical insulation between the coil 51 and the fixed conductive portion 4 and between the coil 51 and the moving conductive portion 3.

The internal space of the case 7 includes the space SP1 and the space SP2. As shown in FIG. 14, the space SP1 includes a space SP11, a space SP12, and a space SP13.

The space SP11 overlaps, in a direction aligned with the one direction S1 (i.e., in the first direction D1), with the end portion 42 of the fixed conductive portion 4 and the end portion 32 of the moving conductive portion 3. This allows the arc generated between the fixed conductive portion 4 and the moving conductive portion 3 to be stretched in the first direction D1 toward the space SP11. More specifically, the space SP11 is located in the one direction S1 with respect to the end portion 42 and the end portion 32.

The space SP12 is located, in the direction in which the fixed contact F10 and the moving contact M10 face each other (i.e., in the second direction D2), opposite from the moving contact M10 when viewed from the fixed contact F10. This allows the arc generated between the fixed conductive portion 4 and the moving conductive portion 3 to be stretched in the second direction D2 toward the space SP12.

The space SP13 is located, in the direction in which the fixed contact F10 and the moving contact M10 face each other (i.e., in the second direction D2), opposite from the fixed contact F10 when viewed from the moving contact M10. This allows the arc generated between the fixed conductive portion 4 and the moving conductive portion 3 to be stretched in the second direction D2 toward the space SP13.

Thus, this allows the arc generated between the fixed conductive portion 4 and the moving conductive portion 3 to be stretched over the space SP11, the space SP12, and the space SP13 as shown in FIG. 14. Consequently, the length of the arc generated between the fixed conductive portion 4 and the moving conductive portion 3 may be extended by efficiently using the internal space of the case 7, thus improving the arc extinction performance.

(Operation of Electromagnetic Relay)

Next, it will be described how the electromagnetic relay 1 operates.

As shown in FIG. 10, while no current is flowing through the coil 51, the moving contact M10 is located at the open position. When a current flows through the coil 51, the magnetic flux generated by the coil 51 produces attractive force between the first plate portion 521 of the armature 52 and the iron core 54. This attractive force causes the armature 52 to turn such that first plate portion 521 moves toward the iron core 54. That is to say, at this time, the armature 52 rotates from the first position toward the second position. As the armature 52 rotates from the first position toward the second position, the card 53 is driven, thus making the card 53 drive the moving conductive portion 3. That is to say, the card 53 rotates around the first end 5311 as a fulcrum. Thus, the two first projections 532 of the card 53 press the two contact pressure portions 33 of the moving conductive portion 3 (see FIG. 13), thus elastically deforming the extended portion 31 of the moving conductive portion 3 such that the moving contact M10 moves from the open position toward the closed position (i.e., the position shown in FIG. 11).

When the two first projections 532 of the card 53 further press the two contact pressure portions 33 of the moving conductive portion 3 (see FIG. 13) after the moving contact M10 has reached the closed position to come into contact with the fixed contact F10, the two contact pressure portions 33 are deformed elastically to absorb the force applied by the contact pressure portions 33. That is to say, since the two contact pressure portions 33 have elasticity, there is some room for the card 53 to further rotate even after the moving contact M10 has reached the closed position. This allows the moving contact M10 to maintain appropriate contact pressure with respect to the fixed contact F10.

When no current flows through the coil 51 any longer, there is no attractive force between the first plate portion 521 and the iron core 54. Thus, the elastic force of the extended portion 31 causes the moving conductive portion 3 to be deformed such that the moving contact M10 moves from the closed position toward the open position. In addition, the elastic force of the extended portion 31 also causes the armature 52 to rotate from the second position toward the first position.

When the moving contact M10 is located at the closed position, the surface M11 of the moving contact M10 is tilted with respect to the first direction D1 to come into contact a curved region of the first surface F11 of the fixed contact F10. That region, contacting with the surface M11 of the moving contact M10, of the first surface F11 is formed to be parallel to the surface M11 when the moving contact M10 is located at the closed position. This stabilizes the state where the surface M11 of the moving contact M10 and the first surface F11 of the fixed contact F10 are in contact with each other. As used herein, if something is "parallel to" another thing, then these two things may naturally be exactly parallel to each other but may also be generally parallel to each other within a permissible tolerance range with respect to the exactly parallel state.

Comparative Example

Figure 18:
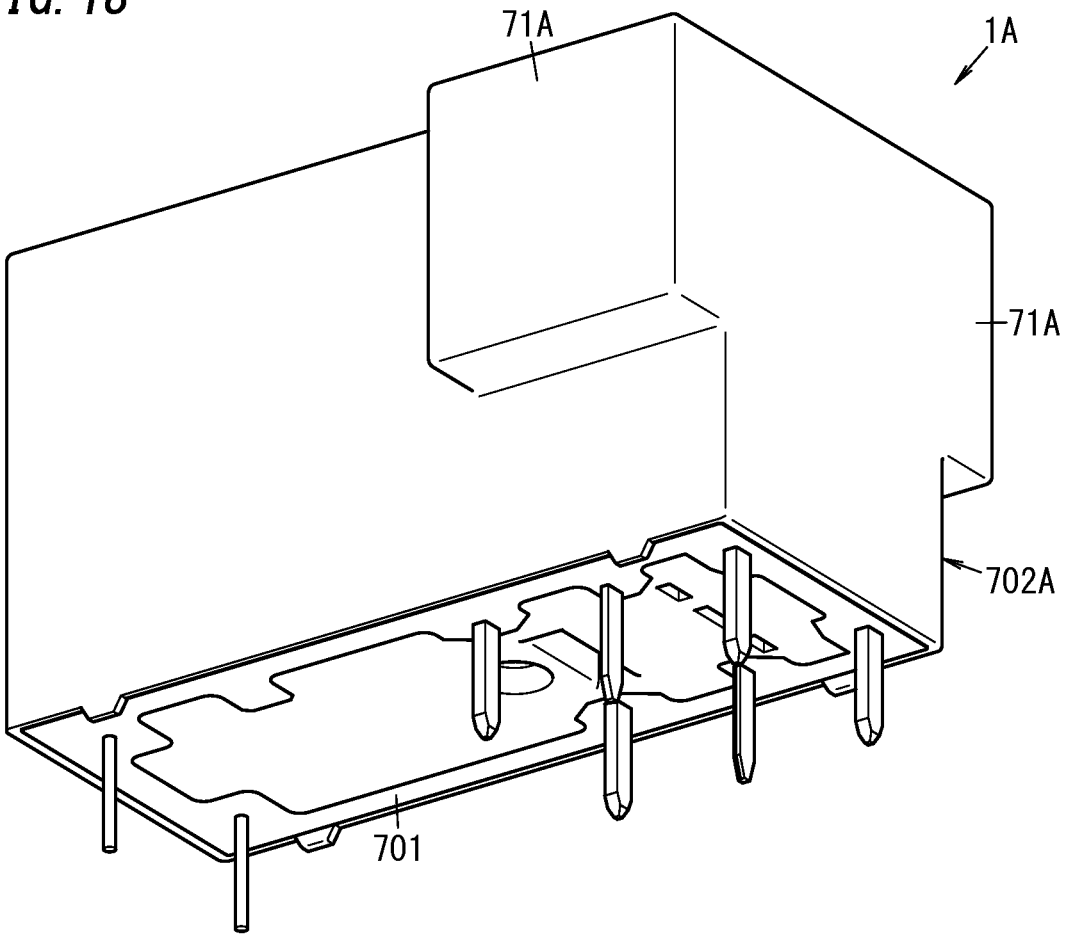
FIG. 18 is a perspective view of an electromagnetic relay according to a comparative example.
Figure 19:
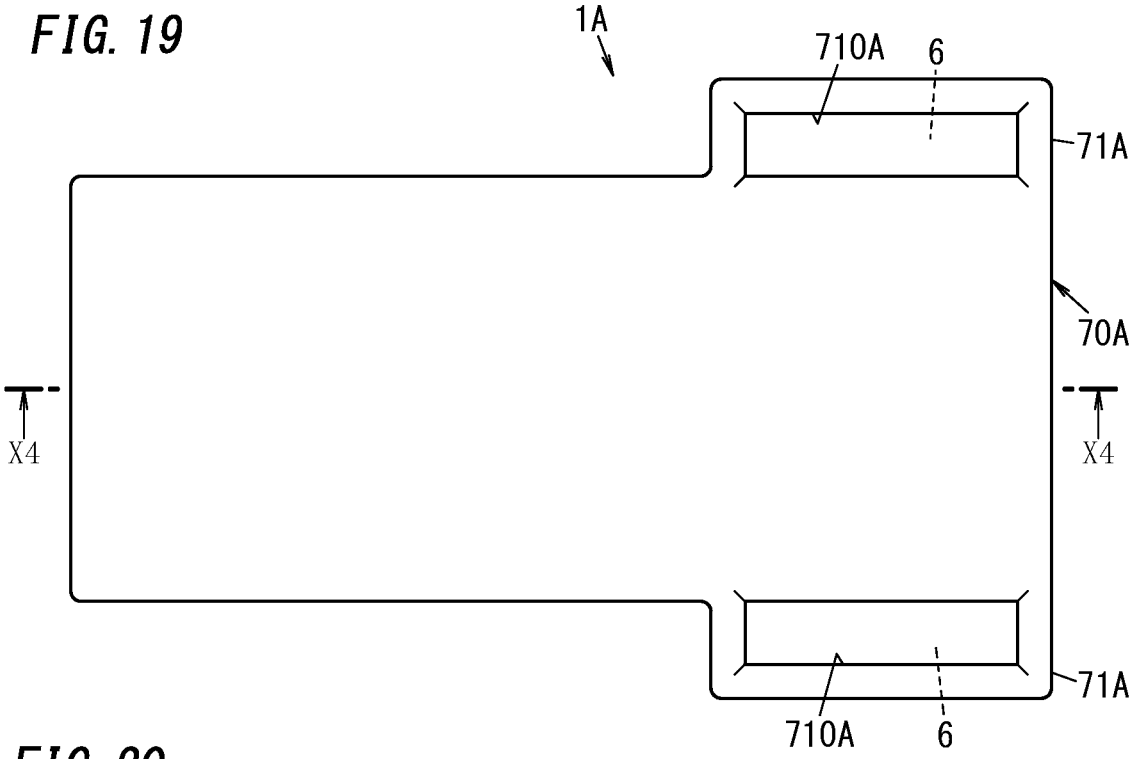
FIG. 19 is a plan view of the electromagnetic relay.
Figure 20:
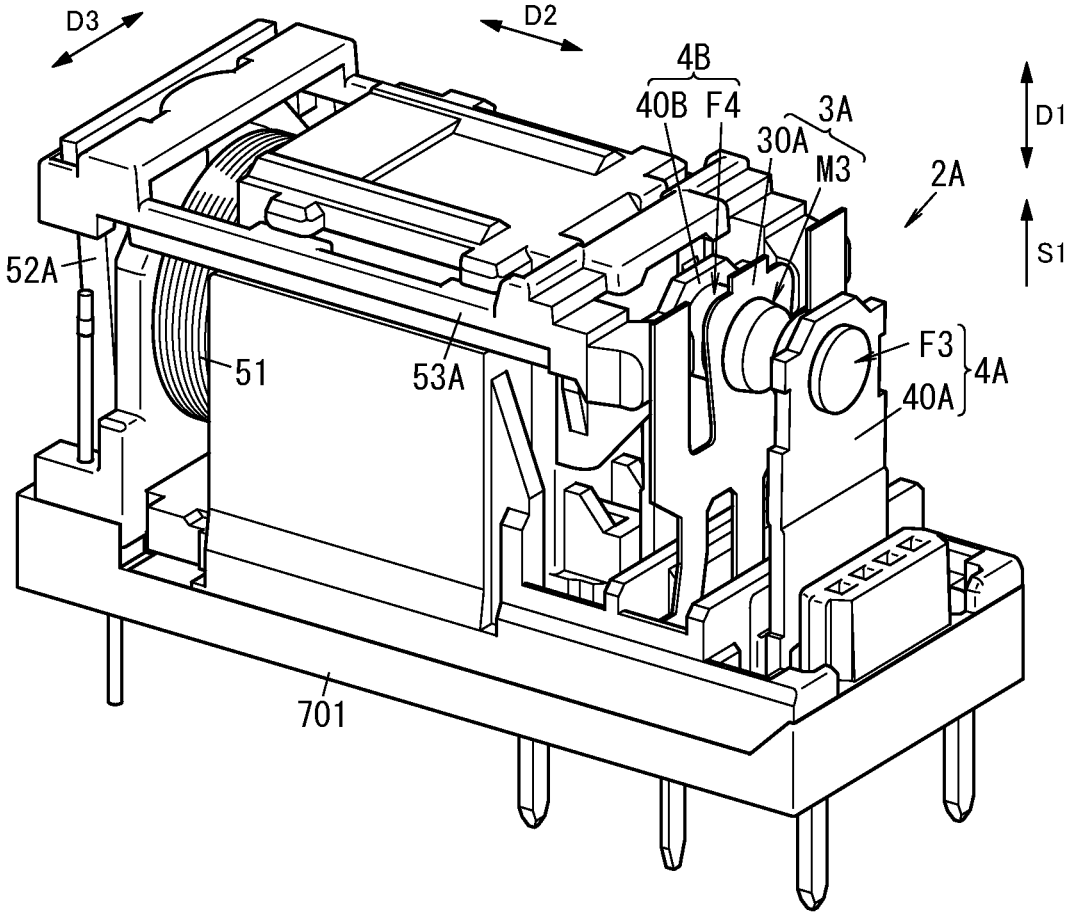
FIG. 20 is a perspective view illustrating the electromagnetic relay with its cover removed.
Figure 21:
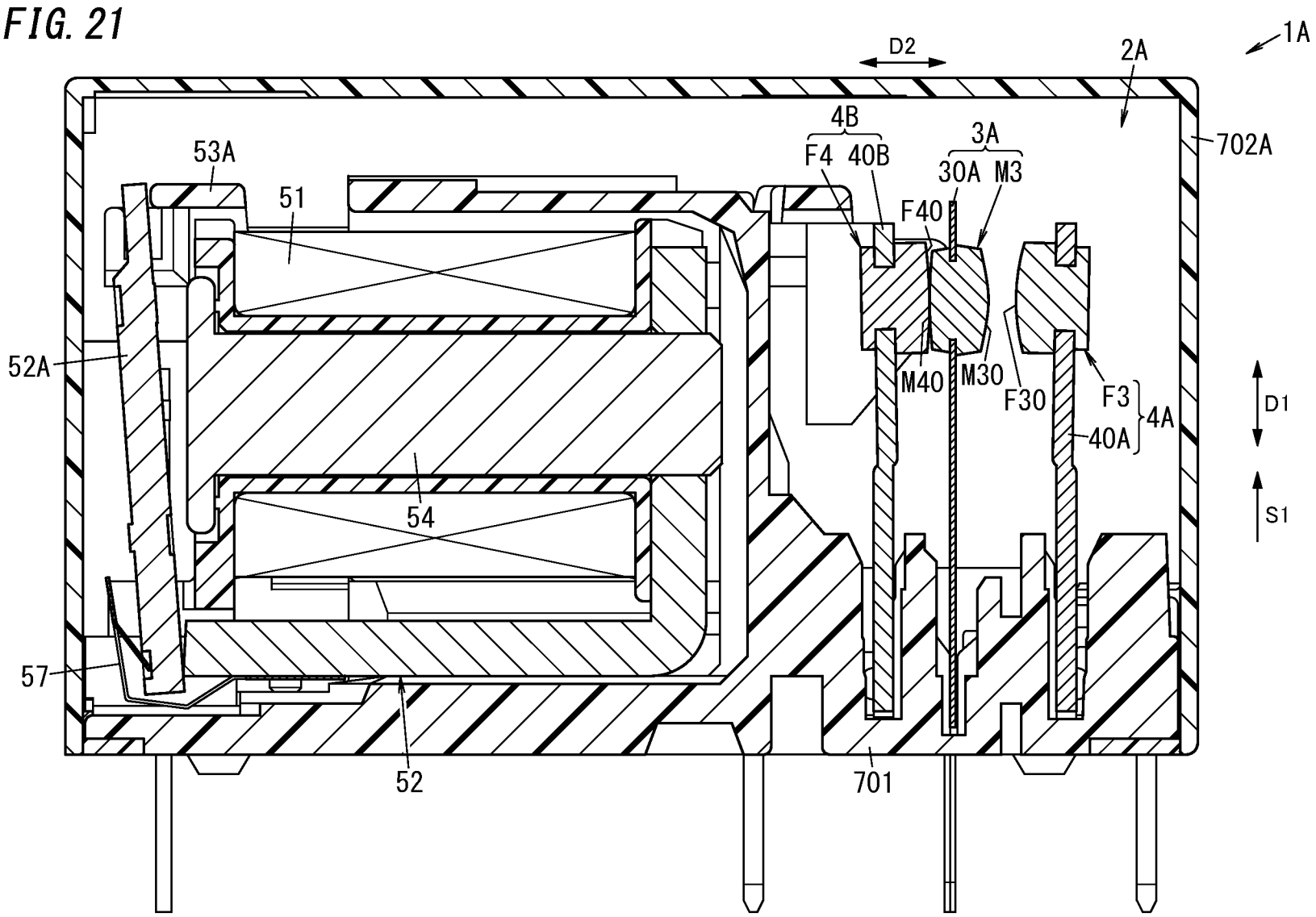
FIG. 21 is a cross-sectional view thereof taken along the plane X4-X4 shown in FIG. 19.

FIGS. 18 and 19 illustrate the appearance of an electromagnetic relay 1A according to a comparative example FIG. 20 illustrates the appearance of the electromagnetic relay 1A with its cover 702A removed. FIG. 21 is a cross-sectional view thereof taken along the plane X4-X4 shown in FIG. 19. In the following description, any constituent element of the electromagnetic relay 1A, having the same function as a counterpart of the electromagnetic relay 1 described above, will be designated by the same reference numeral as that counterpart's, and description thereof will be omitted herein.

As shown in FIGS. 20 and 21, the contact device 2A of the electromagnetic relay 1A includes a first fixed conductive portion 4A, a second fixed conductive portion 4B, and a moving conductive portion 3A.

The first fixed conductive portion 4A includes a contact member F3 and a first base member 40A. The first base member 40A is formed in the shape of a flat plate aligned with the one direction S1. The contact member F3 includes a first fixed contact F30. The contact member F3 is formed in a rivet shape. The contact member F3 is a rivet contact. The contact member F3 is caulked to the first base member 40A.

The second fixed conductive portion 4B includes a contact member F4 and a second base member 40B. The second base member 40B is formed in the shape of a flat plate aligned with the one direction S1. The contact member F4 includes a second fixed contact F40. The contact member F4 is formed in a rivet shape. The contact member F4 is a rivet contact. The contact member F4 is caulked to the second base member 40B.

The second base member 40B is arranged generally parallel to the first base member 40A. The moving conductive portion 3A is arranged between the first fixed conductive portion 4A and the second fixed conductive portion 4B.

The moving conductive portion 3A includes a base portion 30A and a contact member M3. The contact member M3 includes a first moving contact M30 and a second moving contact M40. The contact member M3 is formed in a rivet shape. The contact member M3 is a rivet contact. The contact member M3 is caulked to the base portion 30A. The first moving contact M30 faces the first fixed contact F30. The second moving contact M40 faces the second fixed contact F40.

Each of the first fixed conductive portion 4A and the second fixed conductive portion 4B is electrically connected to the negative electrode of the DC power supply V1 (see FIG. 12). The moving conductive portion 3A is electrically connected to the positive electrode of the DC power supply V1.

As shown in FIG. 19, respective openings 710A of two inserting portions 71A are provided outside a cover 702A of a case body 70A. One permanent magnet 6 is inserted into each of the two inserting portions 71A. The first fixed contact F30, the second fixed contact F40, the first moving contact M30, and the second moving contact M40 are arranged between the two permanent magnets 6. Each of the two permanent magnets 6 is covered with an insulator provided to close the associated opening 710A. This ensures electrical insulation between the two permanent magnets 6 and an external device.

In FIGS. 20 and 21, an armature 52A of the electromagnetic relay 1A is displaced according to a variation in the energization state of the coil 51. As the coil 51 is energized, the armature 52A is attracted toward the iron core 54. Then, as the armature 52A is displaced, a card 53A is displaced, thus making the card 53A drive the moving conductive portion 3A. While the coil 51 is not energized, the second moving contact M40 of the moving conductive portion 3A is in contact with the second fixed contact F40 and is out of contact with the first fixed contact F30. When the coil 51 is energized, the moving conductive portion 3A is deformed elastically toward the first fixed conductive portion 4A. Consequently, the moving conductive portion 3A goes out of contact with the second fixed contact F40 and the first moving contact M30 comes into contact with the first fixed contact F30.

When the coil 51 makes a transition from the energized state to the non-energized state, the elastic force applied by the base portion 30A of the moving conductive portion 3A brings the moving conductive portion 3A out of contact with the first fixed contact F30. The base portion 30A is deformed to bring the second moving contact M40 into contact with the second fixed contact F40.

(Arc Generated by Contact Device)

In the contact device 2, when the moving contact M10 in contact with the fixed contact F10 goes out of contact with the fixed contact F10, an arc may be generated between the moving contact M10 and the fixed contact F10. With an AC power supply connected to the contact device 2, when either the voltage or current of the AC power supply goes zero, the arc disappears spontaneously, thus cutting off the current flowing between the moving conductive portion 3 and the fixed conductive portion 4.

In the contact device 2A according to the comparative example, when the first moving contact M30 in contact with the first fixed contact F30 goes out of contact with the first fixed contact F30, an arc may be generated between the first moving contact M30 and the first fixed contact F30. With an AC power supply connected to the contact device 2A, when either the voltage or current of the AC power supply goes zero, the arc disappears spontaneously, thus cutting off the current flowing between the moving conductive portion 3A and the first fixed conductive portion 4A.

Next, a situation where the contact device 2 is connected to the DC power supply V1 and a situation where the contact device 2A is connected to the DC power supply V1 will be described. For example, each of the contact devices 2, 2A is supposed to be connected to a series circuit of a 300V DC power supply V1 and a load R1 with a resistance of 15Ω. A current of 20 A is supposed to flow through the contacts of the contact device 2 and the contacts of the contact device 2A.

In the electromagnetic relay 1 according to the first embodiment, a transition was made from a state where the coil 51 was energized to a state where the coil 51 was not energized. After that, the amount of time it took for the arc generated between the fixed contact F10 and the moving contact M10 to disappear (hereinafter referred to as a "cutoff time") since the moving contact M10 in contact with the fixed contact F10 began to move was measured. Meanwhile, in the electromagnetic relay 1A according to the comparative example, a transition was made from a state where the coil 51 was energized to a state where the coil 51 was not energized. After that, the amount of time it took for the arc generated between the first fixed contact F30 and the first moving contact M30 to disappear (hereinafter referred to as a "cutoff time") since the first moving contact M30 in contact with the first fixed contact F30 began to move was measured.

In this case, in the electromagnetic relay 1 used for the actual measurement, the diameter L5 (see FIG. 14) of the moving contact M10 was 2.8 mm and the protrusion length L6 (see FIG. 14) of the moving contact M10 toward the fixed contact F10 with respect to the base portion 321 was 0.8 mm. In the electromagnetic relay 1A used for the actual measurement, the diameter L7 (see FIG. 22A) of the first moving contact M30 and the diameter L8 (see FIG. 22A) of the first fixed contact F30 were 2.8 mm and the protrusion length L9 (see FIG. 22A) of the first moving contact M30 toward the first fixed contact F30 with respect to the base portion 30A was 0.8 mm.

The electromagnetic relay 1 has a cutoff time of 0.7 ms. The electromagnetic relay 1A has a cutoff time of 2.9 ms. The electromagnetic relay 1 has a shorter direct current cutoff time than the electromagnetic relay 1A, which is an advantage of the electromagnetic relay 1 over the electromagnetic relay 1A. In addition, the electromagnetic relay 1, having a shorter direct current cutoff time than the electromagnetic relay 1A, is able to reduce the wear of the contacts by the arc. The cutoff time is suitably less than 2 ms.

Next, it will be described why the electromagnetic relay 1 has a shorter direct current cutoff time than the electromagnetic relay 1A.

The mechanism of electron emission when an arc is generated from a metal includes field emission and thermal field emission. In the case of an arc corresponding to a current of 20 A supplied from a 300V DC power supply V1, the mechanism of electron emission from the cathode of the contact device 2, 2A is presumed to be thermal field emission. As used herein, the "cathode of the contact device 2" refers to the fixed conductive portion 4 connected to the negative electrode of the DC power supply V1, out of the moving conductive portion 3 and the fixed conductive portion 4. The anode of the contact device 2 herein refers to the moving conductive portion 3 connected to the positive electrode of the DC power supply V1, out of the moving conductive portion 3 and the fixed conductive portion 4. The "cathode of the contact device 2A" herein refers to the first and second fixed conductive portions 4A, 4B connected to the negative electrode of the DC power supply V1, out of the moving conductive portion 3A and the first and second fixed conductive portions 4A, 4B. The anode of the contact device 2A herein refers to the moving conductive portion 3A connected to the positive electrode of the DC power supply V1, out of the moving conductive portion 3A and the first and second fixed conductive portion 4A, 4B.

In the contact devices 2, 2A, when electrons are emitted by thermal field emission, the surface of the cathode is maintained at a high temperature due to the heat of the arc. In addition, an electric field generated by a potential difference between the anode and the cathode is applied to the surface of the cathode, thus continuing emission of electrons from the cathode. When the heat at the end point of the arc on the cathode (i.e., an arc emission point) is transferred to a portion adjacent to the end point of the arc on the cathode, electrons are emitted by thermal field emission from that portion adjacent to the end point of the arc on the cathode. In this manner, the end point of the arc on the cathode moves.

If there is a gap on the path along which the end point of the arc on the cathode moves, then the heat is transferred less smoothly from the end point of the arc on the cathode to the portion adjacent to the end point of the arc on the cathode. Thus, in that portion adjacent to the end point of the arc on the cathode, the temperature does not rise sufficiently, and electrons are not emitted easily by the mechanism of thermal field emission. Consequently, this makes it difficult for the end point of the arc on the cathode to move across the gap.

In the electromagnetic relay 1 according to the first embodiment, the fixed conductive portion 4 corresponds to the cathode. In the fixed conductive portion 4, the fixed contact F10 is crimped to the base member 40. This reduces the gap between the fixed contact F10 and the base member 40 compared to a situation where the fixed contact F10 is fixed by caulking to the base member 40. In addition, the surface 401 of the base member 40 is flush with the first surface F11 of the fixed contact F10 of the fixed conductive portion 4. There is no groove, projection, or level difference with a width of 50 μm or more in the boundary between the base member 40 and the fixed contact F10, thus allowing the heat to be transferred smoothly between the base member 40 and the fixed contact F10. This makes it easy for the end point of the arc on the cathode to move from the first surface F11 of the fixed contact F10 to the surface 401 of the base member 40.

Figure 22A:
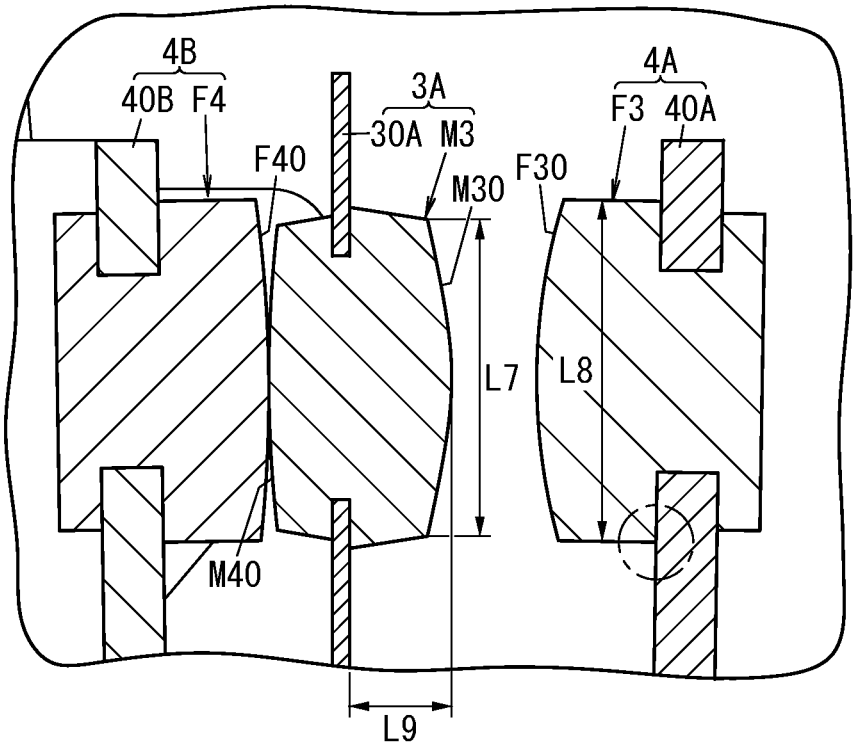
FIG. 22A is an enlarged cross-sectional view of a first fixed conductive portion and a moving conductive portion of the electromagnetic relay.
Figure 22B:
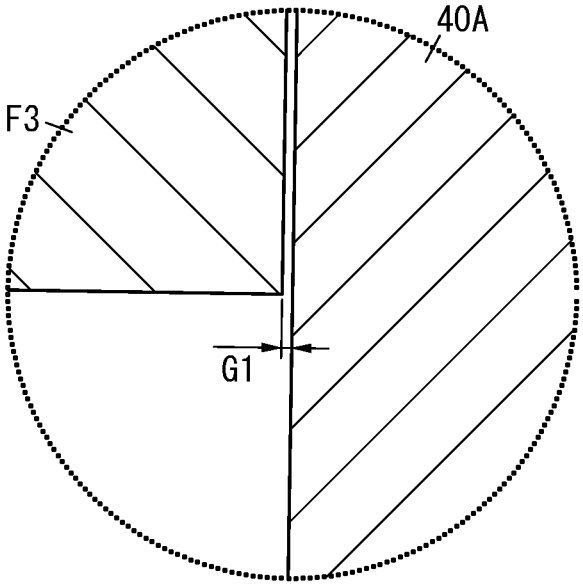
FIG. 22B is an enlarged view of a portion indicated by the one-dot-chain circle in FIG. 22A.

On the other hand, in the electromagnetic relay 1A according to the comparative example, the first and second fixed conductive portions 4A, 4B correspond to the cathode. As shown in FIGS. 22A and 22B, in the first fixed conductive portion 4A, there is a gap G1 with a width of 50 μm or more between the surface of the contact member F3 and the surface of the first base member 40A, thus making it difficult for the heat at the end point of the arc on the contact member F3 to be transferred to the first base member 40A. Therefore, in the first base member 40A, the temperature does not rise sufficiently, thus making it difficult for electrons to be emitted by the mechanism of thermal field emission. For this reason, the end point of the arc would not move from the contact member F3 to the first base member 40 but would remain at an edge portion of the contact member F3. Consequently, the arc would not be stretched sufficiently and the arc cutoff operation at the first fixed conductive portion 4A would lose stability.

In the contact device 2, the outer edge of the moving contact M10 as viewed in the second direction D2 has a curved shape and more specifically has a circular shape. To allow the heat to be transferred efficiently, the moving contact M10 suitably has a shape with as small a number of corners as possible. In particular, the moving contact M10 suitably has a shape with as small corners as possible in a plan view (i.e., when viewed in the second direction D2). The shape of the moving contact M10 is suitably a hemispherical, circular columnar, or semicircular columnar shape, rather than a square tubular shape.

In addition, in the contact devices 2, 2A, the Lorentz force produced by the magnetic field of the two permanent magnets 6 is applied to the arc, thus causing the arc and both end points of the arc to move.

Figure 23A:
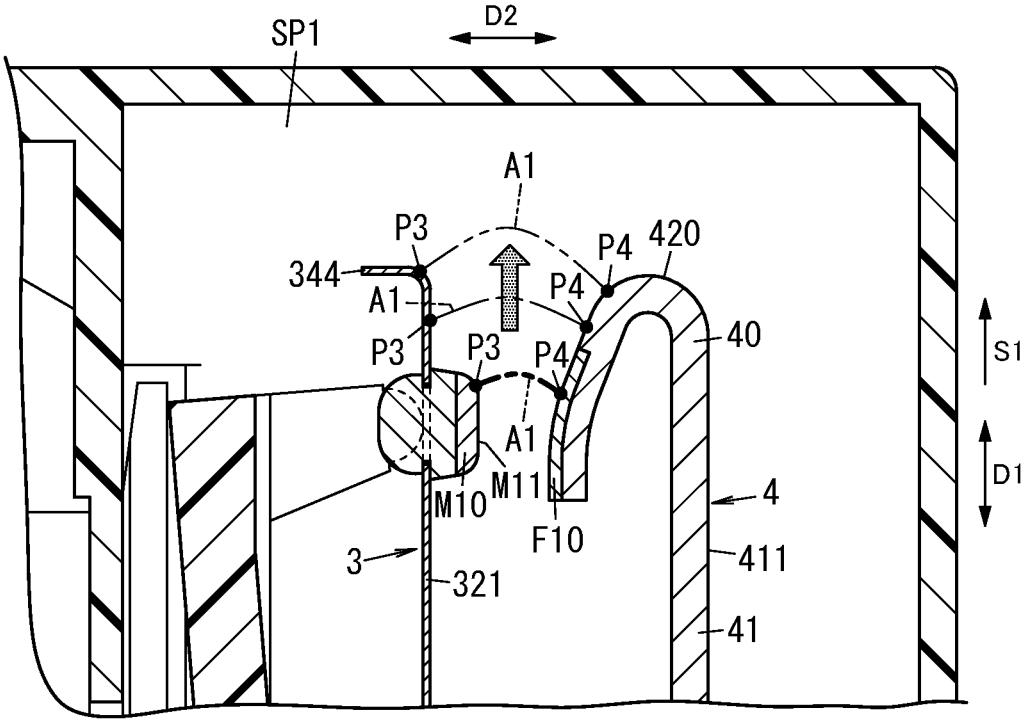
FIG. 23A illustrates how an arc moves in the electromagnetic relay according to the first embodiment.
Figure 23B:
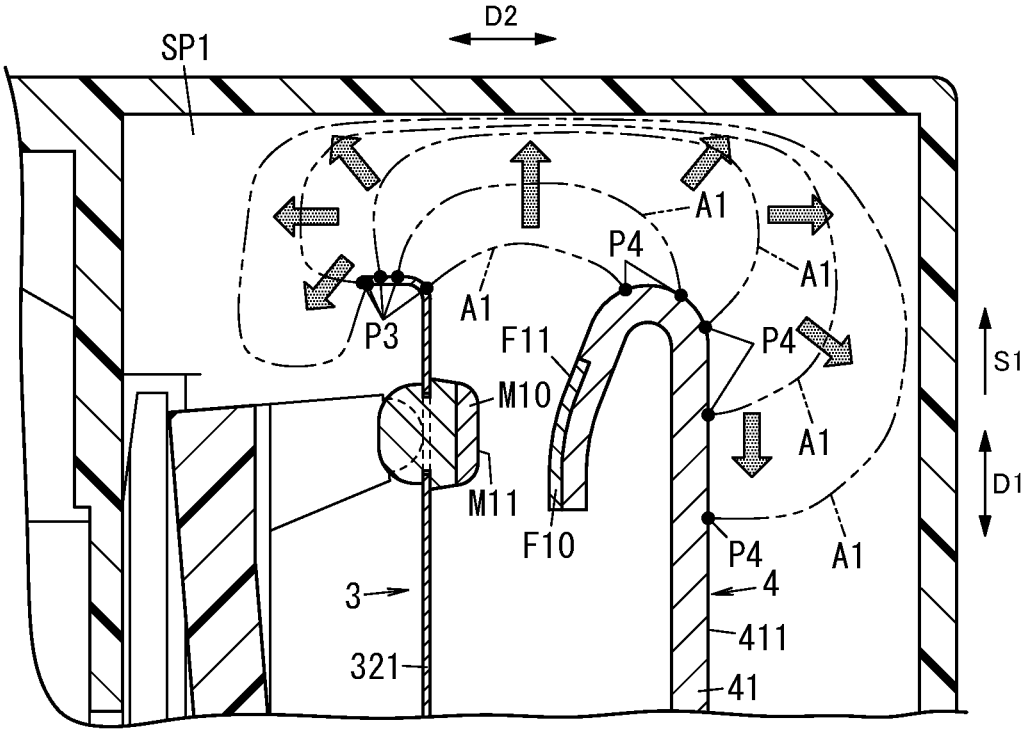
FIG. 23B illustrates how the arc moves in the electromagnetic relay.

FIGS. 23A and 23B illustrate how the arc A1 generated by the electromagnetic relay 1 according to the first embodiment and both end points P3, P4 of the arc A1 move. In FIG. 23A, the arc A1 indicated by the bold two-dot chain is an arc just generated. In FIGS. 23A and 23B, the two arcs A1 indicated by the fine two-dot chains are the arc that has moved. The end point P3 is an end point of the arc A1 on the moving conductive portion 3. The end point P4 is an end point of the arc A1 on the fixed conductive portion 4. In FIGS. 23A and 23B, the solid arrows indicate the directions of the Lorentz force applied to respective points of the arc A1.

First, the arc A1 is caused to move in the one direction S1 by the Lorentz force applied in the one direction S1. The end point P3 on the moving conductive portion 3 moves from the surface M11 of the moving contact M10 toward the base portion 321. The end point P4 on the fixed conductive portion 4 moves from the first surface F11 of the fixed contact F10 to the base member 40. The arc A1 further moves to cause the end point P3 to reach the tip in the one direction S1 of the moving conductive portion 3 and to cause the end point P4 to reach the tip 420 in the one direction S1 of the fixed conductive portion 4. Thereafter, the end point P3 moves away from the fixed conductive portion 4 to reach an end 344, opposite in the second direction D2 from the fixed conductive portion 4, of the moving conductive portion 3. Likewise, the end point P4 also moves away from the moving conductive portion 3 to reach a surface 411, opposite in the second direction D2 from the moving contact M10, of the extended portion 41 of the fixed conductive portion 4. The arc A1 is stretched by the Lorentz force in the first direction D1 and the second direction D2 inside the space SP1. Finally, the arc A1 is stretched to a length that is greater than the gap distance L1 as measured in the second direction D2 between the fixed contact F10 and the moving contact M10 as shown in FIG. 14. Thus, compared to a situation where the arc A1 is stretched to a length approximately equal to the distance L1, the arc cutoff may be stabilized.

In general, the longer the gap distance L1 is, the more easily the arc A1 may be stretched. Meanwhile, the shorter the gap distance L1 is, the smaller the overall size of the electromagnetic relay 1 may be. The gap distance L1 may be 0.8 mm, for example. The gap distance L1 suitably falls within the range from 0.5 mm to 1.1 mm, and more suitably falls within the range from 0.7 mm to 1.0 mm.

In the contact device 2, the end portion 42 of the fixed conductive portion 4 is curved to be folded back from the tip in the one direction S1 of the end portion 42, thus allowing the end point P4 of the arc A1 to move more smoothly along the end portion 42, compared to a situation where the end portion 42 has a flat plate shape. This is probably because when the end portion 42 has such a curved shape, the movement of the end point P4 of the arc A1 would be promoted more significantly, or interfered with less seriously, by the electric field surrounding the arc A1, compared to a situation where the end portion 42 has a flat plate shape.

Furthermore, in FIG. 14, as the distance to the top of FIG. 14 decreases, the gap distance between the first surface F11 of the fixed contact F10 and the surface M11 of the moving contact M10 increases. Thus, as the end point P4 of the arc A1 moves upward (i.e., in the one direction S1) along the first surface F11 and as the end point P3 of the arc A1 moves upward along the surface M11 of the moving contact, the arc A1 is stretched more and more significantly. This allows the contact device 2 to further improve the arc extinction performance.

Besides, in the contact device 2, the direction in which the extended portion 31 of the moving conductive portion 3 extends toward the end portion 32 and the direction in which the extended portion 41 of the fixed conductive portion 4 extends toward the end portion 42 are both the one direction S1. This makes it easier to stretch the arc toward both the spaces SP12 and SP13, compared to a situation where one of the extended portions 31, 41 extends in the opposite direction from the one direction S1. That is to say, this ensures an even broader arc stretching space.

In the foregoing description, a situation where electrons are emitted by thermal field emission has been described. Even when electrons are emitted by field emission, the configuration in which the surface 401 of the base member 40 is flush with the first surface F11 of the fixed contact F10 would also achieve the advantage of stabilizing the arc cutoff. Nevertheless, the situation where electrons are emitted by thermal field emission in the fixed conductive portion 4 to generate an arc would achieve the advantage of stabilizing the arc cutoff more significantly than the situation where electrons are emitted by field emission in the fixed conductive portion 4 to generate an arc, thanks to the configuration in which the surface 401 of the base member 40 is flush with the first surface F11 of the fixed contact F10.

The part, constituting the moving contact M10, of the contact member M1 may be made of, for example, a silver alloy (such as AgNi or $AgSnO_2$). The rest, other than the moving contact M10, of the contact member M1 may be made of a copper alloy such as touch-pitch copper. That is to say, the moving contact M10 has a structure in which a silver alloy material is bonded to a copper alloy material. Optionally, the moving contact M10 may be made of only a silver alloy. Such a configuration of the contact member M1 may be applied to the contact member F1 as well.

The moving contact M10 according to the first embodiment is a rivet contact. However, the moving contact M10 does not have to be a rivet contact but may also be a wire contact, for example. The wire contact is made of a circular columnar or polygonal (such as quadrangular) conductive material. If the moving contact M10 is a wire contact, then the moving contact M10 is fixed by caulking, for example, to the base portion 321. One of two bottom surfaces of such a circular columnar or polygonal conductive material constituting the moving contact M10 includes the moving contact M10 and faces the fixed contact F10. Optionally, the moving contact M10 may be attached to the base portion 321 by welding or brazing, for example. More specifically, a semicircular columnar or semicircular member that constitutes the moving contact M10 may be attached to the base portion 321 by welding or brazing. Such a configuration of the moving contact M10 is also applicable to the fixed contact F10.

(Method for Manufacturing Contact Device)

Next, an exemplary method for manufacturing the contact device 2 will be described with reference to FIGS. 10 and 16.

In the beginning, the base 701 of the case body 70 and the cover 702 are separate from each other. Also, in the beginning, the two permanent magnets 6 are not magnetized yet. First, the moving conductive portion 3, the fixed conductive portion 4, and the driving unit 5 are fixed to the base 701 of the case body 70. In addition, the permanent magnets 6 are inserted one by one into two inserting portions 71, provided inside the cover 702, through the respective openings 710 of the inserting portions 71 (see FIG. 5).

Next, the two permanent magnets 6 are magnetized. Then, the two permanent magnets 6 attract each other, and each of the two permanent magnets 6 comes into contact with the inner surface of its associated inserting portion 71. In this state, even if the assembly is arranged such that the opening 705 of the cover 702 faces vertically downward, the frictional force produced between each permanent magnet 6 and the inner surface of the inserting portion 71 reduces the chances of the permanent magnet 6 dropping out of the inserting portion 71.

Next, the cover 702 is attached to the base 701 such that the opening 705 of the cover 702 is closed with the base 701. This allows the moving conductive portion 3, the fixed conductive portion 4, the driving unit 5, and the two permanent magnets 6 to be housed in the case body 70. In addition, each permanent magnet 6 is arranged in this manner to face its associated regulating piece 721 as shown in FIG. 16. Two regulating pieces 721 are provided to correspond one to one to the two permanent magnets 6. Each regulating piece 721 faces the associated permanent magnet 6 in the first direction D1. This reduces the chances of each permanent magnet 6 dropping out of the inserting portion 71.

As can be seen from the foregoing description, each permanent magnet 6 is inserted through the opening 710 of its associated inserting portion 71 provided inside the case body 70. Thus, it is easier to insulate the permanent magnets 6 from the structure outside of the case body 70 compared to a configuration in which the opening 710 to insert the permanent magnet 6 therethrough is provided outside the case body 70. For example, if the opening 710A to insert the permanent magnet 6 therethrough is provided outside the case body 70A as in the comparative example (see FIG. 19), then the permanent magnet 6 needs to be covered with an insulator such as a sealing member to ensure insulation for the permanent magnet 6. In contrast, according to this embodiment, the sealing member may be omitted, thus cutting down the cost of covering the permanent magnets 6 with the sealing member.

In addition, the two permanent magnets 6 are arranged to produce attractive force between themselves and each of the two permanent magnets 6 is arranged to face its associated regulating piece 721, thus reducing the chances of the permanent magnets 6 dropping out of the inserting portions 71. Thus, the step of fixing the respective permanent magnets 6 to the inserting portions 71 by an adhesive, for example, may be omitted.

The contact device 2 includes the two conductive portions (namely, the moving conductive portion 3 and the fixed conductive portion 4), the case body 70, and the inserting portions 71. Each of the two conductive portions has a contact. The contact of one (i.e., the moving conductive portion 3) of the two conductive portions is the moving contact M10. The contact of the other (i.e., the fixed conductive portion 4) of the two conductive portions is the fixed contact F10. The moving contact M10 moves between the closed position where the moving contact M10 is in contact with the fixed contact F10 and the open position where the moving contact M10 is out of contact with the fixed contact F10. The two conductive portions are housed in the case body 70. The inserting portions 71 are provided inside the case body 70. The permanent magnets 6 are inserted one by one into the inserting portions 71.

The case body 70 includes the base 701 and the cover 702. The cover 702 is attached to the base 701 such that the opening 705 of the cover 702 is closed with the base 701. The regulating pieces 721 are fixed to the base 701 and are arranged inside the cover 702 when the base 701 is attached to the cover 702. The permanent magnets 6 are held between the regulating pieces 721 and the case body 70. Also, between each permanent magnet 6 and its associated regulating piece 721, arranged is the opening 710 of its associated inserting portion 71.

The method for manufacturing the contact device 2 includes: a first step of inserting the permanent magnets 6 into the inserting portions 71; a second step of magnetizing the permanent magnets 6; and a third step of attaching the cover 702 to the base 701 such that the opening 705 of the cover 702 is closed with the base 701. In the third step, the two conductive portions (namely, the moving conductive portion 3 and the fixed conductive portion 4) and the permanent magnets 6 are housed in the case body 70. In addition, in the third step, the permanent magnets 6 are held between the regulating pieces 721 and the case body 70.

The configuration for the inserting portions 71 is applicable independently of the configuration for the moving conductive portion 3, the fixed conductive portion 4, the driving unit 5, and other members. That is to say, the inserting portions 71 to insert the permanent magnets 6 thereto may be provided for a known contact device. The inserting portions 71 may be provided for, for example, a contact device having a structure in which the end portion 42 of the fixed conductive portion 4 is not curved. Optionally, the inserting portions 71 may be provided for a contact device including a moving contact and a fixed contact with arbitrary dimensions and shapes.

Furthermore, not only the inserting portions 71 but also the regulating pieces 721 may be provided for a known contact device. Also, the above-described method for manufacturing the contact device 2 using the inserting portions 71 and the regulating pieces 721 may be applied to a known contact device.

Furthermore, the number of the inserting portions 71 provided does not have to be two but may also be one or three or more. Likewise, the number of the regulating pieces 721 provided does not have to be two but may also be one or three or more.

(Variations of First Embodiment)

Next, variations of the first embodiment will be enumerated one after another.

The driving unit 5 does not have to be configured to drive the moving conductive portion 3 by changing the energization state of the coil 51. For example, the driving unit 5 may also be configured to drive the moving conductive portion 3 in accordance with the operator's manual operation (i.e., may be implemented as an actuator, for example). The electromagnetic relay 1 may also be used as a switch or a disconnector for opening and closing an electric circuit by driving the moving conductive portion 3 in accordance with the operator's manual operation, for example.

In the first embodiment described above, the first terminal portion 36 and the second terminal portion 46 are extended out of the case body 70 through the through holes 706, 707 provided through the base 701 of the case body 70. However, the first terminal portion 36 and the second terminal portion 46 do not have to have such a configuration. Alternatively, the first terminal portion 36 and the second terminal portion 46 may be extended out of the case body 70 from a different part of the case body 70. For example, the first terminal portion 36 and the second terminal portion 46 may also be extended out of the case body 70 through a through hole provided through the cap portion 704 of the case body 70. The direction in which the first terminal portion 36 is extended out of the case body 70 with respect to the position of the extended portion 31 as a starting point may be the same as, or different from, the one direction S1, whichever is appropriate. Likewise, the direction in which the second terminal portion 46 is extended out of the case body 70 with respect to the position of the extended portion 41 as a starting point may also be the same as, or different from, the one direction S1, whichever is appropriate.

Also, of the respective end portions 32, 42 of the moving conductive portion 3 and the fixed conductive portion 4, only one of these two end portions 32, 42 may be curved or both of these end portions 32, 42 may be curved. Making both of these two end portions curved further improves the arc extinction performance of the contact device 2.

As used herein, if the end portion 32 is curved, it means that the bend radius of the end portion 32 on a surface facing the end portion 42 is 50% or more of the thickness of the end portion 32. Likewise, if the end portion 42 is curved, it means that the bend radius of the end portion 42 on a surface facing the end portion 32 is 50% or more of the thickness of the end portion 42.

Furthermore, in the first embodiment described above, the moving contact M10 is configured to be attached to the base portion 321 by caulking. However, this is only an example of the present disclosure and should not be construed as limiting. Alternatively, the moving contact M10, as well as the fixed contact F10, may be crimped to a predetermined base member. This makes the end point of the arc easier to move on the moving conductive portion 3, thus further improving the arc extinction performance of the contact device 2. Still alternatively, part of the predetermined base member may also serve as the moving contact M10.

Furthermore, in the first embodiment described above, the fixed contact F10 is configured to be crimped to the base member 40. However, this is only an example of the present disclosure and should not be construed as limiting. Alternatively, the fixed contact F10, as well as the moving contact M10, may be attached to the base member 40 by caulking, for example Still alternatively, part of the base member 40 may serve as the fixed contact F10.

Furthermore, in the first embodiment described above, in the vicinity of the boundary between the surface 401 of the base member 40 and the first surface F11, facing the moving contact M10, of the fixed contact F10, the surface 401 is flush with the first surface F11. As used herein, if the surface 401 of the base member 40 is flush with the first surface F11 of the fixed contact F10, then it means that there are no grooves, of which the depth is at least 10%, suitably 5% or more, and more suitably 2% or more, of the thickness of the base member 40, or projections or level differences, of which the height is as large as the depth of such grooves, between the surface 401 and the first surface F11. The thickness of the base member 40 is about 500 μm, for example Thus, there should be no grooves with a depth of, for example, at least 50 μm, suitably 25 μm or more, and more suitably 10 μm or more, or projections or level differences, of which the height is as large as the depth of such grooves, between the surface 401 and the first surface F11. Crimping the fixed contact F10 to the base member 40 would form such a configuration that the surface 401 of the base member 40 is flush with the first surface F11 of the fixed contact F10 more easily than fixing the fixed contact F10 to the base member 40 by caulking. Note that the surface 401 of the base member 40 and the first surface F11 of the fixed contact F10 may be either planes or curved surfaces, whichever is appropriate.

Also, the surface M11, facing the fixed contact F10, of the moving contact M10 may be flush with the surface of the base portion 321. This configuration allows the end point of the arc to move more smoothly on the moving conductive portion 3, thus further improving the arc extinction performance of the contact device 2. In the configuration in which the moving contact M10 is crimped to the predetermined base member described above, the surface M11, facing the fixed contact F10, of the moving contact M10 may be flush with the surface of the predetermined base member. This configuration allows the end point of the arc to move more smoothly on the moving conductive portion 3, thus further improving the arc extinction performance of the contact device 2

Furthermore, the end portion 42 is curved to be folded back when viewed in the third direction D3. More specifically, the end portion 42 may have a U-shape or a C-shape when viewed in the third direction D3.

Likewise, the end portion 32 may also have a U-shape or a C-shape, for example, when viewed in the third direction D3.

Optionally, out of the moving conductive portion 3 and the fixed conductive portion 4, the moving conductive portion 3 may be electrically connected to the negative electrode of the DC power supply V1 and the fixed conductive portion 4 may be electrically connected to the positive electrode of the DC power supply V1, contrary to the first embodiment.

Furthermore, the electromagnetic relay 1 does not have to be implemented as a hinged relay. Alternatively, the electromagnetic relay 1 may also be implemented as a plunger relay in which the moving contact and the fixed contact are made to come into, and go out of, contact with each other by making a mover, corresponding to the moving conductive portion 3, move straight.

Furthermore, the moving conductive portion 3 and the fixed conductive portion 4 may be electrically connected to a DC power supply or an AC power supply, whichever is appropriate.

Second Embodiment

Figure 24:
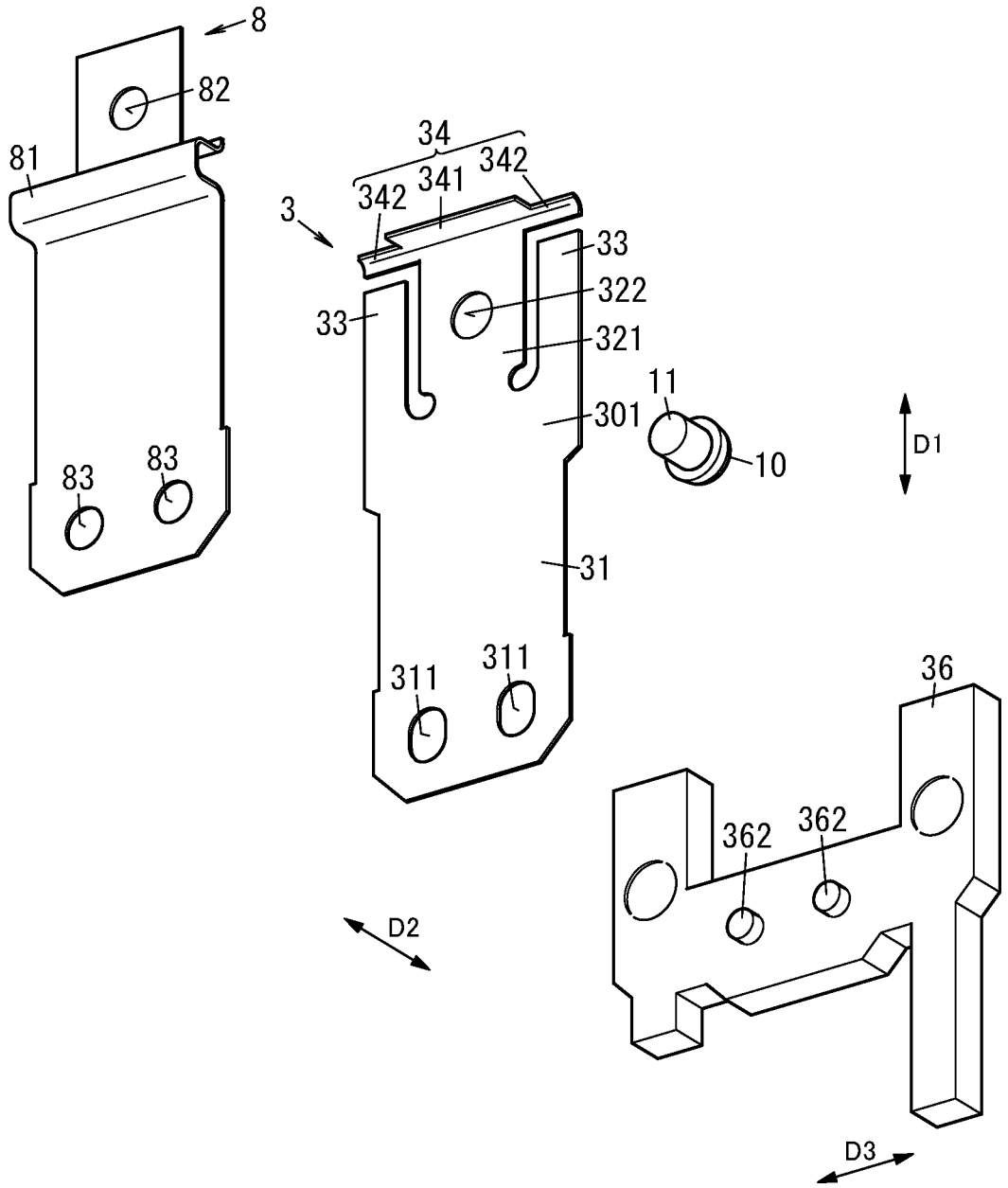
FIG. 24 is an exploded perspective view illustrating a moving conductive portion and supporting member of an electromagnetic relay according to a second embodiment.
Figure 25:
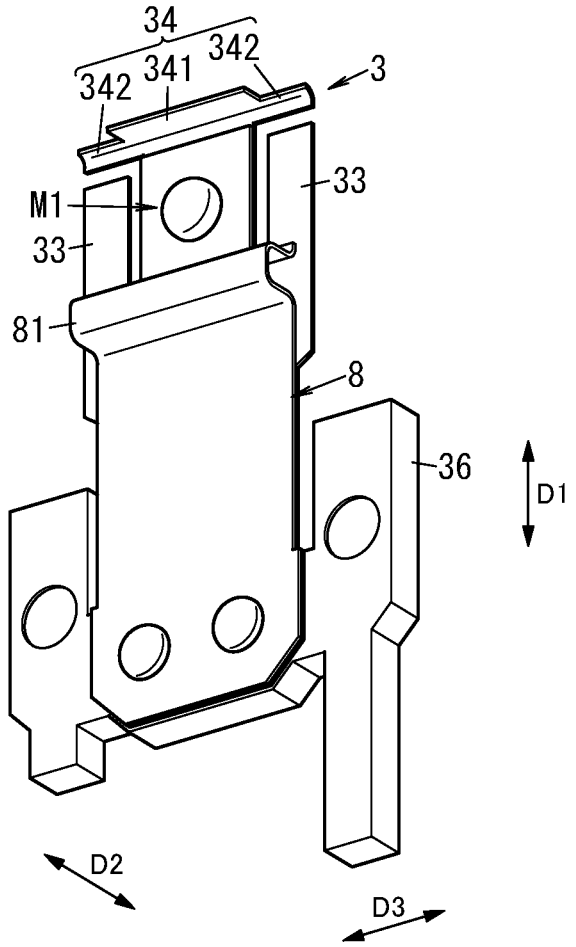
FIG. 25 is a perspective view illustrating an assembled state of the moving conductive portion and supporting member of the electromagnetic relay.

Next, a contact device according to a second embodiment will be described with reference to FIGS. 24 and 25. In the following description, any constituent element of this second embodiment, having the same function as a counterpart of the first embodiment described above, will be designated by the same reference numeral as that counterpart's, and description thereof will be omitted herein.

A contact device according to this embodiment further includes a supporting member 8. The supporting member 8 is formed in the shape of a rectangular plate. The supporting member 8 may be formed out of a metallic plate with spring properties, for example. The supporting member 8 is attached to the moving conductive portion 3 to be laid over the moving conductive portion 3. This allows the supporting member 8 to support the moving conductive portion 3.

The longitudinal axis of the supporting member 8 is aligned with the first direction D1. The supporting member 8 is attached to a surface 301, opposite from the fixed contact F10 (see FIG. 1), of the moving conductive portion 3. The supporting member 8 covers the base portion 321 and extended portion 31 of the moving conductive portion 3. One part 81 of the supporting member 8 is bent in a U-shape to go away from the moving conductive portion 3 when viewed in the third direction D3. The part 81 overlaps with a boundary between the base portion 321 and the extended portion 31. The supporting member 8 has a through hole 82 to be aligned with the attachment hole 322 of the base portion 321. Two caulking holes 83 are provided through the supporting member 8. Two caulking holes 311 are provided through the extended portion 31.

The contact member M1 with the moving contact M10 is formed by passing, through the attachment hole 322 and the through hole 82, the body portion 11 of a rivet member 10 that forms the basis of the contact member M1 and by crushing the body portion 11 with a caulking tool. In this manner, the contact member M1 is fixed to the base portion 321 and the supporting member 8. Also, the first terminal portion 36 to be electrically connected to the positive electrode of the DC power supply V1 (see FIG. 12) is connected both electrically and mechanically by caulking, for example, to the moving conductive portion 3 and the supporting member 8. The first terminal portion 36 has two projections 362. In the caulking step, the two projections 362 are passed through the two caulking holes 311 of the extended portion 31 and the two caulking holes 83 of the supporting member 8 and then crushed. The supporting member 8 is fixed to the first terminal portion 36 by caulking, for example, with the moving conductive portion 3 sandwiched between the first terminal portion 36 and the supporting member 8 itself.

When the moving conductive portion 3 is deformed by being pressed by the card 53 (see FIG. 1), the supporting member 8 is also deformed along with the moving conductive portion 3. The U-bent part 81 of the supporting member 8 is easily deformable. In addition, according to this embodiment, the first terminal portion 36 and the moving contact M10 are electrically connected together via the moving conductive portion 3 and the supporting member 8, and therefore, the electrical resistance between the first terminal portion 36 and the moving contact M10 is reducible compared to the first embodiment. This allows the contact device 2 to be used with an even larger energization current.

Third Embodiment

Figure 26:
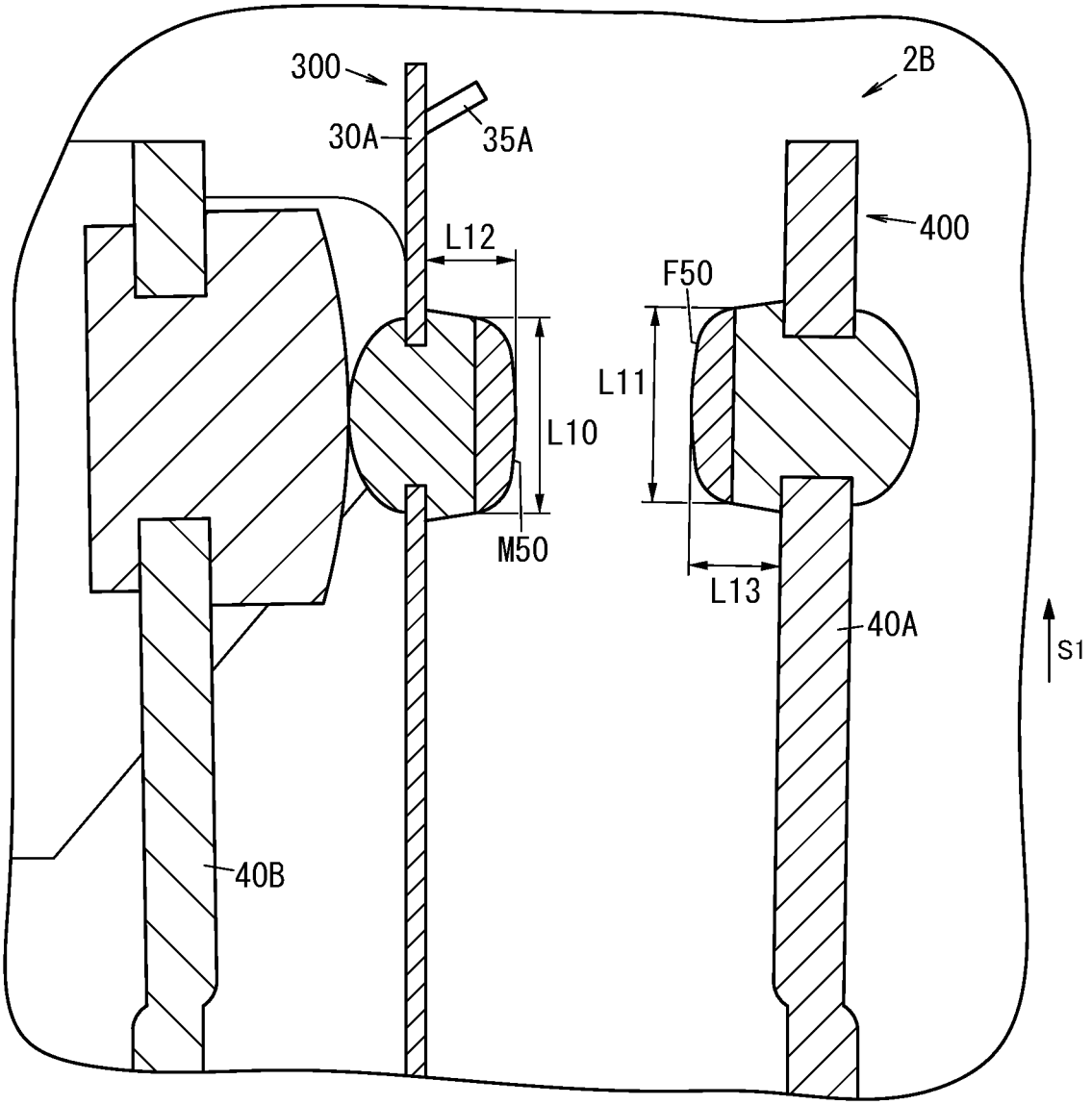
FIG. 26 is a cross-sectional view illustrating a principal part of an electromagnetic relay according to a third embodiment.

Next, a contact device 2B according to a third embodiment will be described with reference to FIG. 26. In the following description, any constituent element of the contact device 2B, having the same function as a counterpart of the contact device 2A according to the comparative example (see FIG. 21) described above, will be designated by the same reference numeral as that counterpart's, and description thereof will be omitted herein. Also, unlike the contact device 2 of the first embodiment, the contact device 2B to be described below does not include the first conductive portion (fixed conductive portion 4: see FIG. 14) with the first end portion (end portion 42: see FIG. 14) that is curved to be folded back from the tip in the one direction S1. The contact device 2B includes a fixed conductive portion 400 instead of the fixed conductive portion 4. Optionally, the contact device 2B may include the fixed conductive portion 4 of the first embodiment, not the fixed conductive portion 400.

A moving conductive portion 300 of the contact device 2B includes a moving contact M50 instead of the first moving contact M30 (see FIG. 21). The fixed conductive portion 400 includes a fixed contact F50 instead of the first fixed contact F30 (see FIG. 21).

In the contact device 2A, the diameter L7 (see FIG. 22A) of the first moving contact M30 and the diameter L8 (see FIG. 22A) of the first fixed contact F30 are 2.8 mm. In the contact device 2B, on the other hand, the diameter L10 of the moving contact M50 and the diameter L11 of the fixed contact F50 are 1.5 mm.

The diameter L10 of the moving contact M50 of the contact device 2B is smaller than the diameter L7 of the first moving contact M30 of the contact device 2A. This allows the arc to quickly move from the moving contact M50 to the base portion 30A, thus stabilizing the cutoff of the arc.

In the contact device 2B, the protrusion length L12 of the moving contact M50 toward the fixed contact F50 with respect to the base portion 30A may be 0.65 mm, for example.

Also, the protrusion length L13 of the fixed contact F50 toward the moving contact M50 with respect to the first base member 40A may be 0.65 mm, for example.

In the contact device 2B according to this embodiment, the arc cutoff time fell within the range from 1.0 ms to 2.0 ms, for example.

In addition, a protruding portion 35A protrudes from the base portion 30A. The protruding portion 35A protrudes from the tip in the one direction S1 of the base portion 30A toward the fixed contact F50.

Fourth Embodiment

Figure 27:
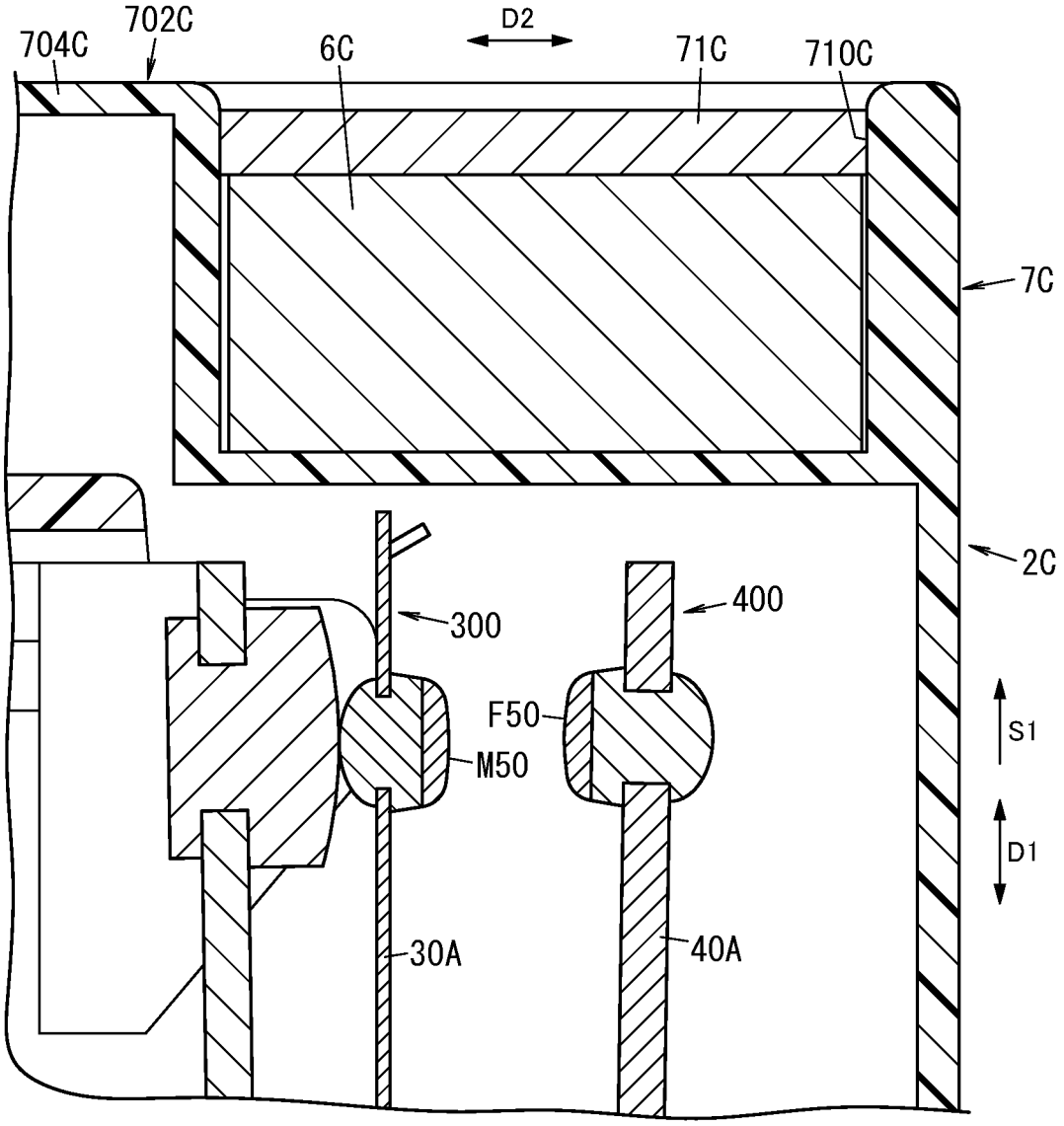
FIG. 27 is a cross-sectional view illustrating a principal part of an electromagnetic relay according to a fourth embodiment.

Next, a contact device 2C according to a fourth embodiment will be described with reference to FIG. 27. In the following description, any constituent element of the contact device 2C, having the same function as a counterpart of the contact device 2B according to the third embodiment (see FIG. 26) described above, will be designated by the same reference numeral as that counterpart's, and description thereof will be omitted herein. Also, unlike the contact device 2 of the first embodiment, the contact device 2C to be described below does not include the first conductive portion (fixed conductive portion 4: see FIG. 14) with the first end portion (end portion 42: see FIG. 14) that is curved to be folded back from the tip in the one direction S1. The contact device 2C includes a fixed conductive portion 400 instead of the fixed conductive portion 4. Optionally, the contact device 2C may include the fixed conductive portion 4 of the first embodiment, not the fixed conductive portion 400.

The case 7C of the contact device 2C includes a single inserting portion 71C instead of the two inserting portions 71A (see FIG. 19). An opening 710C of the inserting portion 71C is provided through an outer surface of a cover 702C of the case 7C. The inserting portion 71C is provided as a recess on the outer surface of a cap portion 704C of the cover 702C. A single permanent magnet 6C is inserted into the inserting portion 71C.

The permanent magnet 6C faces the moving contact M50 and the fixed contact F50 in the first direction D1 (predetermined direction). The longitudinal axis of the base portion 30A is aligned with the first direction D1.

The permanent magnet 6C generates a magnetic field aligned with the first direction D1. To a current flowing in the second direction D2 between the fixed contact F50 and the moving contact M50, Lorentz force aligned with the third direction D3 (i.e., the direction in which the viewer looks at FIG. 27 from in front of the paper) is applied. This allows the arc generated between the fixed contact F50 and the moving contact M50 to be stretched in the third direction D3.

The following aspect is disclosed from the fourth embodiment described above. In the contact device 2C, the permanent magnet 6C faces at least one of a first contact (fixed contact F50) or a second contact (moving contact M50) in the predetermined direction (first direction D1). The predetermined direction is aligned with the one direction S1.

According to this configuration, the permanent magnet 6C generates a magnetic flux, and Lorentz force is applied to the arc A1 generated between the fixed contact F50 and the moving contact M50, thus making it easier to stretch the arc A1.

In addition, in the contact device 2C, the permanent magnet 6C faces at least one of the first contact (fixed contact F50) or the second contact (moving contact M50) in the predetermined direction (first direction D1). The second conductive portion (moving conductive portion 300) includes the base portion 30A. The second contact is fixed to the base portion 30A. The longitudinal axis of the base portion 30A is aligned with the predetermined direction.

According to this configuration, the permanent magnet 6C generates a magnetic flux, and Lorentz force is applied to the arc A1 generated between the fixed contact F50 and the moving contact M50, thus making it easier to stretch the arc A1.

Fifth Embodiment

Next, a contact device 2D and an electromagnetic relay 1D according to a fifth embodiment will be described with reference to FIGS. 28-36B. In the following description, any constituent element of this fifth embodiment, having the same function as a counterpart of the first embodiment described above, will be designated by the same reference numeral as that counterpart's, and description thereof will be omitted herein.

Figure 28:
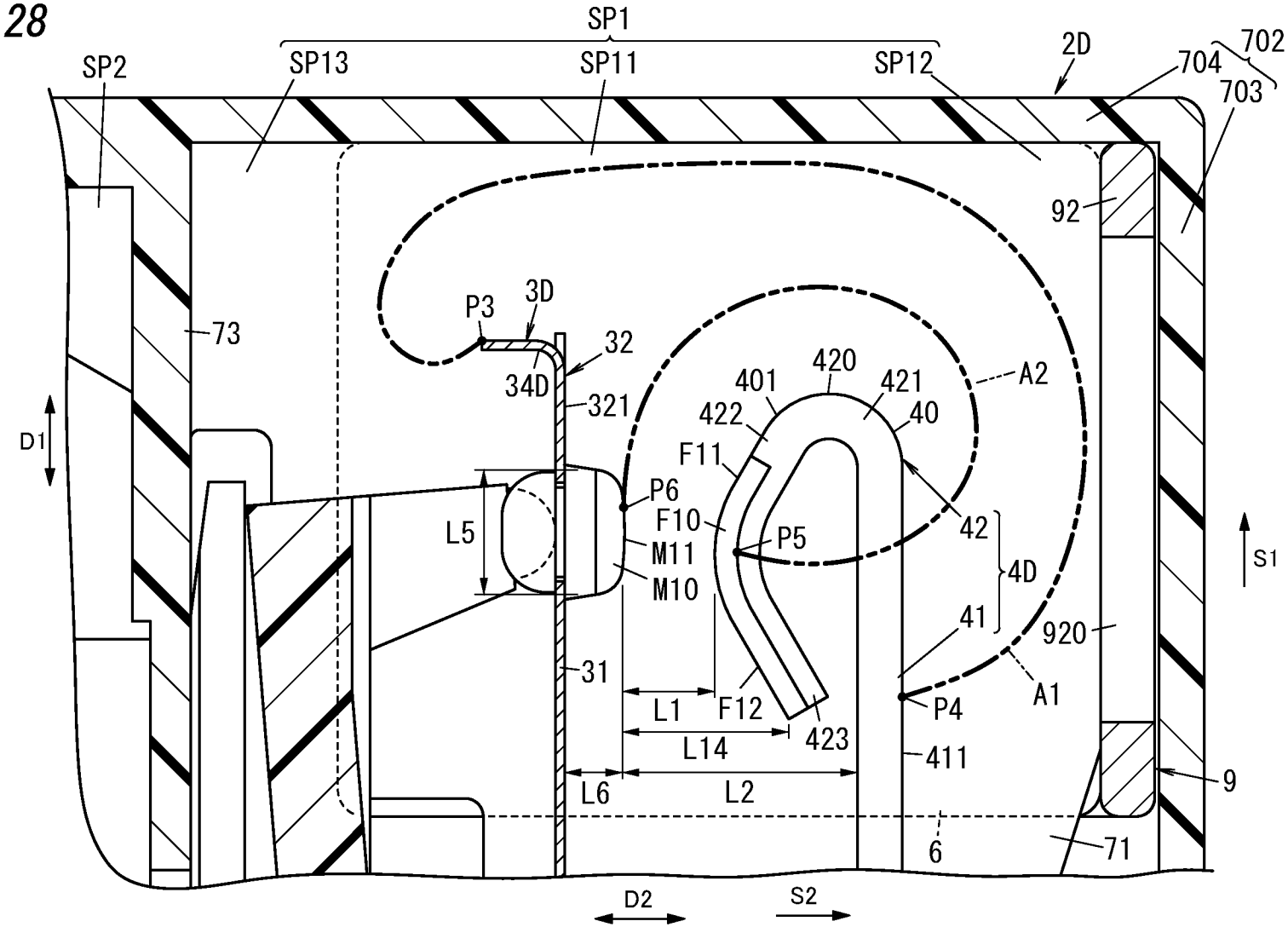
FIG. 28 is a cross-sectional view illustrating a principal part of an electromagnetic relay according to a fifth embodiment to schematically show how an arc is generated.
Figure 29:
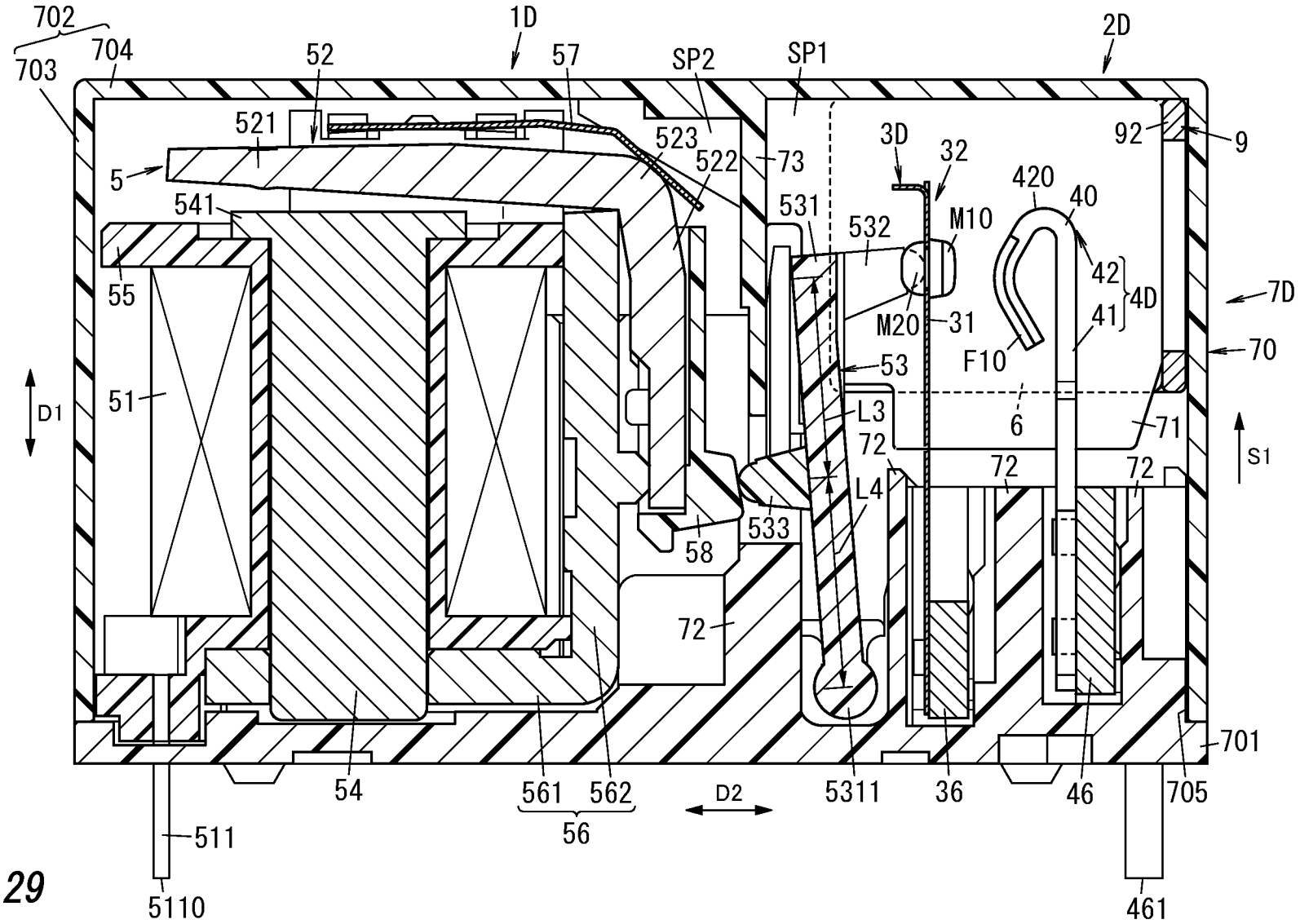
FIG. 29 is a side cross-sectional view of the electromagnetic relay illustrating a state where no current flows through its coil to keep a moving contact and a fixed contact out of contact with each other.
Figure 30:
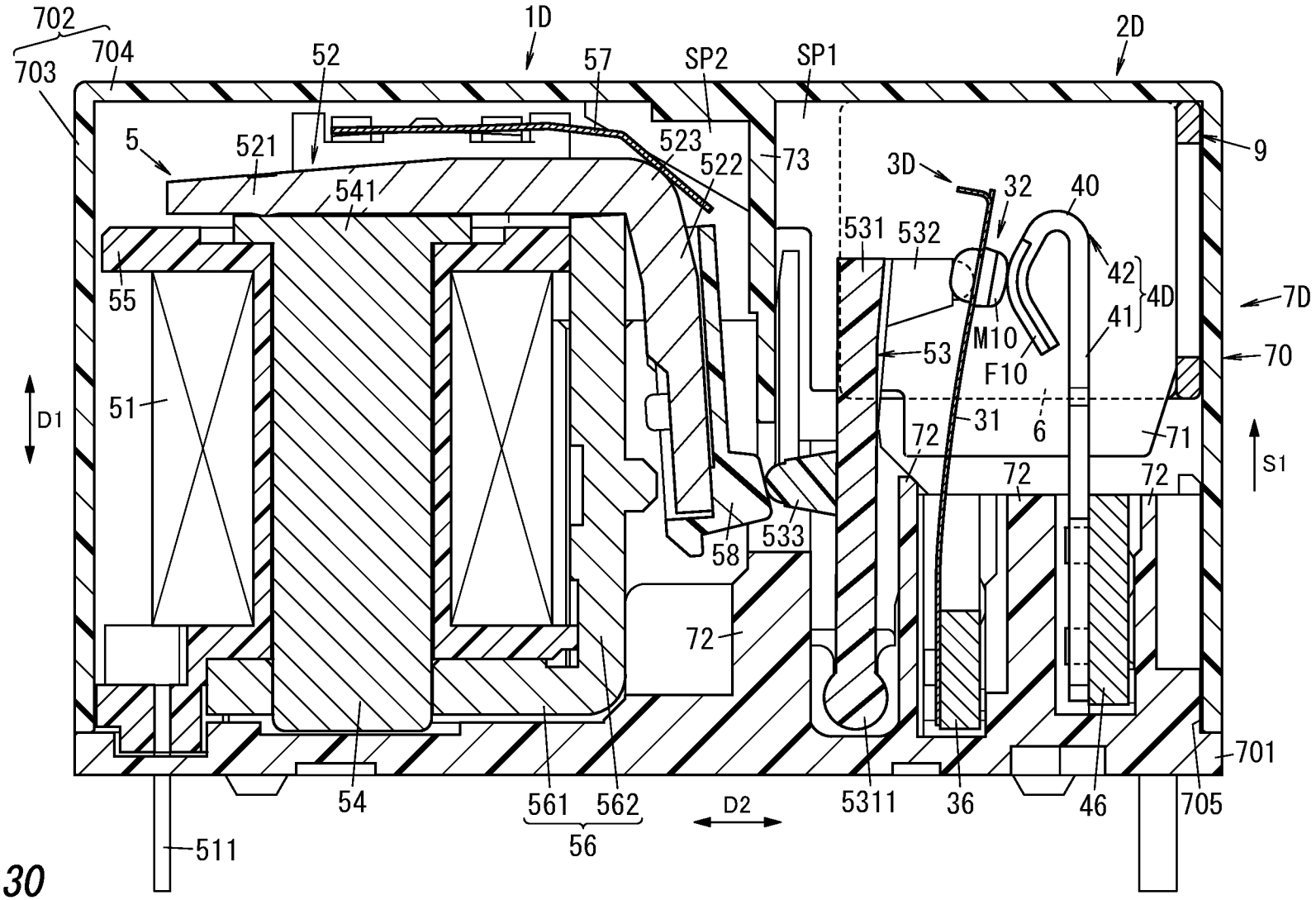
FIG. 30 is a side cross-sectional view of the electromagnetic relay illustrating a state where a current flows through its coil to bring the moving contact and the fixed contact into contact with each other.
Figure 31:
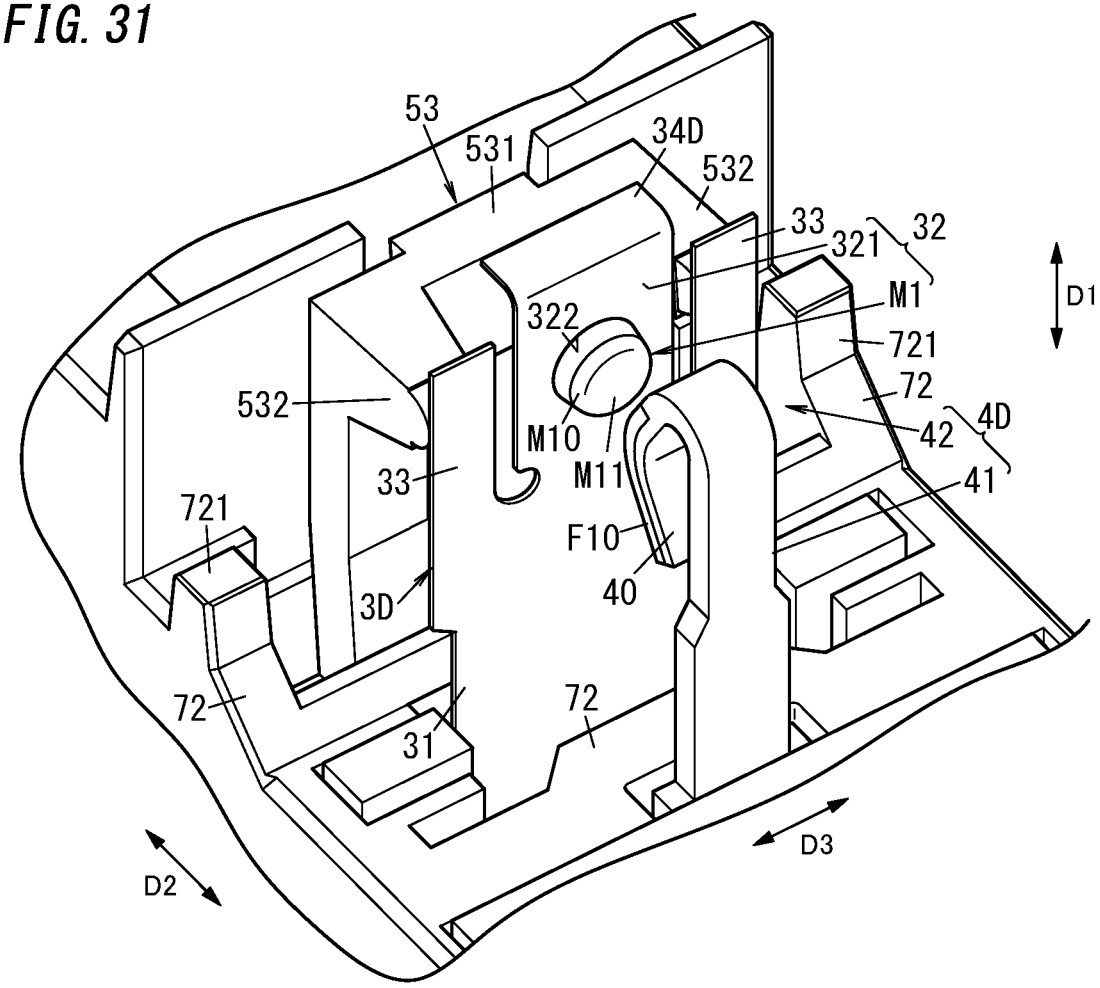
FIG. 31 is a perspective view illustrating a principal part of the electromagnetic relay.
Figure 32:
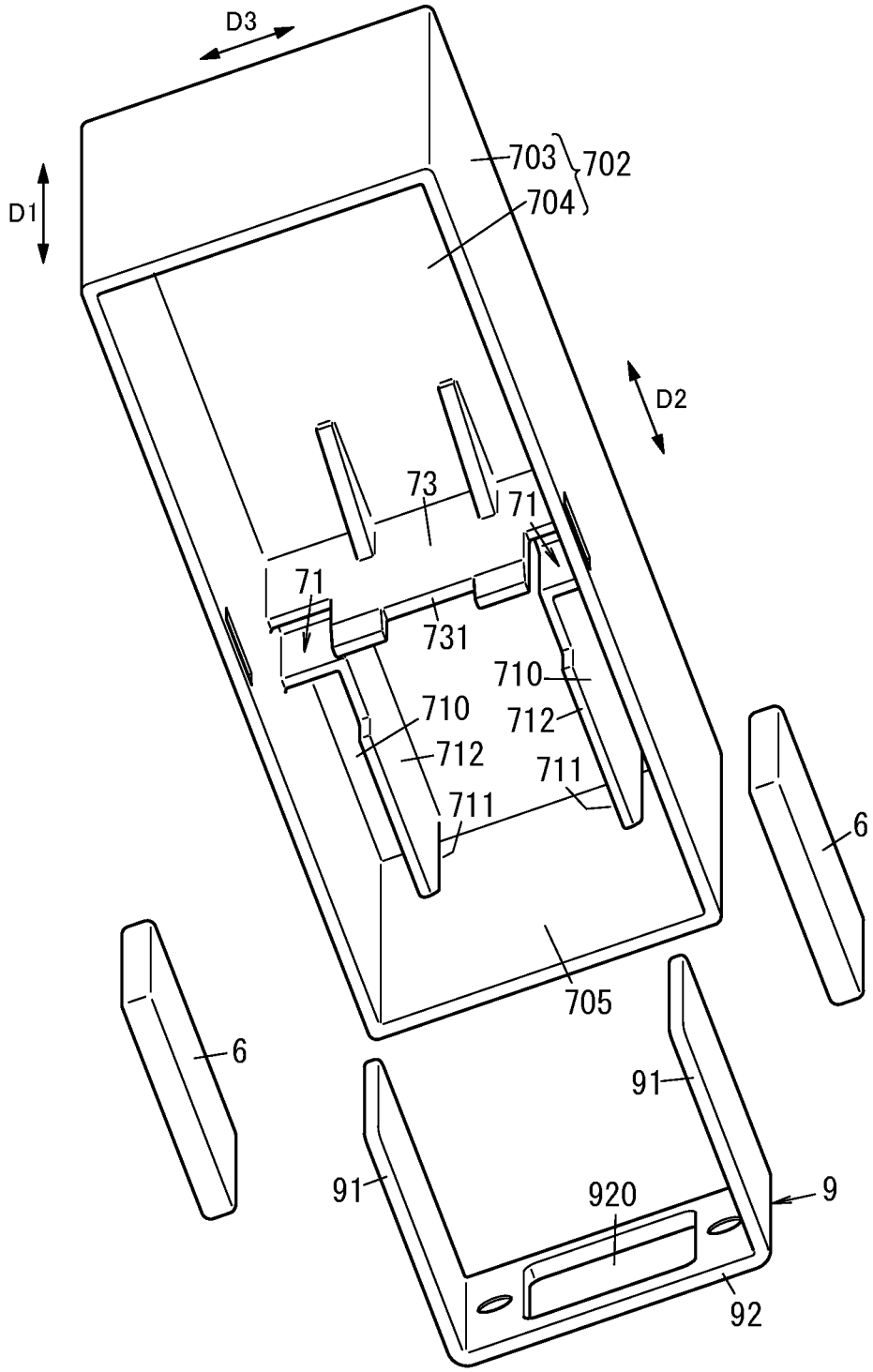
FIG. 32 is an exploded perspective view illustrating a cover, a first yoke, and two permanent magnets of the electromagnetic relay.

As shown in FIGS. 28 and 32, the contact device 2D according to this embodiment further includes a first yoke 9 (yoke), which is a major difference from the contact device 2 of the first embodiment. The first yoke 9 is housed in the case body 70. In the following description, to distinguish the yoke 56 from the first yoke 9, the yoke 56 will be referred to as a "second yoke 56."

The surface M11, facing the fixed contact F10, of the moving contact M10 has a spherical shape. Alternatively, the surface M11 may also have a flat shape or a convex shape.

A facing portion 34D (see FIG. 31) has the same shape as the facing portion 34 according to the first embodiment except that the facing portion 34D includes neither of the two arm portions 342.

As shown in FIG. 28, the end portion 42 includes an intermediate portion 421 and a curved portion 422. A first end of the intermediate portion 421 is connected to the extended portion 41 and a second end thereof is connected to the curved portion 422. That is to say, the intermediate portion 421 is provided between the extended portion 41 and the curved portion 422. The intermediate portion 421 is curved to come closer toward the moving contact M10 as a distance to a tip portion in the one direction of the intermediate portion 421 decreases. The curved portion 422 has a curved shape. The curved portion 422 extends, from the tip in the one direction S1 of the intermediate portion 421, in the direction opposite from the one direction S1. In this case, the tip in the one direction S1 of the intermediate portion 421 agrees with the tip 420 in the one direction S1 of the end portion 42. The fixed contact F10 is present in the curved portion 422.

Part, located between a position adjacent to the intermediate portion 421 and a position facing the moving contact M10, of the curved portion 422 is curved to come closer toward the moving contact M10 as the distance to the tip in the direction opposite from the one direction S1 decreases.

As shown in FIG. 28, a second surface F12, adjacent to the first surface F11, of the fixed contact F10 is provided to extend from the first surface F11 in the direction opposite from the one direction S1. In this case, the second surface F12 extends through a tip portion 423 in the direction opposite from the one direction S1 of the end portion 42. Part of the end portion 42 is curved to go away from the moving contact M10 as the distance to the tip portion 423 decreases. That is to say, part surrounding the tip portion 423 of the end portion 42 is curved toward the extended portion 41 (i.e., to the right in FIG. 28). Thus, the distance L14 measured in the second direction D2 between the tip portion 423 and the moving contact M10 is longer than the gap distance L1 measured in the second direction D2 between the fixed contact F10 and the moving contact M10.

When the moving contact M10 is located at the closed position, the surface M11 of the moving contact M10 is tilted with respect to the first direction D1 to come into contact with a curved region of the first surface F11 of the fixed contact F10.

Figure 33:
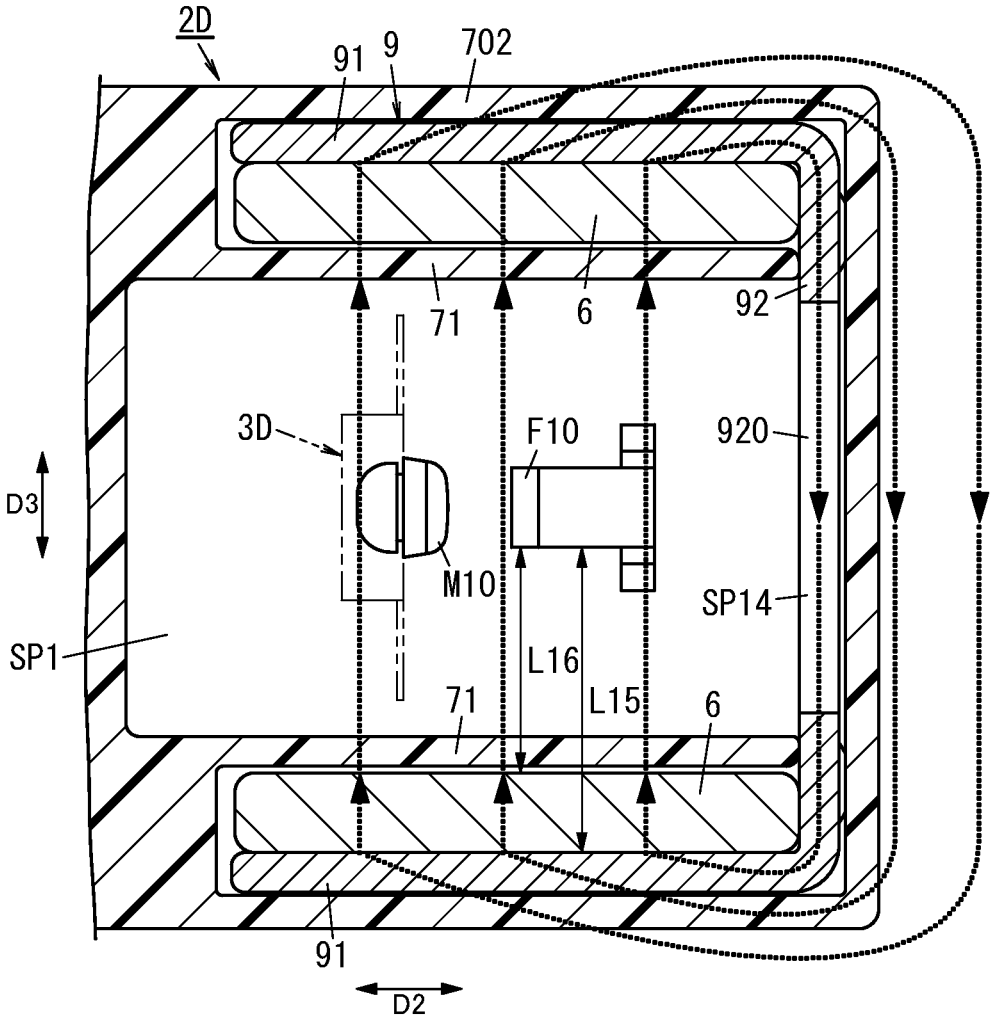
FIG. 33 is a schematic top cross-sectional view of the electromagnetic relay.

In FIGS. 32 and 33, each of the two inserting portions 71 of the case 7D includes a housing wall 712 formed in an L-shape when viewed in the first direction D1 and a part of the cover 702 of the case body 70. The housing walls 712 are provided inside the cover 702. The housing walls 712 are formed integrally with the cover 702. The permanent magnet 6 is housed in each inserting portion 71. That is to say, the permanent magnet 6 is arranged between the housing wall 712 of each inserting portion 71 and the inner surface of the cover 702. There is an opening 710, which is open in the first direction D1, between each inserting portion 71 and the inner surface of the cover 702. Also, a gap 711 is provided between one end in the second direction D2 of the housing wall 712 and the inner surface of the cover 702.

As shown in FIGS. 32 and 33, the first yoke 9 is formed in a U-shape. The first yoke 9 includes two side portions 91 and a coupling portion 92 to couple the two side portions 91 together. The first yoke 9 is made of a magnetic material such as iron (electromagnetic soft iron). The first yoke 9 is arranged on the path of the magnetic flux generated by the two permanent magnets 6.

The two side portions 91 are located, in the third direction D3, on both sides of the fixed contact F10. The two side portions 91 each have a rectangular plate shape. The two side portions 91 are generally parallel to each other and face each other. The two side portions 91 correspond one to one to the two inserting portions 71. Each side portion 91 is inserted into its corresponding inserting portion 71. The two side portions 91 are also associated one to one with the two permanent magnets 6. Each side portion 91 is adjacent to its associated permanent magnet 6. Each side portion 91 is located outside its associated permanent magnet 6 with respect to the fixed contact F10. That is to say, each side portion 91 is arranged between its associated permanent magnet 6 and the inner surface of the cover 702. Thus, the distance L15 between a part adjacent to the permanent magnet 6 (i.e., the side portion 91) of the first yoke 9 and the fixed contact F10 is longer than the distance L16 between a part adjacent to the first yoke 9 of the permanent magnet 6 and the fixed contact F10. With this regard, since the entire permanent magnet 6 is adjacent to the side portion 91 in this embodiment, that part adjacent to the first yoke 9 of the permanent magnet 6 refers to the entire permanent magnet 6.

The coupling portion 92 has a rectangular frame shape. The coupling portion 92 has an opening 920 in its central region. The opening 920 has a rectangular shape. The space SP1 in which the fixed contact F10 and the moving contact M10 are arranged includes a space SP14 inside the opening 920. In this case, the space SP1 is the internal space of the case 7D. The inner surface of the opening 920 is located inside the case 7D. The two side portions 91 protrude from both ends in the third direction D3 of the coupling portion 92. The two side portions 91 both protrude toward the same end in the second direction D2 from the coupling portion 92.

The coupling portion 92 is arranged to face the inner surface of the cover 702. The coupling portion 92 is passed through the gap 711 between one end of the housing wall 712 of each inserting portion 71 and the inner surface of the cover 702.

The coupling portion 92 is exposed to the space SP1 in which the fixed contact F10 and the moving contact M10 are arranged. That is to say, at least part of the first yoke 9 is exposed to the space SP1. The fixed contact F10 is located between the coupling portion 92 and the moving contact M10.

Figure 34A:
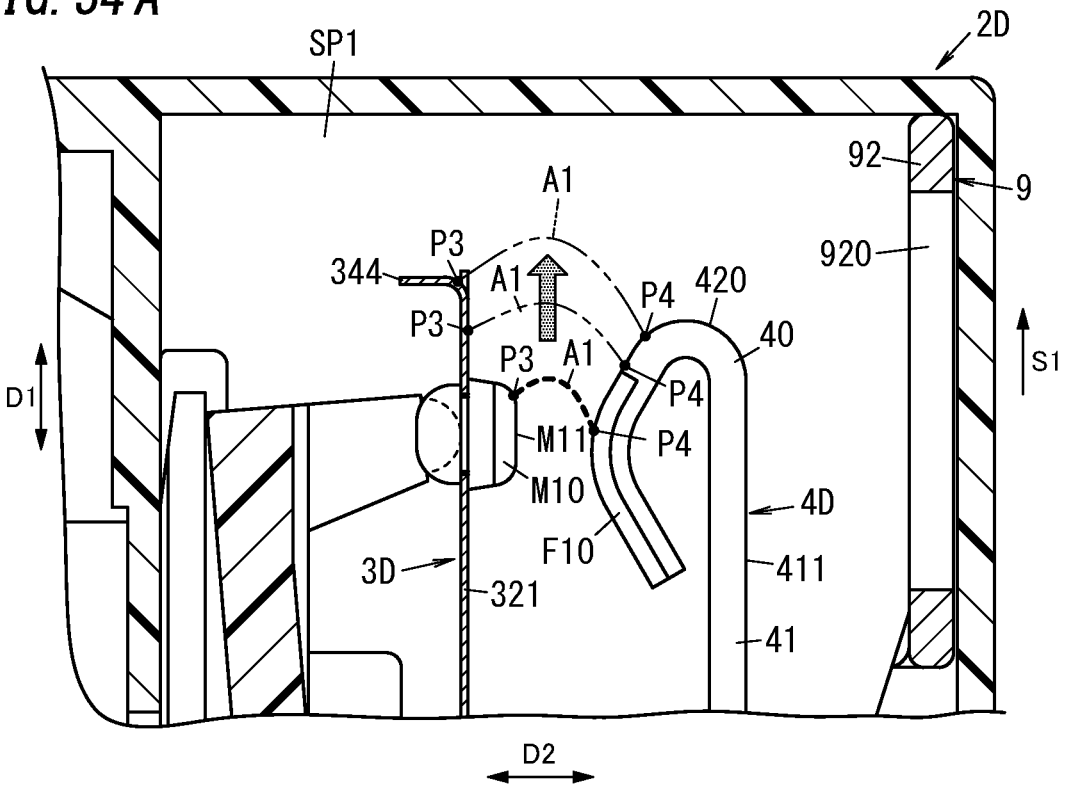
FIG. 34A illustrates how an arc moves in the electromagnetic relay.
Figure 34B:
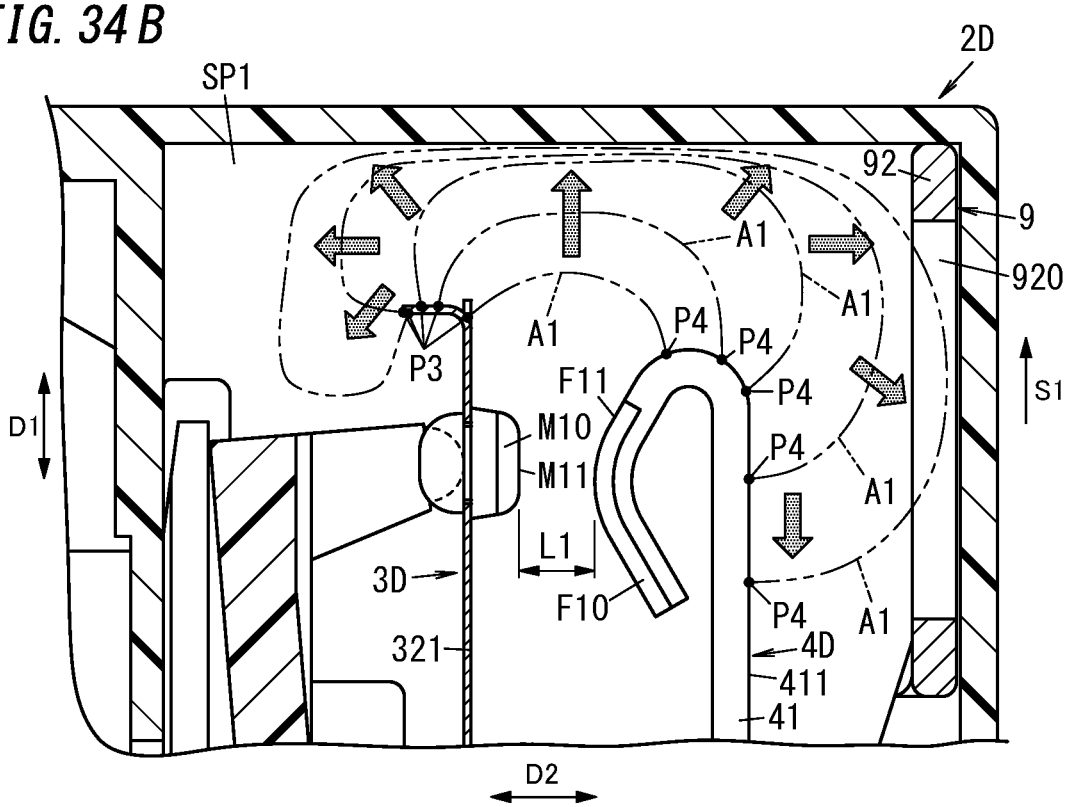
FIG. 34B illustrates how the arc moves in the electromagnetic relay.

FIGS. 34A and 34B illustrate how the arc generated by the electromagnetic relay 1D according to the fifth embodiment and both end points P3, P4 of the arc move. In FIG. 34A, the bold dashed line indicates a virtual path A1 of the arc just generated. In FIGS. 34A and 34B, the fine two-dot chains indicate the virtual paths A1 of the arc that has moved. The end point P3 is an end point of the arc on the moving conductive portion 3D. The end point P4 is an end point of the arc on the fixed conductive portion 4D. In FIGS. 34A and 34B, the solid arrows indicate the directions of the Lorentz force applied to respective points of the arc.

The first yoke 9 arranged in the space SP1 has the opening 920, and therefore, the space inside the opening 920 may be used as a part of the arc stretching space. That is to say, the arc may be stretched to reach the space inside the opening 920. As can be seen, the contact device 2D has a broader arc stretching space compared to a situation where the first yoke 9 does not have the opening 920.

Also, as shown in FIG. 28, a part, surrounding the tip portion 423 in the direction opposite from the one direction S1, of the end portion 42 is curved in such a direction as going away from the moving contact M10. The distance L14 measured in the second direction D2 between the tip portion 423 and the moving contact M10 is longer than the gap distance L1 measured in the second direction D2 between the fixed contact F10 and the moving contact M10. Thus, if the end point P4 of the arc has moved in the end portion 42 from a position closest to the moving contact M10 toward the tip portion 423, the arc is stretched. This allows the contact device 2D to further improve the arc extinction performance.

Figure 35:
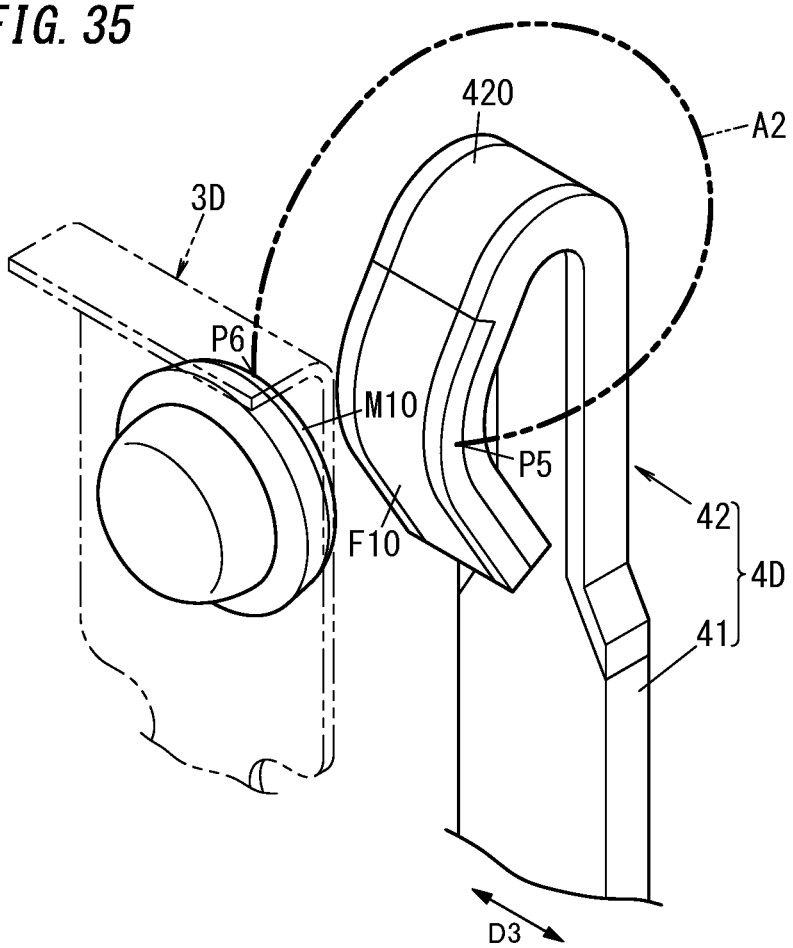
FIG. 35 is a perspective view illustrating a principal part of the electromagnetic relay to schematically show how an arc is generated.

A situation where the arc is stretched such that the end point P4 of the arc moves from the end portion 42 toward the extended portion 41 in the fixed conductive portion 4D has been described with reference to FIGS. 34A and 34B. In another situation, the arc may be stretched with the end point P4 thereof remaining in the end portion 42. Such a situation will be described in detail with reference to FIGS. 28 and 35 illustrating the virtual path A2 of the arc in that situation.

In the following description, an end point of the arc on the fixed conductive portion 4D when the arc is generated along the virtual path A2 will be hereinafter referred to as an "end point P5" and an end point the arc on the moving conductive portion 3D in such a situation will be hereinafter referred to as an "end point P6."

When the end point P5 is located around the middle in the third direction D3 of the fixed contact F10, it is difficult to stretch the arc from the end point P5 to the right, because part of the base member 40 fixed to the fixed contact F10 is present on the right of the fixed contact F10 in FIG. 28.

In a conductor, an electric field tends to be concentrated toward a pointed portion. That is to say, at an end in the third direction D3 of the fixed contact F10, the electric field tends to be concentrated more easily than around the middle of the fixed contact F10. Thus, the end point P5 of the arc tends to move toward the end in the third direction D3 of the fixed contact F10. Actually, the end point P5 may move from around the middle in the third direction D3 of the fixed contact F10 through the end in the third direction D3 of the fixed contact F10 as shown in FIG. 35. Then, the arc may be stretched from the end point P5 to the right by passing through the vicinity of the base member 40 (i.e., a region in front of the base member 40 for a viewer who looks at FIG. 28 from in front of the paper on which FIG. 28 is drawn). Thus, the arc is stretched as indicated by the virtual path A2, for example Specifically, along the virtual path A2, the arc extends from one end in the third direction D3 of the fixed contact F10 toward the extended portion 41, further extends in the one direction S1, and then is connected to the moving contact M10 so as to draw a circle. That is to say, the arc is extended from the fixed contact F10 in a direction opposite from the moving contact M10.

Figure 36A:
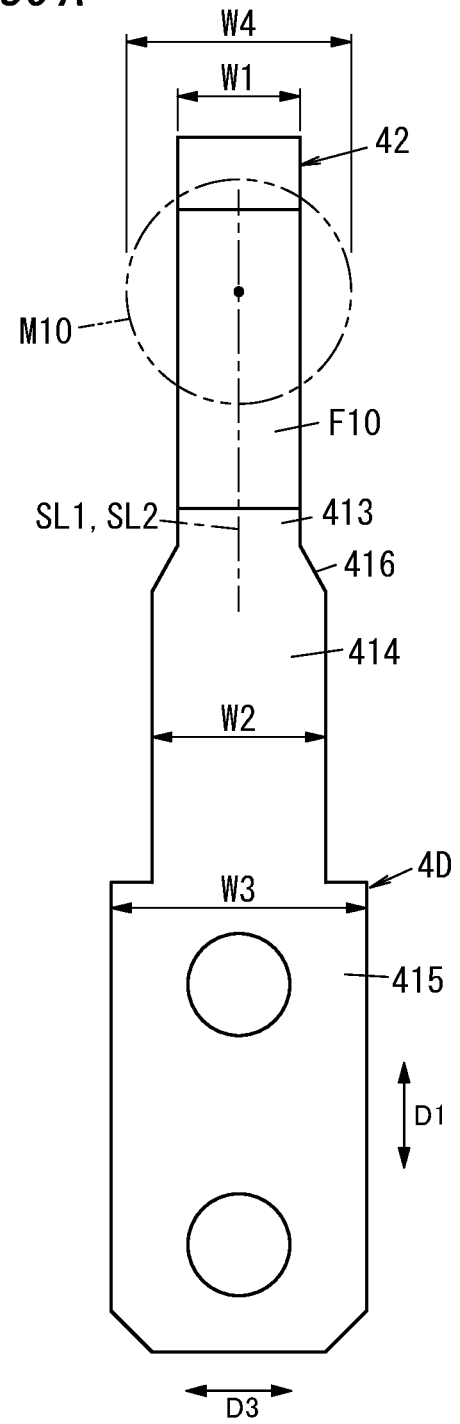
FIG. 36A is a front view of a fixed conductive portion of the electromagnetic relay.

In this case, if the end point P5 of the arc on the fixed contact F10 of the fixed conductive portion 4D moves quickly to reach the end in the third direction D3 of the fixed contact F10, then the arc may be stretched quickly. Thus, the width W1 in the third direction D3 of the fixed contact F10 is suitably sufficiently small. As shown in FIG. 36A, in the fixed conductive portion 4D according to this embodiment, the width W1 in the third direction D3 of the fixed contact F10 (first contact) is smaller than the maximum width W3 in the third direction D3 of the fixed conductive portion 4D (first conductive portion). In this case, the maximum width W3 corresponds to the width in the third direction D3 of a third part 415 to be described later. Furthermore, the width W1 in the third direction D3 of the fixed contact F10 is smaller than the maximum width W2 in the third direction D3 of parts (i.e., a first part 413 and a second part 414 to be described later) exposed to the space SP1 in which the fixed contact F10 and the moving contact M10 are arranged. In this case, the maximum width W2 corresponds to the width in the third direction D3 of the second part 414.

Figure 36B:
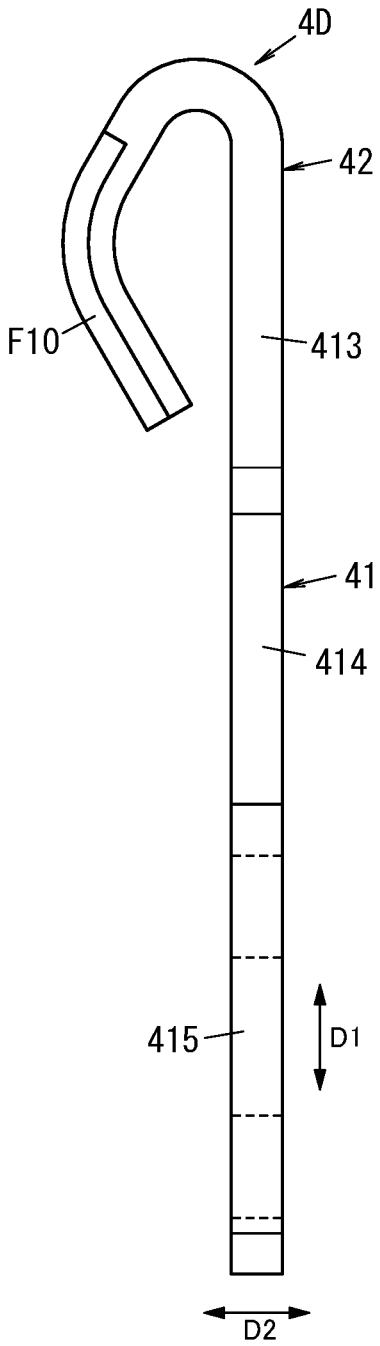
FIG. 36B is a side view of the fixed conductive portion of the electromagnetic relay.

In the fixed conductive portion 4D, the width in the third direction D3 of the end portion 42 including the fixed contact F10 is substantially constant, no matter where in the end portion 42 the width is measured. That is to say, the width of every part but the fixed contact F10 of the end portion 42 is approximately equal to the width W1 of the fixed contact F10. As shown in FIGS. 36A and 36B, the extended portion 41 includes a first part 413, a second part 414, and a third part 415. Each of the first part 413, the second part 414, and the third part 415 has a rectangular plate shape. The first part 413 is a part connected to the end portion 42. The third part 415 is a part connected both electrically and mechanically to the second terminal portion 46 (see FIG. 29) that is electrically connected to the negative electrode of the DC power supply V1 (see FIG. 12). The second part 414 is a part between the first part 413 and the third part 415. In the portion that covers the range from the first part 413 through the second part 414, a taper 416 is provided to broaden the width in the third direction D3. The first part 413, the second part 414, and the third part 415 may be sorted in the descending order by the width in the third direction D3 in the order of the third part 415, the second part 414, and the first part 413.

The maximum width W3 in the third direction D3 of the fixed conductive portion 4D is the width of the third part 415. Also, the third part 415 is arranged between the plurality of wall portions 72 of the case 7D (see FIG. 29) so as not to be exposed to the space SP1 in which the fixed contact F10 and the moving contact M10 are arranged. The maximum width W2 in the third direction D3 of a part, exposed to the space SP1 in which the fixed contact F10 and the moving contact M10 are arranged, of the fixed conductive portion 4D is the width of the second part 414.

Also, the width W1 in the third direction D3 of the fixed contact F10 is equal to or less than the width W4 of the moving contact M10.

In this example, the width W1 of the fixed contact F10 may fall within the range from 0.1 mm to 1.5 mm, the maximum width W2 of the second part 414 may fall within the range from 0.5 mm to 1.7 mm, the maximum width W3 of the third part 415 may be equal to or less than 2.5 mm, and the width W4 of the moving contact M10 may fall within the range from 1.5 mm to 3.0 mm.

As can be seen, the width W1 in the third direction D3 of the fixed contact F10 is smaller than the maximum widths W2, W3 and the width W4. Thus, compared to a situation where the width W1 is equal to or greater than the maximum width W2, W3 or the width W4, the end point P5 of the arc on the fixed contact F10 moves more quickly to reach the end in the third direction D3 of the fixed contact F10. This allows the arc to be stretched more easily.

(Effects of Permanent Magnets on External Environment)

Figure 37:
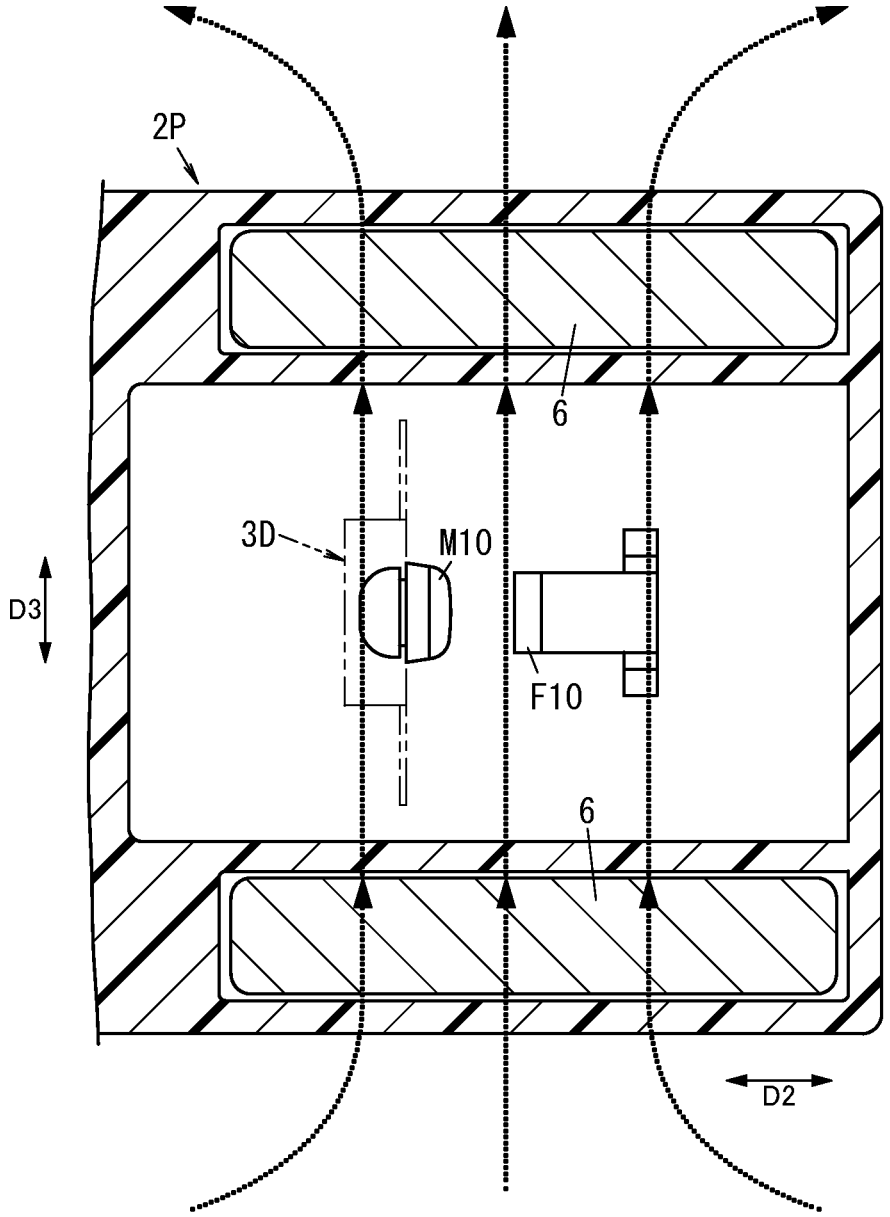
FIG. 37 is a schematic top cross-sectional view of an electromagnetic relay according to a comparative example.

Next, other advantages of the contact device 2D according to the fifth embodiment will be described in comparison with a contact device 2P according to a comparative example FIG. 37 is a cross-sectional view illustrating a principal part of the contact device 2P according to the comparative example. The contact device 2P does not include the first yoke 9, which is a major difference from the contact device 2D according to the fifth embodiment (see FIG. 33). The first yoke 9 of the contact device 2D reduces the effect of the magnetic flux generated by the two permanent magnets 6 on an environment outside of the contact device 2D.

More specifically, in the contact device 2P with no first yoke 9, part of the magnetic flux (as indicated by the dotted lines in FIG. 37) generated by the two permanent magnets 6 leaks out of the contact device 2P in the third direction D3 that is the direction in which the two permanent magnets 6 are arranged side by side. Meanwhile, in the contact device 2D with the first yoke 9, at least part of the magnetic flux (as indicated by the dotted lines in FIG. 33) generated by the two permanent magnets 6 will be aligned with a magnetic circuit formed by the first yoke 9. The magnetic circuit formed by the first yoke 9 is constituted by a path leading from one side portion 91 out of the two side portions 91 of the first yoke 9 through the other side portion 91 via the coupling portion 92. That is to say, making the magnetic flux aligned with the magnetic circuit allows the magnetic flux going out of the contact device 2D to pass through the vicinity of the contact device 2D more easily. This allows the contact device 2D to reduce the effect of the magnetic flux generated by the two permanent magnets 6 on the environment outside of the contact device 2D more significantly than the contact device 2P with no first yoke 9. For example, this reduces the chances of the two permanent magnets 6 magnetizing or attracting a member outside of the contact device 2D. The present inventors confirmed via experiments that the flux density of the magnetic flux leaking out of a middle portion of the permanent magnets 6 was about 60 mT in the contact device 2D and about 200 mT in the contact device 2P. Also, part having the highest flux density on a peripheral surface of the contact device 2D had a flux density of about 90 mT.

(First Variation of Fifth Embodiment)

Next, a first variation of the fifth embodiment will be described with reference to FIG. 38. In the following description, any constituent element of this first variation of the fifth embodiment, having the same function as a counterpart of the fifth embodiment described above, will be designated by the same reference numeral as that counterpart's, and description thereof will be omitted herein.

In the fifth embodiment described above, when the fixed contact F10 and the moving contact M10 are in contact with each other, the first line SL1 passing through the center of the fixed contact F10 and parallel to the one direction S1 agrees with the second line SL2 passing through the center of the moving contact M10 and parallel to the one direction S1 when viewed in the second direction D2 as shown in FIG. 36A.

Figure 38:
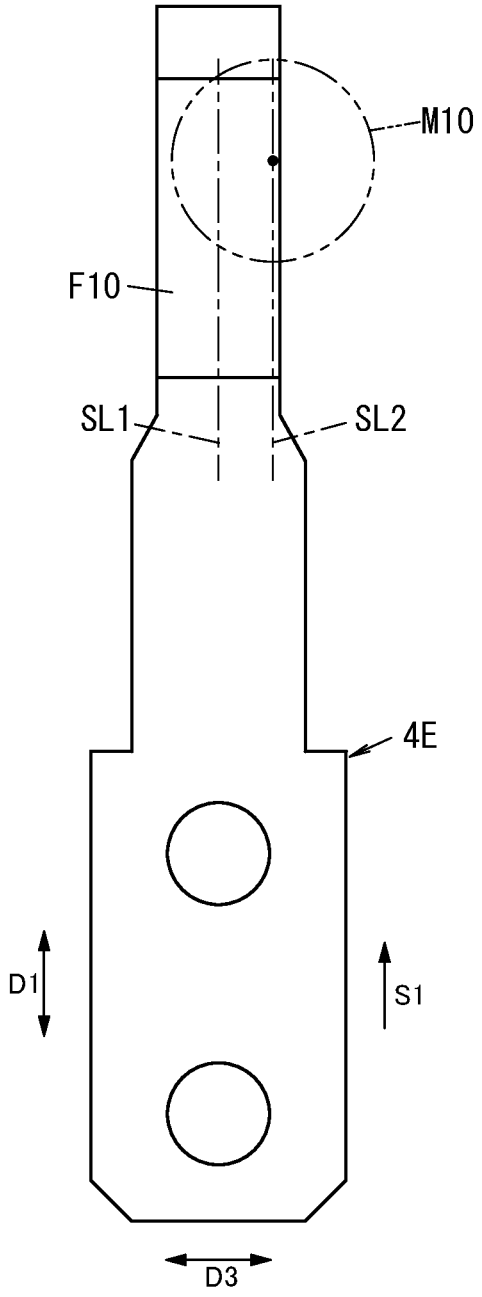
FIG. 38 is a front view of a fixed conductive portion of an electromagnetic relay according to a first variation of the fifth embodiment.

In this first variation, the fixed conductive portion 4E including the fixed contact F10 is arranged to be shifted in the third direction D3 as shown in FIG. 38 compared to the fifth embodiment. More specifically, the fixed conductive portion 4E is arranged to be shifted such that the center of the moving contact M10 comes into contact with part, located near one end in the third direction D3, of the fixed contact F10.

In this first variation, when the fixed contact F10 and the moving contact M10 are in contact with each other, the first line SL1 passing through the center of the fixed contact F10 and parallel to the one direction S1 is located at a different position from the second line SL2 passing through the center of the moving contact M10 and parallel to the one direction S1 when viewed in the second direction D2. That is to say, the first line SL1 does not agree with the second line SL2. Thus, the center of the moving contact M10 comes into contact with a point, shifted in the third direction D3 with respect to the center of the fixed contact F10, of the fixed contact F10.

Therefore, when an arc is generated between the fixed contact F10 and the moving contact M10, the end point of the arc on the fixed contact F10 is highly likely located in the vicinity of the end in the third direction D3 of the fixed contact F10 in the first place. Thus, according to this first variation, the end point of the arc on the fixed contact F10 is likely to more quickly move and reach the end in the third direction D3 of the fixed contact F10, compared to the fifth embodiment. When the end point of the arc on the fixed contact F10 reaches the end in the third direction D3, the arc may be stretched as indicated by the virtual path A2 shown in FIG. 35. That is to say, according to this first variation, the arc may be stretched more quickly and thereby the arc extinction performance may be improved by shortening the time it takes for the end point of the arc to move and reach the end in the third direction D3 of the fixed contact F10.

(Second Variation of Fifth Embodiment)

Figure 39:
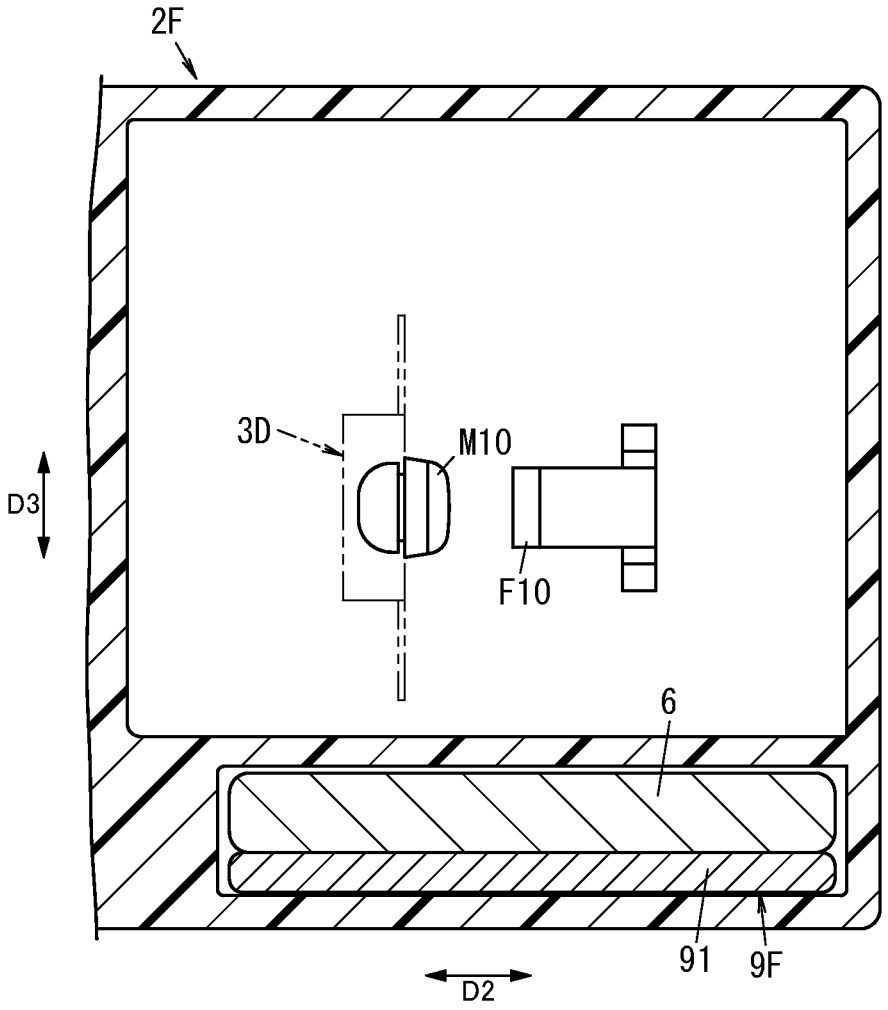
FIG. 39 is a schematic top cross-sectional view of an electromagnetic relay according to a second variation of the fifth embodiment.

Next, a second variation of the fifth embodiment will be described with reference to FIG. 39. In the following description, any constituent element of this second variation of the fifth embodiment, having the same function as a counterpart of the fifth embodiment described above, will be designated by the same reference numeral as that counterpart's, and description thereof will be omitted herein.

A contact device 2F according to this variation includes only one permanent magnet 6, which is a major difference from the contact device 2D according to the fifth embodiment. Also, although the first yoke 9 according to the fifth embodiment includes the two side portions 91 and the coupling portion 92, the first yoke 9 according to this variation includes only one side portion 91.

The permanent magnet 6 is located on one side in the third direction D3 (e.g., under in FIG. 39) of the fixed contact F10. In addition, no permanent magnet 6 is arranged on the other side in the third direction D3 (e.g., over in FIG. 39) of the fixed contact F10.

According to this second variation, the arc may be stretched by applying the Lorentz force produced by the magnetic field of the permanent magnet 6 to the arc. In addition, in this second variation, the first yoke 9 also forms a magnetic circuit, thus reducing the effect of the permanent magnet 6 on an environment outside of the contact device 2F.

Optionally, a plurality of permanent magnets 6 may be arranged on one side in the third direction D3 of the fixed contact F10.

Note that if a single or a plurality of permanent magnets 6 are located on one side in the third direction D3 of the fixed contact F10, the first yoke 9 does not have to have the single side portion 91. Alternatively, the first yoke 9 may also have the two side portions 91 and the coupling portion 92 just like the first yoke 9 according to the fifth embodiment, for example (Third Variation of Fifth Embodiment)

Figure 40:
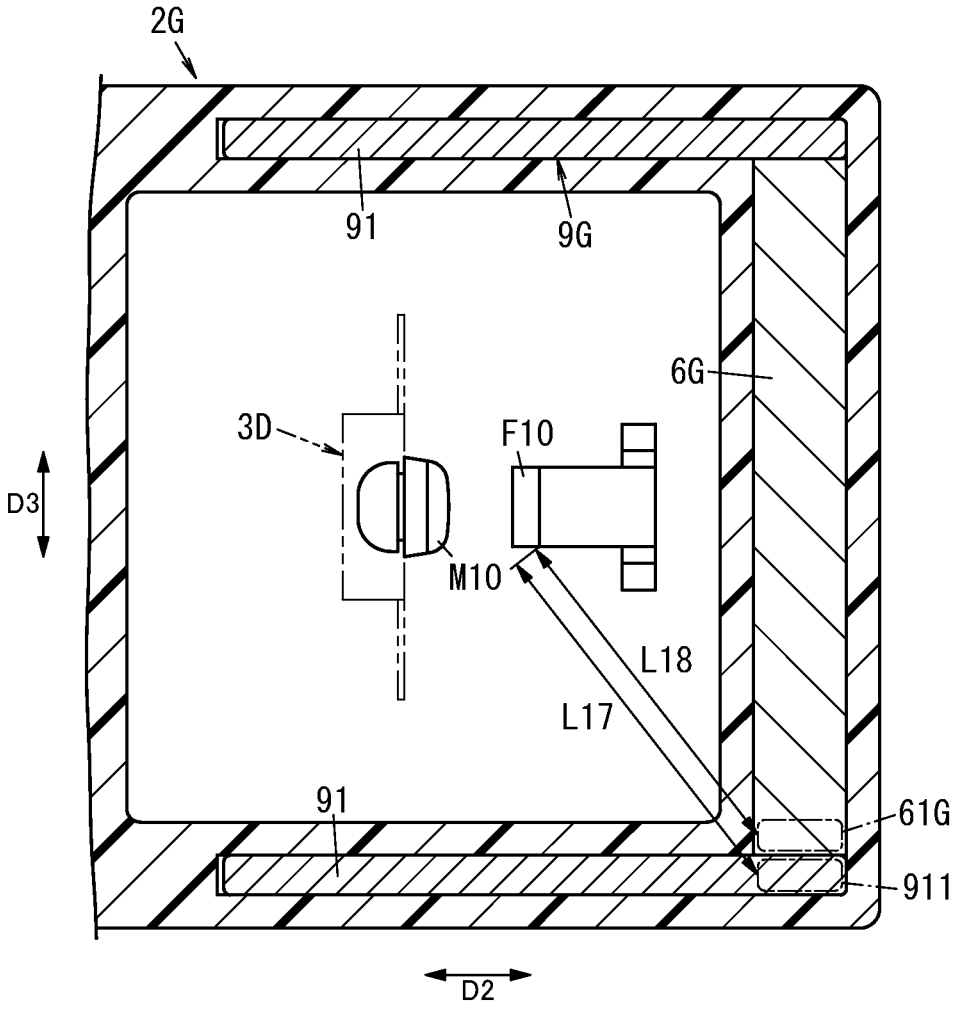
FIG. 40 is a schematic top cross-sectional view of an electromagnetic relay according to a third variation of the fifth embodiment.

Next, a third variation of the fifth embodiment will be described with reference to FIG. 40. In the following description, any constituent element of this third variation of the fifth embodiment, having the same function as a counterpart of the fifth embodiment described above, will be designated by the same reference numeral as that counterpart's, and description thereof will be omitted herein.

The first yoke 9G of the contact device 2G according to this third variation does not include the coupling portion 92, which is a major difference from the first yoke 9 according to the fifth embodiment. In addition, the contact device 2G according to this third variation includes only one permanent magnet 6G, which is a major difference from the contact device 2D according to the fifth embodiment.

The two magnetic poles of the permanent magnet 6G are provided at both longitudinal ends (i.e., the upper and lower ends in FIG. 40) of the permanent magnet 6G One of the two magnetic poles of the permanent magnet 6G faces one of the two side portions 91 of the first yoke 9G, and the other of the two magnetic poles of the permanent magnet 6G faces the other of the two side portions 91 of the first yoke 9G. In the contact device 2G, a path leading from one of the two side portions 91 to the other of the two side portions 91 via the permanent magnet 6G forms a magnetic circuit through which the magnetic flux of the permanent magnet 6G passes. That is to say, the first yoke 9G is arranged on the path of the magnetic flux generated by the permanent magnet 6G.

The distance L17 between a part 911, adjacent to the permanent magnet 6G, of the first yoke 9G and the fixed contact F10 is longer than the distance L18 between a part 61G, adjacent to the first yoke 9G, of the permanent magnet 6G and the fixed contact F10. At least part (i.e., the part 911) of each side portion 91 is located outside of the associated permanent magnet 6G with respect to the fixed contact F10.

The two side portions 91 are magnetized by the magnetic field generated by the permanent magnet 6G Thus, as in the fifth embodiment, a magnetic field aligned with the third direction D3 is generated around the fixed contact F10 and the moving contact M10. This allows the arc to be stretched by applying the Lorentz force, produced by the magnetic field of the permanent magnet 6G, to the arc according to this third variation as well. In addition, according to this third variation, the first yoke 9G also forms a magnetic circuit, and therefore, the effect of the magnetic flux generated by the permanent magnet 6G on the environment outside of the contact device 2G is also reducible.

Optionally, the fifth embodiment may be modified in terms of only the configuration of the first yoke 9 as in this third variation with the arrangement of the two permanent magnets 6 unchanged. That is to say, the fifth embodiment may be modified such that the first yoke 9 has no coupling portion 92 with the arrangement of the two permanent magnets 6 on both sides in the third direction D3 of the fixed contact F10 unchanged.

(Fourth Variation of Fifth Embodiment)

Figure 41:
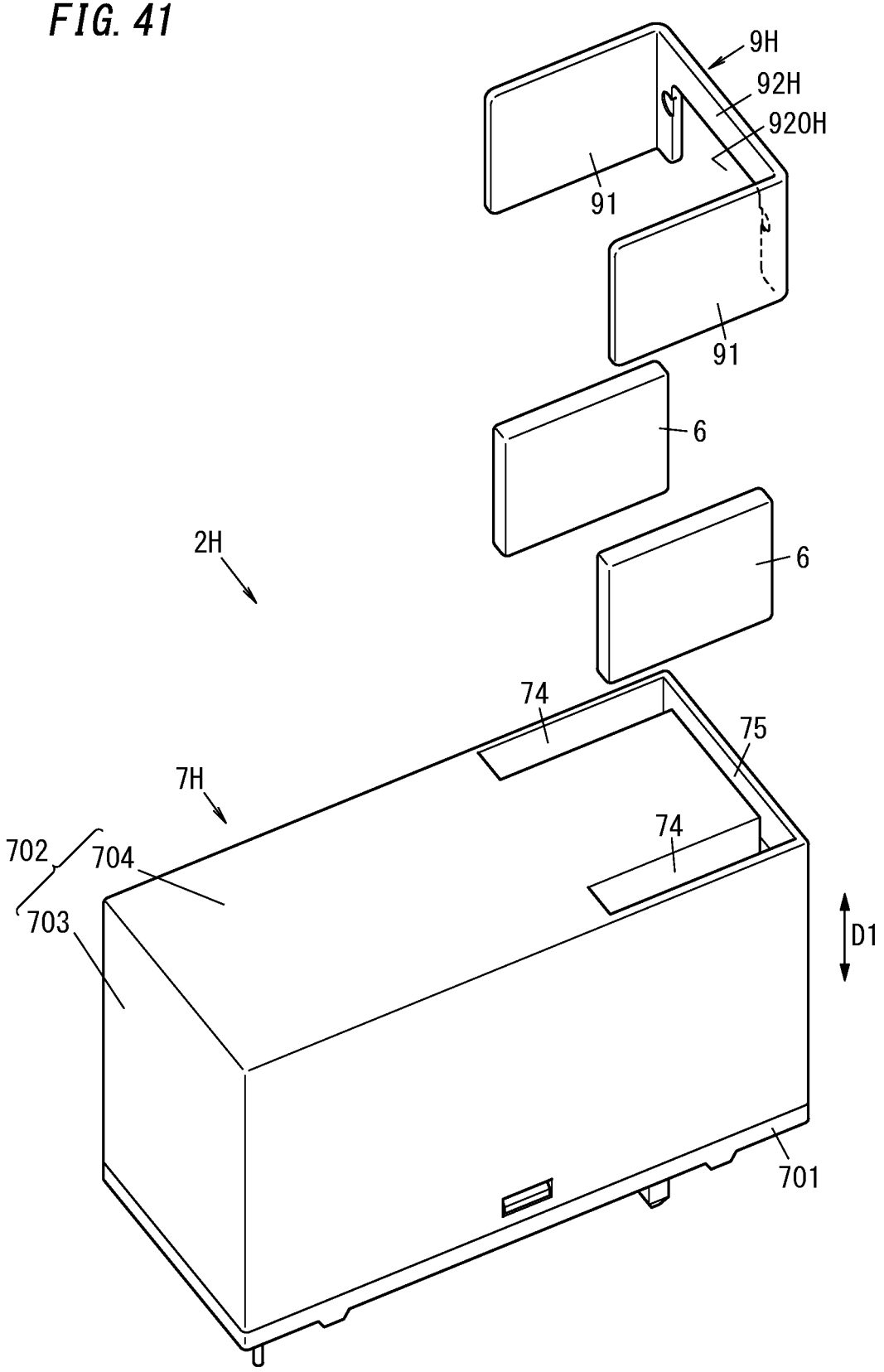
FIG. 41 is a partially exploded perspective view of an electromagnetic relay according to a fourth variation of the fifth embodiment.
Figure 42:
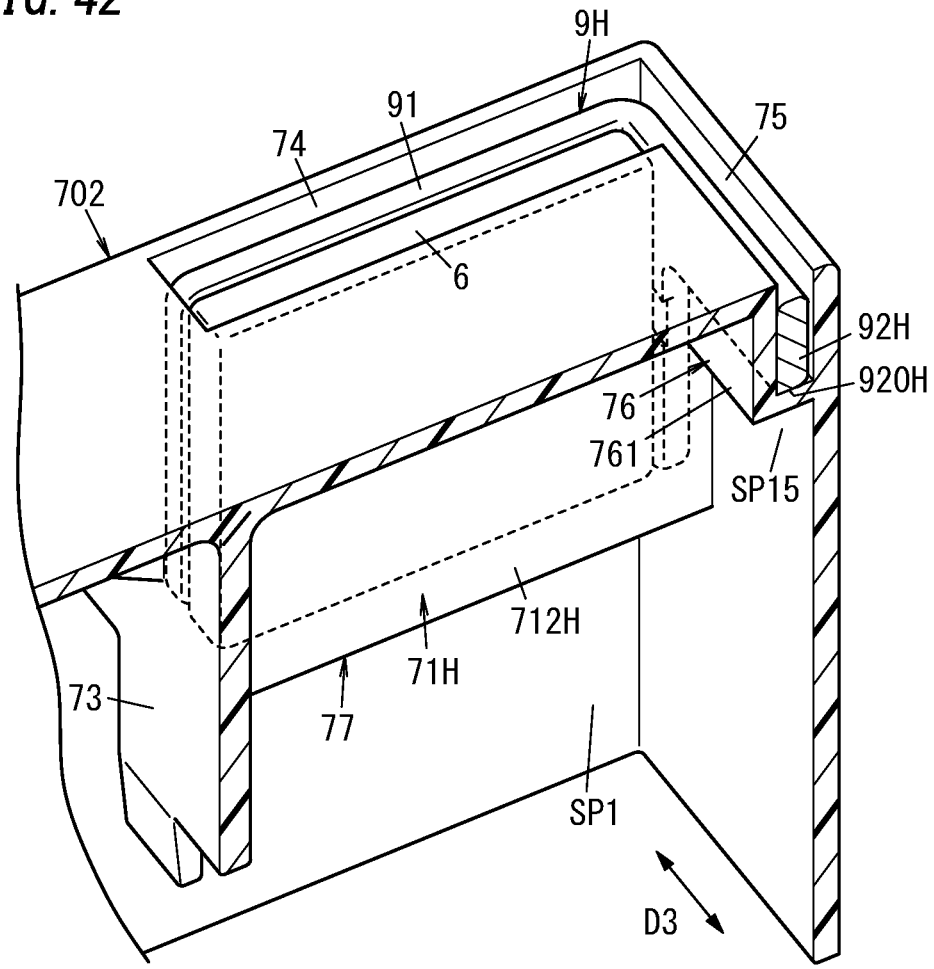
FIG. 42 is a cross-sectional perspective view illustrating a principal portion of the electromagnetic relay.

Next, a fourth variation of the fifth embodiment will be described with reference to FIGS. 41 and 42. In the following description, any constituent element of this fourth variation of the fifth embodiment, having the same function as a counterpart of the fifth embodiment described above, will be designated by the same reference numeral as that counterpart's, and description thereof will be omitted herein.

In a contact device 2H according to this fourth variation, the space housing the first yoke 9H and the two permanent magnets 6 is open to the outside, not inside, of the case 7H, which is a major difference from the contact device 2D according to the fifth embodiment. Specifically, the cap portion 704 of the cover 702 of the case 7H has two first openings 74 and a second opening 75 that couples the two first openings 74 together. The cover 702 is recessed inward in the two first openings 74 and the second opening 75. That is to say, the cover 702 has recesses communicating with the outside in the two first openings 74 and the second opening 75. The recesses of the two first openings 74 are deeper than the recess of the second opening 75.

In addition, in the contact device 2H, the coupling portion 92H of the first yoke 9H has a U-shape, which is another major difference from the contact device 2D according to the fifth embodiment. The coupling portion 92H couples together the two side portions 91 of the first yoke 9H on one side closer to the cover 702 (i.e., upside) in the direction in which the base 701 and the cover 702 are arranged one on top of the other (i.e., in the first direction D1).

The two side portions 91 of the first yoke 9H and the two permanent magnets 6 correspond one to one to the two first openings 74. Through each of the first openings 74, an associated side portion 91 and an associated permanent magnet 6 are passed. At least part of the coupling portion 92H of the first yoke 9H is passed through the second opening 75.

The case 7H includes two first inserting portions 71H. Two side portions 91 and two permanent magnets 6 are provided, and therefore, two first inserting portions 71H are provided accordingly. That is to say, the two first inserting portions 71H are respectively provided on both sides in the third direction D3 of the fixed contact F10 (see FIG. 33). Each of the first inserting portions 71H includes a housing wall 712H provided in the space SP1 inside the case 7H and a part of the cover 702. Each first inserting portion 71H has the shape of a rectangular box, which is open at the first opening 74. Each side portion 91 and each permanent magnet 6 are inserted through the first opening 74 into the associated first inserting portion 71H.

The case 7H further includes a second inserting portion 76. The second inserting portion 76 includes a housing wall 761 provided in the space SP1 inside the case 7H and a part of the cover 702. The second inserting portion 76 has the shape of a rectangular box, which is open at the second opening 75. At least part of the coupling portion 92H of the first yoke 9H is inserted through the second opening 75 into the second inserting portion 76.

The opening 920H of the first yoke 9H is formed in the shape of a cutout. Inside the opening 920H, located are the housing wall 712H that forms part of the first inserting portion 71H and the housing wall 761 that forms part of the second inserting portion 76. In the following description, the space SP15 inside the opening 920H is supposed to be a space not including the region where the housing wall 712H and the housing wall 761 are arranged. That is to say, the space SP15 is located even inside of the housing walls 712H and 761 that are provided inside the opening 920H and is supposed to form part of the space SP1 where the fixed contact F10 and the moving contact M10 are arranged. That is to say, the space SP1 includes a space inside the opening 920H. In this case, the space SP1 is an internal space of the case 7H.

The case 7H has a housing portion 77 including the two first inserting portions 71H and the second inserting portion 76. The housing portion 77 houses the two permanent magnets 6 and the first yoke 9H therein. The housing portion 77 separates the two permanent magnets 6 and the first yoke 9H from the internal space (space SP1) of the case 7H.

(Other Variations of Fifth Embodiment)

Next, other variations of the fifth embodiment will be enumerated one after another. The variations to be described below may be adopted in combination as appropriate. Also, the variations to be described below may also be adopted in combination with the first to third variations as appropriate.

The coupling portion 92 of the first yoke 9 does not have to have a frame shape.

Alternatively, the coupling portion 92 of the first yoke 9 may also have a U-shape in which one end thereof in the first direction D1 is open.

Also, the coupling portion 92 of the first yoke 9 does not have to be arranged as already described for the fifth embodiment. For example, the coupling portion 92 may be arranged on the left (in FIG. 29) of the fixed contact F10. That is to say, the coupling portion 92 may also be arranged such that the moving contact M10 is located between the fixed contact F10 and the coupling portion 92. Alternatively, the coupling portion 92 may also be arranged either over or under (in FIG. 29) the fixed contact F10. That is to say, the coupling portion 92 may be arranged to face the fixed contact F10 in the first direction D1.

The first yoke 9 may be coated with a member with electrical insulation properties. This would enhance electrical insulation between the first yoke 9 and the fixed conductive portion 4D.

Furthermore, a member with electrical insulation properties (such as a plate member) may be arranged between the coupling portion 92 of the first yoke 9 and the fixed conductive portion 4D. This would enhance the electrical insulation between the first yoke 9 and the fixed conductive portion 4D. Alternatively, the first yoke 9 may be embedded in the case body 70.

Optionally, the arrangement of the fixed contact F10 with respect to the first yoke 9 and the arrangement of the moving contact M10 with respect to the first yoke 9 as described for the fifth embodiment may be interchanged with each other. That is to say, the moving contact M10 may be located between the coupling portion 92 and the fixed contact F10. In other words, one of the fixed contact F10 or the moving contact M10 may be located between the other contact and the coupling portion 92.

The arrangement of the permanent magnets 6 does not have to be the one described for the fifth embodiment. For example, the permanent magnets 6 may also be arranged over either the fixed contact F10 or the moving contact M10 in FIG. 29. That is to say, the permanent magnets 6 may also be arranged to face either the fixed contact F10 or the moving contact M10 in the first direction D1.

(Resume)

The following aspects are disclosed from the first to fifth embodiments and their variations described above:

A contact device 2 according to a first aspect includes a first conductive portion (fixed conductive portion 4) and a second conductive portion (moving conductive portion 3). The first conductive portion includes a first end portion (end portion 42) and a first extended portion (extended portion 41). The first end portion includes a first contact (fixed contact F10). The first extended portion is provided to extend in one direction S1 and connected to the first end portion at a tip in the one direction S1 of the first extended portion. The second conductive portion includes a second end portion (end portion 32) and a second extended portion (extended portion 31). The second end portion includes a second contact (moving contact M10). The second extended portion is provided to extend in the one direction S1 and connected to the second end portion at a tip in the one direction S1 of the second extended portion. One contact selected from the group consisting of the first contact and the second contact is a moving contact M10. The other contact selected from the group consisting of the first contact and the second contact is a fixed contact F10. The moving contact M10 moves between a closed position where the moving contact M10 is in contact with the fixed contact F10 and an open position where the moving contact M10 is out of contact with the fixed contact F10. At least the first end portion, out of the first end portion and the second end portion, is curved to be folded back from a tip 420 in the one direction S1 of the first end portion. The first contact is located in a folded-back part of the first end portion and faces the second contact.

According to this configuration, at least the first end portion (end portion 42) is curved to be folded back from the tip 420 in the one direction S1 of the first end portion. This allows an end point P4 of an arc A1 generated between the fixed contact F10 and the moving contact M10 to move more easily along the end portion 42, compared to a situation where the end portion 42 is flat. For example, in the end portion 42, the end point P4 of the arc A1 easily moves toward a surface 411, opposite from an end portion 32, of the end portion 42. This allows the contact device 2 to exhibit improved arc extinction performance with respect to the arc A1 generated.

In a contact device 2 according to a second aspect, which may be implemented in conjunction with the first aspect, the first conductive portion (fixed conductive portion 4) includes a base member 40. The base member 40 covers a part of the first end portion (end portion 42). The first contact (fixed contact F10) is crimped to the base member 40.

According to this configuration, in the first end portion (end portion 42), the first contact (fixed contact F10) is crimped to the base member 40. This narrows the gap between the first contact and the base member 40, compared to, for example, a situation where the first contact is caulked to the base member 40, thus allowing the end point P4 of the arc A1 to move more smoothly between the first contact and the base member 40.

In a contact device 2 according to a third aspect, which may be implemented in conjunction with the first or second aspect, the first conductive portion (fixed conductive portion 4) includes a base member 40. The base member 40 covers a part of the first end portion (end portion 42). The first contact (fixed contact F10) is fixed to the base member 40. A surface 401 of the base member 40 is flush with a surface (first surface F11) of the first contact (fixed contact F10). The first surface F11 of the first contact faces the second contact (moving contact M10).

According to this configuration, the surface 401 of the base member 40 is flush with the surface (first surface F11) of the first contact (fixed contact F10). This allows the end point P4 of the arc A1 to move more smoothly between the base member 40 and the first contact, compared to a situation where there is a level difference between the surface 401 of the base member 40 and the first contact.

In a contact device 2 according to a fourth aspect, which may be implemented in conjunction with the third aspect, the first end portion (end portion 42) has a surface (first surface F11) curved to extend from the tip 420 in the one direction S1 of the first end portion toward the second end portion (end portion 32).

This configuration allows the end point P4 of the arc A1 generated between the fixed contact F10 and the moving contact M10 to move even more smoothly in the first end portion (end portion 42).

A contact device 2 according to a fifth aspect, which may be implemented in conjunction with any one of the first to fourth aspects, further includes at least one permanent magnet 6. The at least one permanent magnet 6 faces at least one of the first contact (fixed contact F10) or the second contact (moving contact M10) in a predetermined direction (third direction D3).

According to this configuration, the permanent magnet 6 generates a magnetic flux so that Lorentz force is applied to the arc A1 generated between the fixed contact F10 and the moving contact M10, thus stretching the arc A1 easily.

In a contact device 2 according to a sixth aspect, which may be implemented in conjunction with the fifth aspect, the predetermined direction (third direction D3) is perpendicular to not only the one direction S1 but also a direction (second direction D2) in which the first contact (fixed contact F10) and the second contact (moving contact M10) face each other.

According to this configuration, the permanent magnet 6 generates a magnetic flux so that Lorentz force is applied to the arc A1 generated between the fixed contact F10 and the moving contact M10, thus stretching the arc A1 easily. In addition, the arc A1 is stretched easily in a space that covers parts, located opposite from the facing surface, of respective end portions of the first conductive portion (fixed conductive portion 4) and the second conductive portion (moving conductive portion 3).

In a contact device 2 according to a seventh aspect, which may be implemented in conjunction with the fifth aspect, the at least one permanent magnet 6 includes two permanent magnets 6. At least one of the first contact (fixed contact F10) or the second contact (moving contact M10) is located between the two permanent magnets 6. The second conductive portion (moving conductive portion 3) includes a base portion 321. The second contact is fixed to the base portion 321. The predetermined direction (third direction D3) is perpendicular to not only a direction (second direction D2) in which the first contact and the second contact face each other but also a longitudinal axis (first direction D1) of the base portion 321.

This configuration allows the arc A1 to be stretched along the longitudinal axis of the base portion 321 (i.e., in the first direction D1).

In a contact device 2 according to an eighth aspect, which may be implemented in conjunction with any one of the fifth to seventh aspects, the permanent magnet 6 is arranged such that Lorentz force is applied in a direction (first direction D1) aligned with the one direction S1 to a current flowing, between the first contact (fixed contact F10) and the second contact (moving contact M10), in a direction (second direction D2) in which the first contact and the second contact face each other.

According to this configuration, the permanent magnet 6 generates a magnetic flux, thus further facilitating the stretch of the arc A1 generated between the fixed contact F10 and the moving contact M10. That is to say, the arc A1 is stretched efficiently in a space covering parts, located in the one direction S1, of the first end portion (end portion 42) and the second end portion (end portion 32) and in a space covering parts, located opposite from the respective facing surfaces, of the first end portion and the second end portion.

In a contact device 2C according to a ninth aspect, which may be implemented in conjunction with the fifth aspect, the permanent magnet 6C faces, in the predetermined direction (first direction D1), at least one of the first contact (fixed contact F50) or the second contact (moving contact M50). The predetermined direction is aligned with the one direction S1.

According to this configuration, the permanent magnet 6C generates a magnetic flux so that Lorentz force is applied to the arc A1 generated between the fixed contact F50 and the moving contact M50, thus stretching the arc A1 easily.

In a contact device 2C according to a tenth aspect, which may be implemented in conjunction with the fifth or ninth aspect, the permanent magnet 6C faces, in the predetermined direction (first direction D1), at least one of the first contact (fixed contact F50) or the second contact (moving contact M50). The second conductive portion (moving conductive portion 300) includes a base portion 30A. The second contact is fixed to the base portion 30A. A longitudinal axis of the base portion 30A is aligned with the predetermined direction.

According to this configuration, the permanent magnet 6C generates a magnetic flux so that Lorentz force is applied to the arc A1 generated between the fixed contact F50 and the moving contact M50, thus stretching the arc A1 easily.

In a contact device 2 according to an eleventh aspect, which may be implemented in conjunction with any one of the fifth to eleventh aspects, the permanent magnet 6 faces the first end portion (end portion 42) and the second end portion (end portion 32) in the predetermined direction (third direction D3).

According to this configuration, the permanent magnet 6 generates a magnetic flux, thus further facilitating the stretch of the arc A1 generated between the fixed contact F10 and the moving contact M10. This improves the arc extinction performance with respect to the arc A1.

A contact device 2 according to a twelfth aspect, which may be implemented in conjunction with any one of the first to eleventh aspects, further includes a case 7. In the case 7, the first conductive portion (fixed conductive portion 4) and the second conductive portion (moving conductive portion 3) are housed. An internal space of the case 7 includes a space SP11 and at least one of a space SP12 or a space SP13. The space SP11 is located in the one direction S1 with respect to the first end portion (end portion 42) and the second end portion (end portion 32). In a direction (second direction D2) in which the first contact (fixed contact F10) and the second contact (moving contact M10) face each other, the space SP12 is located opposite from the second contact when viewed from the first contact. In the direction in which the first contact and the second contact face each other, the space SP13 is located opposite from the first contact when viewed from the second contact.

This configuration allows the arc A1 generated between the fixed contact F10 and the moving contact M10 to be stretched toward the space SP11 and the space SP12 or the space SP13.

In a contact device 2 according to a thirteenth aspect, which may be implemented in conjunction with any one of the first to twelfth aspects, the first conductive portion (fixed conductive portion 4) is electrically connected to a negative electrode of a DC power supply V1, and the second conductive portion (moving conductive portion 3) is electrically connected to a positive electrode of the DC power supply V1.

Of the first end portion (end portion 42) and the second end portion (end portion 32), the end portion 42 electrically connected to the negative electrode of the DC power supply V1 emits electrons when the arc A1 is generated. According to the configuration described above, the end portion 42 electrically connected to the negative electrode of the DC power supply V1 is curved to be folded back from the tip 420 in the one direction S1 of the end portion 42. This allows the end point P4 of the arc A1 (electron emission point) to move more smoothly compared to a situation where the end portion 42 electrically connected to the negative electrode of the DC power supply V1 is flat.

In a contact device 2 according to a fourteenth aspect, which may be implemented in conjunction with any one of the first to thirteenth aspects, the second conductive portion (moving conductive portion 3) includes a base portion 321. The base portion 321 covers a part of the second end portion (end portion 32). The second contact (moving contact M10) is caulked to the base portion 321.

This configuration allows the second contact (moving contact M10) to be attached to the base portion 321 easily.

In a contact device 2 according to a fifteenth aspect, which may be implemented in conjunction with any one of the first to fourteenth aspects, a gap distance L1 between the first contact (fixed contact F10) and the second contact (moving contact M10) falls within a range from 0.6 mm to 1.1 mm.

This configuration allows the arc A1 to be stretched more easily than when a shorter gap distance L1 is provided there.

In a contact device 2 according to a sixteenth aspect, which may be implemented in conjunction with any one of the first to fifteenth aspects, when viewed in a direction (second direction D2) in which the first contact (fixed contact F10) and the second contact (moving contact M10) face each other, the second contact has a curved outer peripheral edge.

This configuration allows heat to be transferred easily through the second contact (moving contact M10), thus facilitating movement of the end point P3 of the arc A1.

A contact device 2 according to a seventeenth aspect, which may be implemented in conjunction with any one of the first to sixteenth aspects, further includes a case 7. The case 7 includes a case body 70 and an inserting portion 71. In the case body 70, the first conductive portion (fixed conductive portion 4) and the second conductive portion (moving conductive portion 3) are housed. The inserting portion 71 is provided inside the case body 70. A permanent magnet 6 is inserted into the inserting portion 71.

According to this configuration, the permanent magnet 6 is inserted into the inserting portion 71 inside the case body 70. This facilitates insulating the permanent magnet 6 from the environment outside of the case body 70, compared to a situation where the permanent magnet 6 is arranged outside of the case body 70.

An electromagnetic relay 1 according to an eighteenth aspect includes the contact device 2 according to any one of the first to seventeenth aspects and a driving unit 5. The driving unit 5 includes a coil 51 and an armature 52. The armature 52 is displaced according to a variation in energization state of the coil 51 to drive a conductive portion having the moving contact M10, which is either the first conductive portion (fixed conductive portion 4) or the second conductive portion (moving conductive portion 3), and thereby move the moving contact M10 between the closed position and the open position.

This configuration allows the contact device 2 to more easily move the end point P4 of the arc A1 generated between the fixed contact F10 and the moving contact M10, compared to a situation where the end portion 42 is flat. This improves the arc extinction performance.

In an electromagnetic relay 1 according to a nineteenth aspect, which may be implemented in conjunction with the eighteenth aspect, the driving unit 5 further includes a card 53. As the armature 52 is displaced, the card 53 is also displaced to drive a conductive portion having the moving contact M10 (the moving conductive portion 3), which is either the first conductive portion (fixed conductive portion 4) or the second conductive portion (moving conductive portion 3), and thereby move the moving contact M10 between the closed position and the open position. The card 53 has electrical insulation properties. The card 53 is arranged between the armature 52 and the conductive portion having the moving contact M10 (moving conductive portion 3) which is either the first conductive portion (fixed conductive portion 4) or the second conductive portion (moving conductive portion 3).

According to this configuration, the card 53 has electrical insulation properties, and is arranged between the conductive portion having the moving contact M10 (moving conductive portion 3) and the armature 52. This allows the card 53 to enhance the insulation properties between the conductive portion having the moving contact M10 and the armature 52.

In an electromagnetic relay 1 according to a twentieth aspect, which may be implemented in conjunction with the nineteenth aspect, the conductive portion having the moving contact M10 (moving conductive portion 3), which is either the first conductive portion (fixed conductive portion 4) or the second conductive portion (moving conductive portion 3), further includes a facing portion 34. The facing portion 34 is located opposite from the fixed contact F10 when viewed from a surface M11, facing the fixed contact F10, of the moving contact M10. The facing portion 34 faces the card 53.

This configuration allows the facing portion 34 to protect the card 53 from the arc A1 generated between the fixed contact F10 and the moving contact M10.

In an electromagnetic relay 1 according to a twenty-first aspect, which may be implemented in conjunction with any one of the eighteenth to twentieth aspects, the contact device 2 further includes a case 7. In the case 7, the first conductive portion (fixed conductive portion 4), the second conductive portion (moving conductive portion 3), and the driving unit 5 are housed. The case 7 has an inner wall 73. The inner wall 73 is provided between the conductive portion having the moving contact M10 (moving conductive portion 3), which is either the first conductive portion (fixed conductive portion 4) or the second conductive portion (moving conductive portion 3), and the armature 52. The inner wall 73 separates a space SP1 and a space SP2 from each other. In the space SP1, the fixed contact F10 and the moving contact M10 are arranged. In the space SP2, the armature 52 is arranged.

This configuration allows the inner wall 73 to protect the armature 52 from the arc A1 generated between the fixed contact F10 and the moving contact M10.

A contact device 2D (or 2F, 2G, or 2H) according to a twenty-second aspect, which may be implemented in conjunction with the first aspect, includes a first conductive portion (fixed conductive portion 4D or 4E) and a second conductive portion (moving conductive portion 3D). The conductive portion includes a first end portion (end portion 42) and a first extended portion (extended portion 41). The first end portion includes a first contact (fixed contact F10). The first extended portion has length in the one direction S1. The first extended portion is connected to the first end portion at a tip in the one direction S1 of the first extended portion. The second extended portion includes a second end portion (end portion 32) and a second extended portion (extended portion 31). The second end portion includes a second contact (moving contact M10). The second extended portion has length in the one direction S1. The second extended portion is connected to the second end portion at a tip in the one direction S1 of the second extended portion. One contact selected from the group consisting of the first contact and the second contact is a moving contact M10. The other contact selected from the group consisting of the first contact and the second contact is a fixed contact F10. The moving contact M10 moves between a closed position where the moving contact M10 is in contact with the fixed contact F10 and an open position where the moving contact M10 is out of contact with the fixed contact F10. The first end portion has an intermediate portion 421 and a curved portion 422. The intermediate portion 421 is connected to the first extended portion. The curved portion 422 having a curved shape. The curved portion 422 is extended in a direction opposite from the one direction S1 from a tip 420 in the one direction S1 of the intermediate portion 421. The first contact is present in the curved portion 422 and faces the second contact.

According to this configuration, the curved portion 422 of the first end portion (end portion 42) has a curved shape, thus facilitating the movement of the end point of the arc generated between the fixed contact F10 and the moving contact M10, compared to a situation where the end portion 42 is flat. For example, in the end portion 42, the end point of the arc moves easily toward a surface 411, opposite from the end portion 32, of the end portion 42. This allows the contact device 2D (or 2F, 2G, or 2H) to exhibit improved arc extinction performance with respect to the arc generated in the contact device 2D (or 2F, 2G, or 2H).

A contact device 2D (or 2F, 2G, or 2H) according to a twenty-third aspect, which may be implemented in conjunction with the twenty-second aspect, further includes a permanent magnet 6 (or 6G) and a yoke (first yoke 9, 9F, 9G, or 9H). The yoke is arranged adjacent to the permanent magnet 6 (or 6G). A distance L15 (or L17) between a part, adjacent to the permanent magnet 6 (or 6G), of the yoke and the fixed contact F10 is longer than a distance L16 (or L18) between a part, adjacent to the yoke, of the permanent magnet 6 (or 6G) and the fixed contact F10.

According to this configuration, at least part of the magnetic flux generated by the permanent magnet 6 (or 6G) passes through the yoke (first yoke 9, 9F, 9G, or n9H). This reduces the chances of the magnetic flux generated by the permanent magnet 6 (or 6G) leaking out of the contact device 2D (or 2F, 2G, or 2H).

In a contact device 2D (or 2H) according to a twenty-fourth aspect, which may be implemented in conjunction with the twenty-third aspect, the yoke (first yoke 9 or 9H) includes two side portions 91 and a coupling portion 92 (or 92H). The two side portions 91 are located, in a predetermined direction (third direction D3), on both sides of the fixed contact F10. The predetermined direction is perpendicular to both the one direction S1 and a direction (second direction D2) in which the fixed contact F10 and the moving contact M10 face each other. The coupling portion 92 (or 92H) couples the two side portions 91 together.

According to this configuration, at least part of the magnetic flux generated by the permanent magnet 6 passes through a magnetic circuit formed by the two side portions 91 and coupling portion 92 (or 92H) of the yoke (first yoke 9). This further reduces the chances of the magnetic flux generated by the permanent magnet 6 leaking out of the contact device 2D (or 2H).

A contact device 2D (or 2H) according to a twenty-fifth aspect, which may be implemented in conjunction with the twenty-fourth aspect, includes a case 7D (or 7H). The case 7D (or 7H) has an internal space (space SP1) in which the fixed contact F10 and the moving contact M10 are arranged. The coupling portion 92 (or 92H) has an opening 920 (or 920H). The internal space (space SP1) includes a space SP14 (or SP15) inside the opening 920 (or 920H).

This configuration allows the space inside the opening 920 (or 920H) to be used as a part of a space for stretching the arc.

In a contact device 2H according to a twenty-sixth aspect, which may be implemented in conjunction with the twenty-fifth aspect, the case 7H includes a housing portion 77. In the housing portion 77, the permanent magnet 6 and the yoke (first yoke 9H) are housed. The housing portion 77 separates the permanent magnet 6 and the yoke from the internal space (space SP1) of the case 7H.

This configuration contributes to enhancing electrical insulation between the yoke (first yoke 9H) and the fixed contact F10 and between the yoke (first yoke 9H) and the moving contact M10.

In a contact device 2D (or 2H) according to a twenty-seventh aspect, which may be implemented in conjunction with any one of the twenty-fourth to twenty-sixth aspects, one contact selected from the group consisting of the fixed contact F10 and the moving contact M10 is located between the other contact and the coupling portion 92 (or 92H).

This configuration reduces the chances of the stretch of the arc in the one direction S1 being interfered with by the yoke, compared to a situation where the yoke (first yoke 9 or 9H) is arranged to face, in the one direction S1, the fixed contact F10 and the moving contact M10.

In a contact device 2D (or 2F, 2G or 2H) according to a twenty-eighth aspect, which may be implemented in conjunction with the twenty-seventh aspect, the fixed contact F10 is located between the coupling portion 92 (or 92H) and the moving contact M10.

This configuration reduces the chances of the movement of the moving contact M10 being interfered with by the yoke, compared to a situation where the moving contact M10 is located between the fixed contact F10 and the yoke (first yoke 9 or 9H).

In a contact device 2F according to a twenty-ninth aspect, which may be implemented in conjunction with any one of the twenty-third to twenty-eighth aspects, the permanent magnet 6 is located on one side in a predetermined direction (third direction D3) of the fixed contact F10. The predetermined direction is perpendicular to both the one direction S1 and a direction (second direction D2) in which the fixed contact F10 and the moving contact M10 face each other.

This configuration facilitates ensuring a space to stretch the arc, compared to a situation where the permanent magnets 6 are provided on both sides in the predetermined direction (third direction D3) of the fixed contact F10.

In a contact device 2D according to a thirtieth aspect, which may be implemented in conjunction with any one of the twenty-third to twenty-ninth aspects, the yoke (first yoke 9) is exposed at least partially to a space SP1 in which the fixed contact F10 and the moving contact M10 are arranged.

This configuration makes it easy to use the space SP1 to stretch the arc, compared to, for example, a situation where a member to coat the yoke (first yoke 9) is provided in the space SP1 in which the fixed contact F10 and the moving contact M10 are arranged.

In a contact device 2D (or 2F, 2G or 2H) according to a thirty-first aspect, which may be implemented in conjunction with any one of the twenty-second to thirtieth aspects, when measured in a predetermined direction (third direction D3), a width W1 of the first contact (fixed contact F10) is smaller than a maximum width W3 of the first conductive portion (fixed conductive portion 4D or 4E). The predetermined direction is perpendicular to both the one direction S1 and a direction (second direction D2) in which the fixed contact F10 and the moving contact M10 face each other.

This configuration increases the chances of the arc generated between the first contact (fixed contact F10) and the second contact (moving contact M10) being stretched while passing by along the width of the first contact (i.e., near the fixed contact F10 in the third direction D3), compared to a situation where the first contact has a greater width W1.

In a contact device 2D (or 2F, 2G or 2H) according to a thirty-second aspect, which may be implemented in conjunction with the thirty-first aspect, when measured in the predetermined direction (third direction D3), the width W1 of the first contact (fixed contact F10) is smaller than a maximum width W2 of a part, exposed to a space SP1 in which the fixed contact F10 and the moving contact M10 are arranged, of the first conductive portion (fixed conductive portion 4D or 4E).

This configuration increases the chances of the arc generated between the first contact (fixed contact F10) and the second contact (moving contact M10) being stretched while passing by along the width of the first contact (i.e., near the first contact in the third direction D3), compared to a situation where the first contact has a greater width W1.

In a contact device 2D (or 2F, 2G or 2H) according to a thirty-third aspect, which may be implemented in conjunction with any one of the twenty-second to thirty-second aspects, when measured in a predetermined direction (third direction D3), a width W1 of the first contact (fixed contact F10) is equal to or less than a width W4 of the second contact (moving contact M10). The predetermined direction is perpendicular to both the one direction S1 and a direction (second direction D2) in which the fixed contact F10 and the moving contact M10 face each other.

This configuration increases the chances of the arc generated between the first contact (fixed contact F10) and the second contact (moving contact M10) being stretched while passing by along the width of the first contact (i.e., near the first contact in the third direction D3), compared to a situation where the first contact has a greater width W1.

In a contact device 2D (or 2F, 2G or 2H) according to a thirty-fourth aspect, which may be implemented in conjunction with any one of the twenty-second to thirty-third aspects, when the first contact (fixed contact F10) and the second contact (moving contact M10) are in contact with each other, a first line SL1 is located at a different position from a second line SL2 as viewed from a direction (second direction D2) in which the fixed contact F10 and the moving contact M10 face each other. The first line SL1 passes through a center of the first contact and is parallel to the one direction S1. The second line SL2 passes through a center of the second contact and is parallel to the one direction S1

This configuration increases the chances of the arc generated between the first contact (fixed contact F10) and the second contact (moving contact M10) being stretched while passing by the first contact (i.e., near the first contact in the third direction D3), compared to a situation where the first line SL1 and the second line SL2 are aligned with each other.

In a contact device 2D (or 2F, 2G or 2H) according to a thirty-fifth aspect, which may be implemented in conjunction with any one of the twenty-second to thirty-fourth aspects, part of the first end portion (end portion 42) is curved such that as a distance to a tip portion 423, in a direction opposite from the one direction S1, of the first end portion (end portion 42) decreases, a distance from the second contact (moving contact M10) to the part of the first end portion (end portion 42) increases.

This configuration allows the arc generated between the first contact (fixed contact F10) and the second contact (moving contact M10) to be stretched when an end point of the arc on the first contact moves in the opposite direction from the one direction S1.

Note that the constituent elements other than the ones according to the first aspect are not essential constituent elements for the contact device 2 (or 2B, 2C, 2D, 2F, 2G, or 2H) but may be omitted as appropriate.

An electromagnetic relay 1D according to a thirty-sixth aspect includes: the contact device 2D (or 2F, 2G, or 2H) according to any one of the twenty-second to thirty-fifth aspects; and a driving unit 5. The driving unit 5 includes a coil 51 and an armature 52. The armature 52 is displaced according to a variation in energization state of the coil 51 to drive a conductive portion having the moving contact M10 (moving conductive portion 3D), which is either the first conductive portion (fixed conductive portion 4D or 4E) or the second conductive portion (moving conductive portion 3D), and thereby move the moving contact M10 between the closed position and the open position.

This configuration allows an end point of an arc generated between the fixed contact F10 and the moving contact M10 to move more easily along the first end portion (end portion 42) in the contact device 2D (or 2F, 2G, or 2H), compared to a situation where the end portion 42 is flat. This allows the electromagnetic relay to exhibit improved arc extinction performance.

The configuration according to the twenty-third to thirtieth aspects for the first yoke 9 does not have to be based on, but is applicable even without, the configuration according to the first and twenty-second aspects. For example, the configuration according to the twenty-third to thirtieth aspects is applicable independently of the configuration for the shape of the fixed conductive portion 4D or 4E. More specifically, the configuration according to the twenty-third to thirtieth aspects is applicable to a contact device having a structure in which the end portion 42 of the fixed conductive portion 4D or 4E is not curved. That is to say, the configuration according to the twenty-third to thirtieth aspects is applicable to a known contact device.

Specifically, a contact device 2D (or 2F, 2G, or 2H) according to a thirty-seventh aspect includes a fixed contact F10 (first contact) and a moving contact M10 (second contact). The moving contact M10 moves between a closed position where the moving contact M10 is in contact with the fixed contact F10 and an open position where the moving contact M10 is out of contact with the fixed contact. The contact device 2D (or 2F, 2G, or 2H) further includes a permanent magnet 6 (or 6G) and a yoke (first yoke 9, 9F, 9G or 9H). The yoke is arranged adjacent to the permanent magnet 6 (or 6G). A distance L15 (or L17) between a part, adjacent to the permanent magnet 6 (or 6G), of the yoke and the fixed contact F10 is longer than a distance L16 (or L18) between a part, adjacent to the yoke, of the permanent magnet 6 (or 6G) and the fixed contact F10.

According to this configuration, at least part of the magnetic flux generated by the permanent magnet 6 (or 6G) passes through the yoke (first yoke 9, 9F, 9G or 9H). Therefore, this reduces the chances of the magnetic flux generated by the permanent magnet 6 (or 6G) leaking out of the contact device 2D (or 2F, 2G, or 2H).

The configuration according to the thirty-seventh aspect is implementable in combination with the configuration according to the twenty-fourth to thirtieth aspects.

The configuration according to the twenty-second to thirty-seventh aspects does not have to be based on, but is applicable even without, the configuration according to the first aspect. Specifically, a contact device 2D (or 2F, 2G, or 2H) according to another aspect includes a first conductive portion (fixed conductive portion 4D or 4H) and a second conductive portion (moving conductive portion 3D). The first conductive portion includes a first end portion (end portion 42) and a first extended portion (extended portion 41). The first end portion includes a first contact (fixed contact F10). The first extended portion has length in the one direction S1. The first extended portion is connected to the first end portion at a tip in the one direction S1 of the first extended portion. The second conductive portion includes a second end portion (end portion 32) and a second extended portion (extended portion 31). The second end portion includes a second contact (moving contact M10). The second extended portion has length in the one direction S1. The second extended portion is connected to the second end portion at a tip in the one direction S1 of the second extended portion. One contact selected from the group consisting of the first contact and the second contact is a moving contact M10. The other contact selected from the group consisting of the first contact and the second contact is a fixed contact F10. The moving contact M10 moves between a closed position where the moving contact M10 is in contact with the fixed contact F10 and an open position where the moving contact M10 is out of contact with the fixed contact F10. The first end portion includes an intermediate portion 421 and a curved portion 422. The intermediate portion 421 is connected to the first extended portion. The curved portion 422 has a curved shape. The curved portion 422 extends in a direction opposite from the one direction S1 from the tip 420 in the one direction S1 of the intermediate portion 421. The first contact is present in the curved portion 422 and faces the second contact.

According to this configuration, the curved portion 422 of the first end portion (end portion 42) is curved. This allows an end point of an arc generated between the fixed contact F10 and the moving contact M10 to move more easily, compared to a situation where the end portion 42 is flat. For example, in the end portion 42, the end point of the arc easily moves toward a surface 411, opposite from an end portion 32, of the end portion 42. This allows the contact device 2D (or 2F, 2G, or 2H) to exhibit improved arc extinction performance with respect to the arc generated.

Optionally, the configuration according to the twenty-second to thirty-seventh aspects is implementable as appropriate in combination with the configuration according to the second to twenty-first aspects.

The embodiments described above, as well as variations thereof, are implementable in combination as appropriate.

REFERENCE SIGNS LIST

1, 1D Electromagnetic Relay
2, 2B, 2C, 2D, 2F, 2G, 2H Contact Device
3, 3D Moving Conductive Portion (Second Conductive Portion)
31 Extended Portion (Second Extended Portion)
32 End Portion (Second End Portion)
321 Base Portion
34, 34D Facing Portion
4, 4D, 4E Fixed Conductive Portion (First Conductive Portion)
40 Base Member
401 Surface
41 Extended Portion (First Extended Portion)
42 End Portion (First End Portion)
420 Tip
421 Intermediate Portion
422 Curved Portion
423 Tip Portion
Driving Unit
51 Coil
52 Armature
53 Card
6, 6C, 6G Permanent Magnet

7, 7D, 7H Case
70 Case Body
71 Inserting Portion
73 Inner Wall
77 Housing Portion
9, 9F, 9G, 9H First Yoke (Yoke)
91 Side Portion
92, 92H Coupling Portion
920, 920H Opening
D1 First Direction (Direction, Predetermined Direction)
D2 Second Direction (Direction)
D3 Third Direction (Predetermined Direction)
F10 Fixed Contact (First Contact)
F11 First Surface (Surface)
L1 Distance
L15-L18 Distance
M10 Moving Contact (Second Contact)
M11 Surface
S1 One Direction
SL1 First Line
SL2 Second Line
SP1, SP2, SP11, SP12, SP13 Space (Internal Space)
SP14, SP15 Space
V1 DC Power Supply
W1 Width
W2 Maximum Width
W3 Maximum Width
W4 Width

The invention claimed is:

1. A contact device comprising a first conductive portion including a first end portion and a first extended portion, the first end portion including a first contact, the first extended portion being provided to extend in one direction and connected to the first end portion at a tip in the one direction of the first extended portion, and a second conductive portion including a second end portion and a second extended portion, the second end portion including a second contact, the second extended portion being provided to extend in the one direction and connected to the second end portion at a tip in the one direction of the second extended portion, one contact selected from the group consisting of the first contact and the second contact being a moving contact, the other contact selected from the group consisting of the first contact and the second contact being a fixed contact, the moving contact being configured to move between a closed position where the moving contact is in contact with the fixed contact and an open position where the moving contact is out of contact with the fixed contact, at least the first end portion, out of the first end portion and the second end portion, being curved to be folded back from a tip in the one direction of the first end portion, the first contact being located in a folded-back part of the first end portion and facing the second contact, the first extended portion and the folded-back part of the first end portion being constituted by a single member, and the first contact being located between the first extended portion and the second contact.

2. The contact device of claim 1, wherein the first conductive portion includes a base member which covers a part of the first end portion and to which the first contact is crimped.

3. The contact device of claim 1, wherein the first conductive portion includes a base member which covers a part of the first end portion and to which the first contact is fixed, and a surface of the base member is flush with a surface, facing the second contact, of the first contact.

4. The contact device of claim 1, further comprising at least one permanent magnet facing at least one of the first contact or the second contact in a predetermined direction, and the predetermined direction is perpendicular to not only the one direction but also a direction in which the first contact and the second contact face each other.

5. The contact device of claim 4, wherein the at least one permanent magnet includes two permanent magnets, at least one of the first contact or the second contact is located between the two permanent magnets, the second conductive portion includes a base portion, the second contact is fixed to the base portion, and the predetermined direction is perpendicular to not only a direction in which the first contact and the second contact face each other but also a longitudinal axis of the base portion.

6. The contact device of claim 1, further comprising a case in which the first conductive portion and the second conductive portion are housed, wherein an internal space of the case includes:

a space located in the one direction with respect to the first end portion and the second end portion; and at least one of a space located, in a direction in which the first contact and the second contact face each other, opposite from the second contact when viewed from the first contact or a space located, in the direction in which the first contact and the second contact face each other, opposite from the first contact when viewed from the second contact.

7. The contact device of claim 1, wherein when viewed in a direction in which the first contact and the second contact face each other, the second contact has a curved outer peripheral edge.

8. The contact device of claim 1, further comprising a case including:

a case body in which the first conductive portion and the second conductive portion are housed; and an inserting portion which is provided inside the case body and to which a permanent magnet is inserted.

9. An electromagnetic relay comprising:

the contact device of claim 1; and a driving unit, wherein the driving unit includes:

a coil; and an armature configured to be displaced according to a variation in energization state of the coil to drive a conductive portion having the moving contact, which is either the first conductive portion or the second conductive portion, and thereby move the moving contact between the closed position and the open position.

10. The electromagnetic relay of claim 9, wherein the driving unit further includes a card configured to be displaced, as the armature is displaced, to drive a conductive portion having the moving contact, which is either the first conductive portion or the second conductive portion, and thereby move the moving contact between the closed position and the open position, the card has electrical insulation properties and is arranged between the armature and the conductive portion having the moving contact which is either the first conductive portion or the second conductive portion, and the conductive portion having the moving contact, which is either the first conductive portion or the second conductive portion, further includes a facing portion that faces the card, the facing portion being located opposite from the fixed contact when viewed from a surface, facing the fixed contact, of the moving contact.

11. The electromagnetic relay of claim 9, wherein the contact device further includes a case in which the first conductive portion, the second conductive portion, and the driving unit are housed, and the case has an inner wall between the conductive portion having the moving contact, which is either the first conductive portion or the second conductive portion, and the armature, the inner wall separating a space in which the fixed contact and the moving contact are arranged from a space in which the armature is arranged.

12. A contact device comprising:

a first conductive portion including a first end portion and a first extended portion, the first end portion including a first contact, the first extended portion being provided to extend in one direction and connected to the first end portion at a tip in the one direction of the first extended portion, and a second conductive portion including a second end portion and a second extended portion, the second end portion including a second contact, the second extended portion being provided to extend in the one direction and connected to the second end portion at a tip in the one direction of the second extended portion, one contact selected from the group consisting of the first contact and the second contact being a moving contact, the other contact selected from the group consisting of the first contact and the second contact being a fixed contact, the moving contact being configured to move between a closed position where the moving contact is in contact with the fixed contact and an open position where the moving contact is out of contact with the fixed contact, at least the first end portion, out of the first end portion and the second end portion, being curved to be folded back from a tip in the one direction of the first end portion, the first contact being located in a folded-back part of the first end portion and facing the second contact, the first conductive portion includes a base member which covers a part of the first end portion and to which the first contact is fixed, a surface of the base member is flush with a surface, facing the second contact, of the first contact, and the first end portion has a surface curved to extend from the tip in the one direction of the first end portion toward the second end portion.

13. A contact device comprising:

a first conductive portion including a first end portion and a first extended portion, the first end portion including a first contact, the first extended portion being provided to extend in one direction and connected to the first end portion at a tip in the one direction of the first extended portion, and a second conductive portion including a second end portion and a second extended portion, the second end portion including a second contact, the second extended portion being provided to extend in the one direction and connected to the second end portion at a tip in the one direction of the second extended portion, one contact selected from the group consisting of the first contact and the second contact being a moving contact, the other contact selected from the group consisting of the first contact and the second contact being a fixed contact, the moving contact being configured to move between a closed position where the moving contact is in contact with the fixed contact and an open position where the moving contact is out of contact with the fixed contact, at least the first end portion, out of the first end portion and the second end portion, being curved to be folded back from a tip in the one direction of the first end portion, the first contact being located in a folded-back part of the first end portion and facing the second contact, the first extended portion and the second extended portion both have length in the one direction, and the first end portion has:

an intermediate portion connected to the first extended portion, and a curved portion having a curved shape and extended in a direction opposite from the one direction from a tip in the one direction of the intermediate portion, and the first contact is present in the curved portion and faces the second contact.

14. The contact device of claim 13, further comprising:

a permanent magnet; and a yoke arranged adjacent to the permanent magnet, wherein a distance between a part, adjacent to the permanent magnet, of the yoke and the fixed contact is longer than a distance between a part, adjacent to the yoke, of the permanent magnet and the fixed contact.

15. The contact device of claim 14, wherein the yoke includes:

two side portions located, in a predetermined direction, on both sides of the fixed contact, the predetermined direction being perpendicular to both the one direction and a direction in which the fixed contact and the moving contact face each other; and a coupling portion coupling the two side portions together.

16. The contact device of claim 15, comprising a case having an internal space in which the fixed contact and the moving contact are arranged, wherein the coupling portion has an opening, the internal space includes a space inside the opening, and the case includes a housing portion housing the permanent magnet and the yoke and separating the permanent magnet and the yoke from the internal space.

17. The contact device of claim 15, wherein one contact selected from the group consisting of the fixed contact and the moving contact is located between the other contact and the coupling portion.

18. The contact device of claim 14, wherein the permanent magnet is located on one side in a predetermined direction of the fixed contact, the predetermined direction being perpendicular to both the one direction and a direction in which the fixed contact and the moving contact face each other.

19. The contact device of claim 13, wherein part of the first end portion is curved such that as a distance to a tip portion in a direction opposite from the one direction of the first end portion decreases, a distance from the second contact to the part of the first end portion increases.

20. An electromagnetic relay comprising:
the contact device of claim 13; and
a driving unit, wherein
the driving unit includes:
a coil; and
an armature configured to be displaced according to a variation in energization state of the coil to drive a conductive portion having the moving contact, which is either the first conductive portion or the second conductive portion, and thereby move the moving contact between the closed position and the open position.

* * * * *